US011235907B2

(12) United States Patent
Workman

(10) Patent No.: US 11,235,907 B2
(45) Date of Patent: Feb. 1, 2022

(54) MODULAR STORAGE CONTAINER

(71) Applicant: Jeanne Workman, Provo, UT (US)

(72) Inventor: Jeanne Workman, Provo, UT (US)

( * ) Notice: Subject to any disclaimer, the term of this patent is extended or adjusted under 35 U.S.C. 154(b) by 0 days.

(21) Appl. No.: 17/035,055

(22) Filed: Sep. 28, 2020

(65) Prior Publication Data

US 2021/0147113 A1 May 20, 2021

Related U.S. Application Data

(60) Provisional application No. 62/937,694, filed on Nov. 19, 2019.

(51) Int. Cl.

| | |
|---|---|
| ***B65D 21/08*** | (2006.01) |
| ***B65D 25/06*** | (2006.01) |
| ***B65D 43/02*** | (2006.01) |
| ***B65D 55/16*** | (2006.01) |
| ***B65D 25/28*** | (2006.01) |

(52) U.S. Cl.

CPC ..... *B65D 21/083* (2013.01); *B65D 25/06* (2013.01); *B65D 25/2891* (2013.01); *B65D 43/0212* (2013.01); *B65D 55/16* (2013.01); *B65D 2543/00537* (2013.01)

(58) Field of Classification Search

CPC ..... B65D 21/083; B65D 25/06; B65D 2501/24222; B65D 2501/24929; A45D 13/02; A45D 2013/026; B25H 3/021; B25H 3/023

See application file for complete search history.

(56) References Cited

U.S. PATENT DOCUMENTS

| | | | | |
|---|---|---|---|---|
| 1,862,057 | A | 6/1932 | Lewis | |
| 3,958,715 | A | 5/1976 | Capelli | |
| 4,190,172 | A * | 2/1980 | Box | B65D 85/305 206/511 |
| 4,577,773 | A * | 3/1986 | Bitel | A47B 88/994 220/533 |
| 5,103,998 | A | 4/1992 | Caro | |
| D364,039 | S * | 11/1995 | Kruger | D3/315 |
| 5,484,078 | A | 1/1996 | Bronovicki | |
| 5,806,708 | A | 9/1998 | Schwab | |
| 5,833,052 | A | 11/1998 | Diamond | |
| 7,117,991 | B2 * | 10/2006 | Waring | A45C 13/04 206/45.2 |
| 7,784,145 | B1 | 8/2010 | Prokop | |
| 7,992,250 | B2 | 8/2011 | Prokop | |
| 8,162,147 | B1 * | 4/2012 | Ting | B65D 85/38 206/707 |
| 8,893,915 | B2 | 11/2014 | Vargas | |
| 9,682,471 | B2 | 6/2017 | Jacobson | |
| 10,478,963 | B1 | 11/2019 | Workman | |
| 2003/0085142 | A1 | 5/2003 | Ouimette | |

(Continued)

*Primary Examiner* — Andrew T Kirsch

(74) *Attorney, Agent, or Firm* — David R. Conklin; Kirton McConkie

(57) ABSTRACT

A storage container having a base storage compartment configured to receive a divider by which the storage compartment is divided into two or more sub-compartments, wherein divider comprises one or more engagement features for selectively engaging with the storage container, the storage container further having a retainer lid configured to retain a divider within an engagement surface of the storage container.

17 Claims, 42 Drawing Sheets

(56) References Cited

U.S. PATENT DOCUMENTS

| | | | | |
|---|---|---|---|---|
| 2008/0128428 | A1* | 6/2008 | Beckerman | B65D 25/06<br>220/532 |
| 2008/0230418 | A1 | 9/2008 | Brouard | |
| 2018/0251263 | A1 | 9/2018 | Akro-Mils | |
| 2018/0362212 | A1 | 12/2018 | Bahr | |

* cited by examiner

MODULAR STORAGE CONTAINER

RELATED APPLICATIONS

This U.S. Patent Applications claims the benefit of U.S. Provisional Patent Application Ser. No. 62/937,694, filed Nov. 19, 2019, which is incorporated herein by reference in its entirety.

FIELD OF THE INVENTION

This invention generally relates to portable containers for storing various items according to the specific needs and desires of a user. Specifically, the present invention relates to a storage container having a base storage compartment configured to receive one or more dividers by which the storage compartment is divided into two or more sub-compartments, wherein at least one of the dividers further includes a tool configured to provide a secondary utility. The present invention further relates to various systems, methods, and structures for selectively securing a plurality of dividers at various desired locations within a storage container. Further still, the present invention relates to a modular storage container adapted to receive a subset of specialized dividers selected from amongst a plurality of specialized dividers, wherein the modular storage container is customized for a specific use dependent upon the selection of specialized dividers in the subset of specialized dividers.

BACKGROUND OF THE INVENTION

Many service and trade professions involve tools or other objects which are required in order for the worker to quickly and efficiently perform their service. For example, both mechanics and surgeons utilize a variety of tools and materials that must be organized and readily accessible during the performance of a task. Similarly, housekeepers and tradesman (i.e., plumbers, electricians, carpenters, repair technicians, handymen, etc.) utilize a wide variety of tools, parts, chemicals, etc. that are highly specialized to the specific task at hand. In addition to professional occupations, many crafts and hobbies involve the use of tools, chemicals, adhesives, and a variety of small parts which are easily misplaced or obscured by other equipment.

When a user is required to search for items while performing a task, the efficiency of the user decreases and frustration often occurs. In some instances, a user's inability to quickly and efficiently locate a needed item can result in increased consumer costs, repurchase of "lost" items, or in the case of a surgeon, added patient injury and/or death.

There currently exist a variety of storage-specific containers or other containers that are commonly used or retrofitted to meet the storage needs of a user. For example, a standard five-gallon bucket is commonly used by tradesmen to hold their various tools, parts and materials for use on a jobsite. In some instances, all of the user's materials are simply placed into the bucket in a random manner, whereby the user is required to dig and sort through the contents of the bucket to find their desired items. Various storage or organizing systems are available for five-gallon buckets, some of which include internal dividers, stackable organizing trays, and/or internal/external storage pockets which hang from the rim of the bucket. Alternative storage containers include a variety of caddies, totes, trays, carts and other types of storage containers having a variety of compartments having shapes and sizes that are generally designed to receive one or more common items. For example, a caddy advertised and sold for use with cleaning tools, may include a compartment having dimensions for receiving a standard spray bottle. For hobbies and crafts, or other instances where storage of small items is desired, a variety of storage systems are available which include movable dividers which may be strategically placed by the user to achieve a desired sub-compartment layout. Generally, these dividers are placed between sidewalls of the container and/or between one or more immovable interior wall or divider. Thus, the user may be limited in one or more desired dimension of a desired sub-compartment.

Thus, while systems and methods currently exist for organizing and providing ready access to a variety of tools, items and materials, challenges still exist. The present invention addresses and overcomes these challenges.

BRIEF SUMMARY OF THE INVENTION

The present disclosure relates generally to a portable, modular storage container for storing various items according to the specific needs and desires of a user. In some instances, the storage container includes a planar base that is generally rectangular and includes sidewalls extending about or surrounding a perimeter of the planar base, wherein an upper perimeter edge of the sidewalls defines an opening of the storage container. In some instances, the planar base and sidewalls define an interior volume of the storage container.

In some instances, the upper perimeter edge of the sidewalls further includes a rim. In some instances, the rim reinforces the sidewalls. In some instances, the rim further includes one or more internal channels or pathways forming a storage compartment within a portion of the rim. In some instances, the sidewalls further comprise an inner surface having two or more receptacles which are arranged opposite one another and configured to compatibly and selectively receive a divider. In some instances, the two or more receptacles comprise a channel or recessed surface of the inner surface of the sidewall. In some instances, the two or more receptacles comprise a ridge, rail or extension of the inner surface of the sidewall.

In some instances, the storage container further includes a handle. In some instances, the handle is coupled to at least one of the planar base, the sidewalls, and the rim. In some instances, the handle divides the interior volume into two or more sub-compartments, wherein a portion of the handle that is located within the interior volume comprises one or more receptacles. In some instances, a portion of the handle extends outwardly from the interior volume and is positioned above the upper perimeter edge and/or rim portions of the container.

The present invention further comprises a divider configured to selectively couple to the inner surface of the sidewall via the two or more receptacles. In some instances, a divider includes first and second side edges that are configured to selectively coupled to the two or more receptacles. In some instances, a divider further includes a bottom edge configured to contact an inner surface of the planar base. In some instances, a bottom edge of the divider is suspended above an inner surface of the planar base when first and second edges of the divider are fully engaged with the two or more receptacles. In some instances, the divider further comprises a top edge positioned opposite the bottom edge, wherein the divider further comprises a body defined by the top, bottom, first side, and second side edges.

In some instances, the top edge of the divider comprises a rim or lip that extends outwardly from the body and is configured to contact and rest on a portion of the upper perimeter edge and/or rim of the storage container when first and second side edges are engaged with the two or more receptacles.

In some instances, the tool portion of the divider comprises a first tool wall positioned at 90 degrees from a second tool wall, wherein first and second tool walls further comprise one or more edges, splines, ridges, channels or other compatible feature or surface for selectively engaging the one or more receptacles of the storage container. In some instances, a tool wall of the divider comprises one or more edges configured to selectively one or more receptacles of the storage container. In some instances, a first set of edges of the first tool wall is configured to selectively engage a first set of receptacles on a first sidewall of the storage container, and a second set of edges of the second tool wall is configured to selectively engage a second set of receptacles on a third sidewall of the storage container, wherein the third sidewall is 90 degrees to the first sidewall. In some instances, the second set of receptacles is provided on a divider of the present invention. In some instances, the tool comprises a third tool wall positioned opposite the first tool wall, and a fourth tool wall positioned opposite the second tool wall, wherein the third tool wall and fourth tool wall comprise a third set of edges, and a fourth set of edges, respectively. In some instances, the third set of edges is configured to selectively engage a third set of receptacles provided on a second sidewall of the storage container, and the fourth set of edges is configured to selectively engage a fourth set of receptacles on a fourth sidewall, wherein the second and fourth sidewalls are parallel to one another and 90 degrees to first and third sidewalls of the storage container. In some instances, any one of the first, second, third, and fourth sidewalls of the storage container may comprise a divider of the present invention. In some instances, a body or other surface of any one of the first, second, third, and fourth sidewalls may comprise one or more receptacles configured to receive one or more edges or other compatible surfaces or features of a divider, tool, or tool wall of the present invention. Thus, first, second, third, and fourth sidewalls may be substituted with first, second, third, and/or fourth dividers, in any desired combination.

In some instances, the tool portion further comprises a concave or convex surface. In some instances, the tool portion comprises a radius. In some instances, the tool portion of the divider comprises one or more receptacles. In some instances, a cross-section of the body is at least one of a square, a rectangle, a triangle, a circle, and an annulus.

Various dividers of the present invention further comprise one or more tools integrated into one or more surfaces of the divider. For example, in some instances a bottom edge of the divider includes a tapered surface comprising a scraper. In some instances, the tapered surface comprises a knife edge. In some instances, a bottom edge of the divider comprises a plurality of tines. In some instances, a bottom edge of the divider comprises an abrasive scrubbing material. In some instances, the body portion of the divider comprises a screwdriver tip.

In some instances, the divider comprises a single material. In some instances, the divider comprises two or more materials, wherein one or more additional materials are selected to provide a desired property or mechanical advantage for the tool portion of the divider. For example, in some instances the bottom edge comprises a metal material that may be sharpened to provide a knife edge, or that may be provided simply as a scraping surface (such as for use in removing adhesive labels or other residue from glass or tile surfaces). In another example, the bottom edge comprises an abrasive scrubbing material, such as coiled stainless steel, steel wool, or a plastic mesh (such as a Scotch-Brite® pad).

In some instances, a tool portion of a divider comprises a plurality of tool sides or walls forming a container or compartment, wherein an outer surface of each tool wall is configured to compatibly and selectively engage a receptacle of the storage container. In some instances, the tool portion of the divider is a storage compartment. In some instances, the tool portion of the divider comprises a plurality of storage compartments. In some instances, the tool portion of the divider is watertight, such as a rinse cup or container. In some instances, the tool portion of the divider comprises a hemispherical concave recess configured to compatibly receive and store a brush end of a toilet brush, wherein the concave recess comprises one or more drainage holes.

The present invention further includes one or more external storage containers, compartments, or tools configured to compatibly and selectively couple to an outer surface of one or more sidewalls of the storage container. In some instances, the one or more external storage containers, compartments or tools is configured to compatibly and selectively couple to the rim of the storage container. In some instances, the one or more external storage container, compartments or tools is configured to compatibly and selectively couple to the storage container via an adapter, such as a hook, a receptacle, a slot, a keyed interface, or the like. In some instances, an exterior surface of the storage container comprises one or more receptacles configured to compatibly and selectively receive one or more edges or other features of a divider, tool, or tool wall of the present invention. In some instances, an external storage container or compartment comprises a cup holder. In some instances, an external storage container or compartment comprises a cellphone holder. In some instances, an external tool comprises a wireless speaker. In some instances, an external tool comprises a retractable cord for holding keys or an identification badge. In some instances, an external tool comprises one or more hooks or other features configured to secure a tool, a part, a material, or other desired item. In some instances, a surface of the storage container comprises a tool that is embedded therein or applied thereon, for example a surface of the storage container may include a sidewall, a rim, or a handle.

In some instances, a storage container is provided having smooth and/or featureless inside walls. In some instances, an interior floor surface of a storage container comprises a plurality of grooves forming a grid pattern of intersecting horizontal and vertical grooves, wherein at least some of the intersecting horizontal and vertical grooves are interconnected. In some instances, the grid pattern of grooves forms a network of interconnected grooves, wherein the network of interconnected grooves forms a reservoir for collecting and isolating liquids from the interior floor surface such that an item in contact with the interior floor surface is prevented from contacting the liquid in the reservoir. In some instances, the grid pattern of grooves is configured to receive a bottom edge of a divider. In some instances, the interconnected grooves of the grid pattern comprise tapered walls. In some instances, the interconnected grooves of the grid pattern comprise rounded walls and/or edges.

In some instances, a storage container is provided having a raised perimeter edge comprising an engagement surface for selectively engaging and maintaining a desired position of a divider coupled thereto. In some instances, the plurality of surfaces comprises a plurality of single notches. In some instances, the plurality of surfaces comprises a plurality of overlapping notches, wherein the overlapping notches comprise different widths. For example, in some instances a first notch having a first width is provided in the raised perimeter edge, and a second notch having a second width is provided in the first notch, wherein the second width is less than the first width. In some instances, the plurality of surfaces is a stepped surface comprising vertical and horizontal surfaces.

In some instances, an exterior or interior surface of the raised perimeter edge comprises a catch positioned in proximity to the surface for selectively engaging and maintaining a desired position of a divider coupled thereto, wherein the catch is configured to receive a compatible engagement feature of the divider. In some instances, a compatible engagement feature of the divider comprises a bump, a recess, a texture, or the like.

In some instances, the raised perimeter edge comprises a plurality circular receptacles configured to receive a peg extension of a divider. In some instances, the circular receptacles have a wedged or tapered upper opening having a first width that is greater than the diameter of the peg extension, and a second width that is approximately equal to, or slightly smaller than the diameter of the peg extension, wherein the wedged opening tapers inwardly towards the circular receptacle from the first width to the second width. In some instances, the second width of the wedged opening is slightly biased and/or temporarily deformed by mechanical interference of the peg extension to permit passage of the peg extension into the circular receptacle, wherein once the peg extension is seated within the circular receptacle, the second width is restored thereby retaining the peg extension within the circular receptacle. In some instances, the material of at least one of the peg extension and the raised perimeter edge is elastic such that it may be temporarily and repeatedly deformed through mechanical interference between the peg extension and the circular receptacle and/or wedged opening. In some instances, a tolerance between the peg extension and the wedged opening and/or circular receptacle is selected to permit repeated insertion and removal of the peg extension within the circular receptacle without weakening the respective materials. In some instances, the peg extension may be removed from the circular extension via the wedged opening by applying a mechanical force on the peg extension in the direction of the wedged opening, wherein the mechanical force is sufficient to temporarily bias at least one of the peg extension and the circular receptacle to allow the peg extension to pass through the second width of the wedged opening.

In some instances, a height of the divider and/or the distance between the openings of the grooves and the raised perimeter edge is selected to enable an initial engagement of the divider with a desired groove in the floor surface of the storage container, and a subsequent engagement of the divider with the raised perimeter edge. In some embodiments, this two-step engagement process provides increased control and ease when installing a divider within the storage container.

In some instances, a storage container is provided having a removable handle. In some instances, a removable handle of a storage container is selectively coupled to the storage container by inserting the handle into a receptacle, wherein one or more surfaces of the handle mechanically and compatibly engage with the receptacle to retain the handle therein. In some instances, the handle may be removed by accessing and disengaging the engaged surfaces of the handle and the receptacle of the storage container. In some instances, the handle is initially unattached to the storage container, but may subsequently be coupled to the storage container. In some instances, the handle may be reversibly coupled to the storage container. In some instances, the handle is irreversibly coupled to the storage container.

In some instances, a storage container is provided comprising a raised perimeter edge having a plurality of u-shaped receptacles configured to receive a peg extension of a divider. In some instances, a retainer lid is provided having one or more surfaces configured to overlap and/or cover a receptacle in a raised perimeter edge of the storage container, wherein the retainer lid is configured to retain a seated position of a divider in the receptacle of the storage container. The retainer lid includes a center support having an opening to receive a handle of the base portion of the storage container, and further defines one or more openings through which the interior volume and surfaces of the storage container may be accessed. In some instances, the retainer lid comprises one or more alignment tabs configured to interact with one or more wall surfaces of the storage container, thereby aligning the retainer lid with the storage container. In some instances, the retainer lid comprises one or more catches configured to secure the retainer lid to an outer perimeter of the storage container, such as a perimeter stop of the container.

In some instances, the present invention provides a method for assembling a storage container, said method comprising steps for: i) providing a storage container comprising a raised perimeter edge having a plurality of receptacles, ii) inserting a divider or equivalent part into the storage container by seating a peg extension of the divider into the plurality of receptacles, and iii) retaining the seated position of the peg extension in the plurality of receptacles by securing a retainer lid to the storage container.

It is to be understood that both the foregoing general description and the following detailed description are exemplary and explanatory and are not restrictive of the invention, as claimed.

BRIEF DESCRIPTION OF THE SEVERAL VIEWS OF THE DRAWINGS

Example embodiments will be described and explained with additional specificity and detail through the use of the accompanying drawings in which.

DETAILED DESCRIPTION OF THE INVENTION

The presently preferred embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

Figure 1:
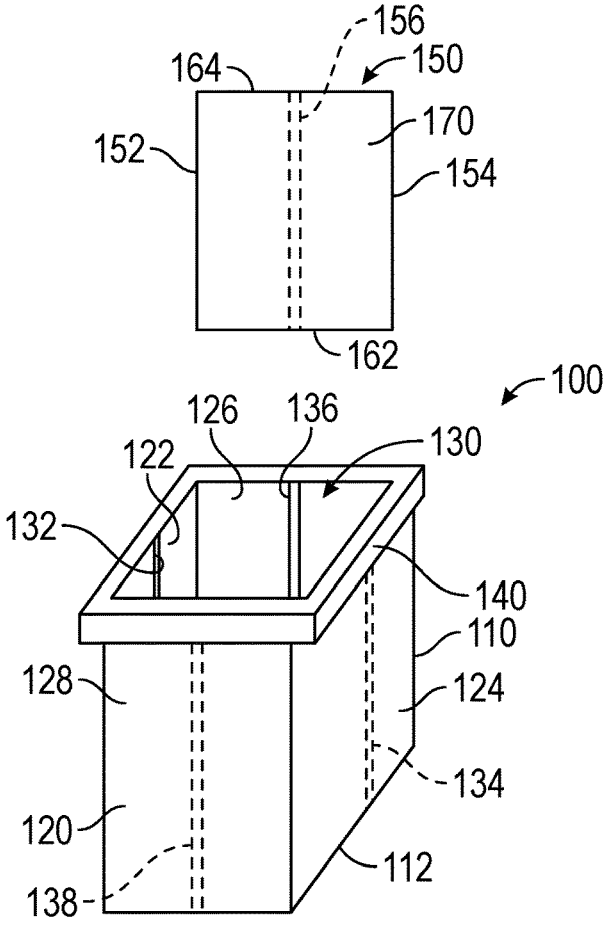
FIG. 1 is an exploded perspective view of a storage container and divider in accordance with a representative embodiment of the present invention.

Referring now to FIG. 1, a storage system 100 is shown. In some embodiments, a storage system 100 of the present invention comprises a storage container 110 generally comprising an interior volume 130 configured to receive and store one or more items. Storage container 110 may comprise any geometric shape or shapes. For example, in some embodiments storage container 110 comprises a rectangular box shape. Alternatively, storage container 110 may comprise a round, oval, triangular or other polygonal shape. Storage container 110 generally comprises a planar base 112 having an outer perimeter edge defining a shape, wherein the shape of planar base 112 defines an overall shape of the container.

Storage container 110 further comprises a plurality of sidewalls 120 coupled to the outer perimeter edge and enclosing planar base 112. Sidewalls 120 comprise a lower perimeter edge that is coupled to planar base 110, and further comprise an upper perimeter edge that is separated from the lower perimeter edge by a sidewall height. The height of sidewalls 120 defines a depth of storage container 110 and interior volume 130. In some embodiments, sidewalls 120 provide a continuous exterior wall surface for storage container 110. Sidewalls 120 further provide a continuous interior wall surface. In some embodiments, sidewalls 120 provides a first sidewall 122 positioned opposite a second sidewall 124, wherein first and second sidewalls 122 and 124 define a length of storage container 110. Sidewalls 120 further comprise a third sidewall 126 and fourth sidewall 128 positioned opposite third sidewall 126, wherein third and fourth sidewalls 126 and 128 define a width of storage container 110. In some embodiments, first, second, third and fourth sidewalls 122, 124, 126, 128 define interior volume 130.

The interior sidewall surfaces of storage container 110 further comprise one or more receptacles 132, 134, 136 and 138. Receptacles 132, 134, 136 and 138 may comprise any surface, feature or design compatible with the various embodiments of the present invention. For example, a suitable receptacle of the present invention may comprise a groove, a channel, a recess, a ridge, a spline, a rail, a dovetail slide, or other keyed or non-keyed interface surface. In some embodiments, first sidewall 122 comprises a first receptacle vertically disposed between the upper and lower perimeter edges of first sidewall 122. In some embodiments, at least one of second, third, and fourth sidewalls 124, 126 and 128 further comprise second, third, and fourth receptacles 134, 136 and 138, respectively. In some embodiments, each sidewall surface comprise a plurality of receptacles.

In some embodiments, storage container 110 further comprises a rim 140 coupled to and circumscribing the upper perimeter edge of sidewalls 120. Rim 140 generally provides a thicker or wider profile or shape to the upper perimeter edge and further reinforces sidewalls 120. In some embodiments, rim 140 comprises one or more channels or pathways forming a storage compartment, as discussed in detail below.

Storage system 100 further comprises a divider 150. Divider 150 is generally coupled to two or more receptacles of storage container 110 in order to divide the interior volume 130 into two or more spaces or sub-compartments. In some embodiments, divider 150 comprises the same material as storage container 110. In some embodiments, divider 150 comprises two or more materials having desired properties within the scope of the present invention. In some embodiments, divider 150 is generally planar having a rectangular shape with a width and height configured to divide interior volume 130 into two or more sub-compartments. In addition to dividing interior volume 130, divider 150 further comprises one or more tools configured to provide an auxiliary function, wherein the auxiliary function is beneficial to the user or an intended use or function for which the storage container 110 is intended.

In some embodiments, divider 150 comprises a first edge 152 configured to selectively coupled to first receptacle 132, and further comprises a second edge 154 configured to selectively couple to second receptacle 134. Divider 150 comprises a bottom edge 162 configured to contact an inner surface of planar base 112 when first and second edges 152, 154 are selected engaged with first and second receptacles 132, 134. Divider 150 further comprises a top edge 164 positioned opposite bottom edge 162 and generally positioned in proximity to upper perimeter edge and/or rim 140 when engaged with, or coupled to receptacles 132, 134.

Divider 150 further comprises a body 170 defining a surface between first, second, bottom and top edges 152, 154, 162, 164. In some embodiments, body 170 is generally planar. In some embodiments, body 170 comprises a three-dimensional shape. In some embodiments, body 150 comprises one or more receptacles 156.

Divider 150 further comprises a tool or tool surface, wherein the tool provides an auxiliary function or benefit to the user. For example, divider 150 provides a primary or first function of engaging receptacles 132 and 134 to divide interior volume 130 into two sub-compartments, and further comprises a tool that provides an auxiliary or second function separate and apart from the first function. Thus, divider 150 provides two or more functions, wherein at least one of the functions is to divide interior volume 130.

Figure 2A:
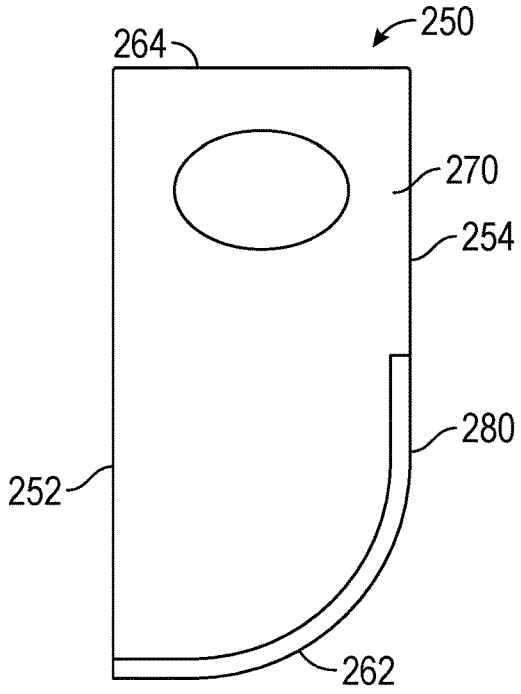
FIGS. 2A-2F provide front and side plan views of various dividers having tools in accordance with various representative embodiments of the present invention
Figure 2B:
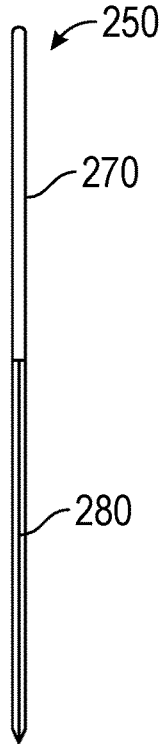

Referring now to FIGS. 2A and 2B, a divider 250 is shown having an integrated tool or tool surface 280 comprising a scraper. Divider 250 generally comprises a planar body 270. A lower portion of second edge 254 and the entire bottom edge 262 is beveled or tapered to provide a sharpened tip or edge that may be used as a scraper. In some embodiments, bottom edge 262 is asymmetrical, wherein an intersection between bottom edge 262 and first side 252 is a right angle, and an intersection between bottom edge 262 and second edge 254 is a radius. In some embodiments, divider 250 and tool or tool surface 280 comprise an identical material, such as a polymer. In some embodiments, divider 250 comprises a polymer material and tool 280 comprises a metal material. In some embodiments, divider 250 and tool 280 comprise a metal material. In some embodiments, tool 280 comprises a metal material that may be sharpened to provide a knife edge. In some embodiments, tool 280 is disposable and/or replaceable. In some embodiments, tool 280 is located entirely on bottom edge 262, wherein bottom edge 262 is straight or contoured. In some embodiments, tool 280 comprises a single bevel. In some embodiments, tool 280 comprises a double bevel. In some embodiments, tool 280 comprises a double bevel having a first side comprising a first bevel angle and a second side comprising a second bevel angle that is greater than the first bevel angle.

Figure 2C:
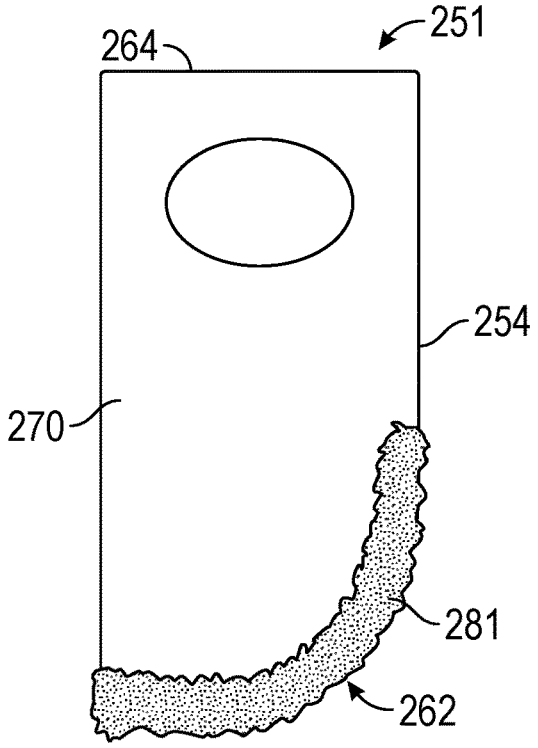
Figure 2D:
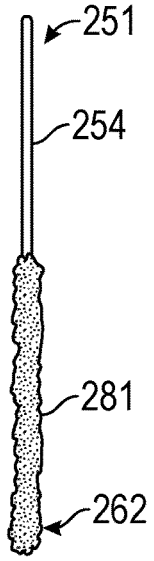

Referring now to FIGS. 2C and 2D, a divider 251 is shown having an integrated tool 281 comprising a scrubbing pad or material. In some embodiments, a lower portion of second edge 254 and the entire bottom edge 262 comprises an abrasive scrubbing material, such as coiled stainless steel, steel wool, pumice, sandpaper, or a plastic mesh material, such as a Scotch-Brite® pad. In some embodiments, the abrasive scrubbing material of tool 281 is coupled to second and bottom edges via an adhesive. In some embodiments, the abrasive material is integrated, incorporated, or infused into the material of divider 251. In some embodiments, divider 251 is comprised of an abrasive material.

Figure 2E:
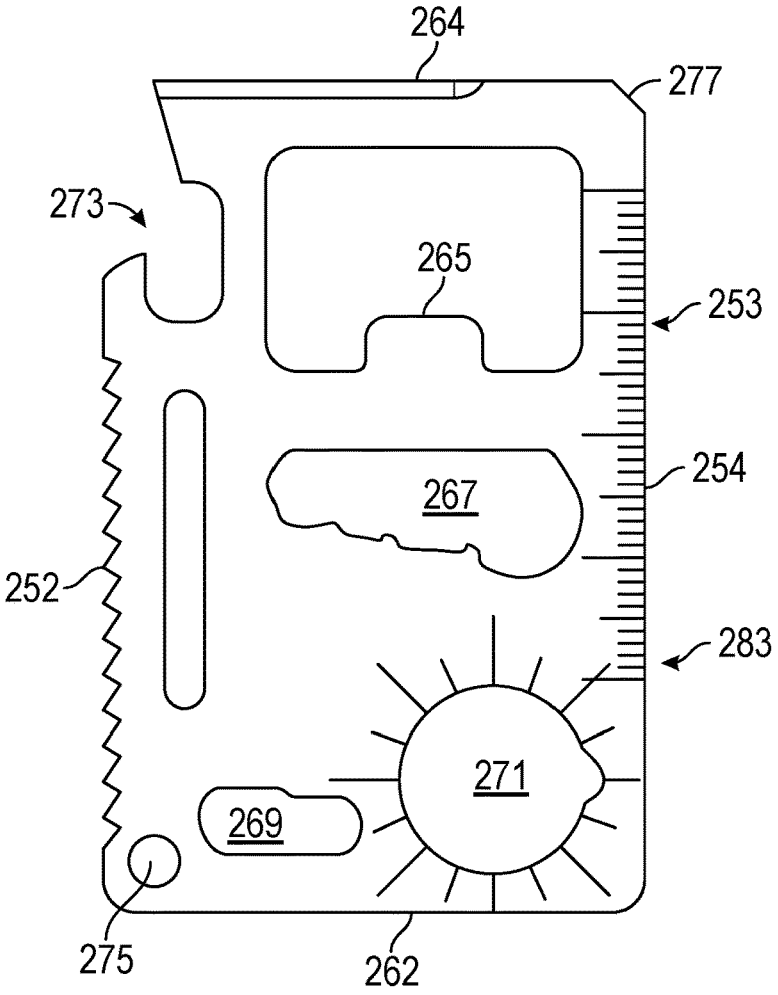
Figure 2F:
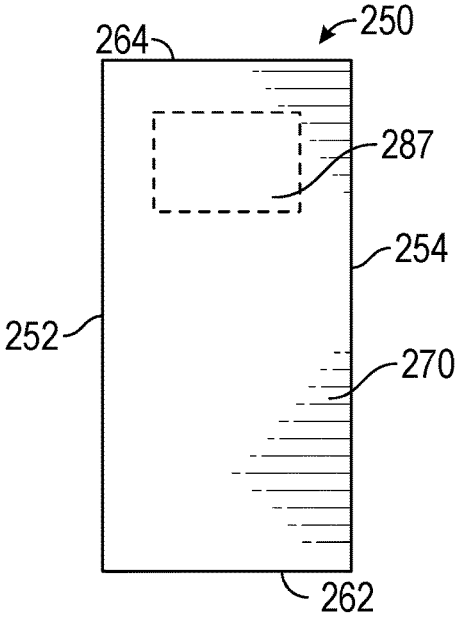

Referring now to FIG. 2E, a divider 253 is shown having a plurality of tools, wherein divider 253 is a multi-tool 283. In some embodiments, divider 253 comprises two or more tools that provide additional benefits to the storage system. For example, in some embodiments an edge surface, such as first edge 252, comprises a saw edge. In some embodiments, an edge surface, such as second edge 254, comprises a ruler. In some embodiments, an edge surface, such as top edge 264, comprises a blade or knife edge. In some embodiments, tool 283 further comprises one or more of a bottle opener 265, a four-position wrench 267, a two-position wrench 269, and a direction indicator 271. In some embodiments, one or more corners of divider 253 further comprises a tool, such as a can opener 273, a keyring hole 275 and/or a screwdriver tip 277. One having skill in the art will readily recognize and understand that divider 253 can be modified to include any number and variety of tools configured to provide one or more additional benefits to storage system 100.

In some embodiments, a divider of the present invention comprises a tool 287 that is embedded within body 270, or applied to an outer surface of body 270, as shown in FIG. 2E. In some embodiments, tool 287 comprises a magnet. In some embodiments, tool 287 comprises an RFID chip, such as part of a security access card or identification badge. In some embodiments, tool 287 comprises a mirror. In some embodiments, tool 287 comprises an adhesive memo pad. In some embodiments, tool 287 comprises a power source, such as a portable charger. In some embodiments, tool 287 comprises a thumb drive. In some embodiments, tool 287 comprises a hook and/or loop fastener material. In some embodiments, tool 287 comprises a magnifying glass. In some embodiments, tool 287 comprises a bubble level. In some embodiments, tool 287 comprises a carpenter square. In some embodiments, tool 287 comprises a joint knife, a putty knife, a plaster knife, a mud knife, a taping knife, a spackle knife, or the like. In some embodiments, tool 287 comprises a chisel or chisel edge. In some embodiments, tool 287 comprises a wire brush or a plurality of wire bristles. In some embodiments, tool 287 comprises a length of adhesive tape, such as masking tape, duct tape, pressure-sensitive tape, double-sided tape, electrical tape, and the like. In some embodiments, tool 287 comprises a mount configured to hold a roll of adhesive tape. In some embodiments, tool 287 comprises a mount configured to hold a roll of solder. In some embodiments, tool 287 comprises a mount configured to hold and store an electrical cord, such as an extension cord, a lamp cord, a power cord of an appliance or a consumer product that is stored within, or used in combination with storage container 110.

Figure 2G:
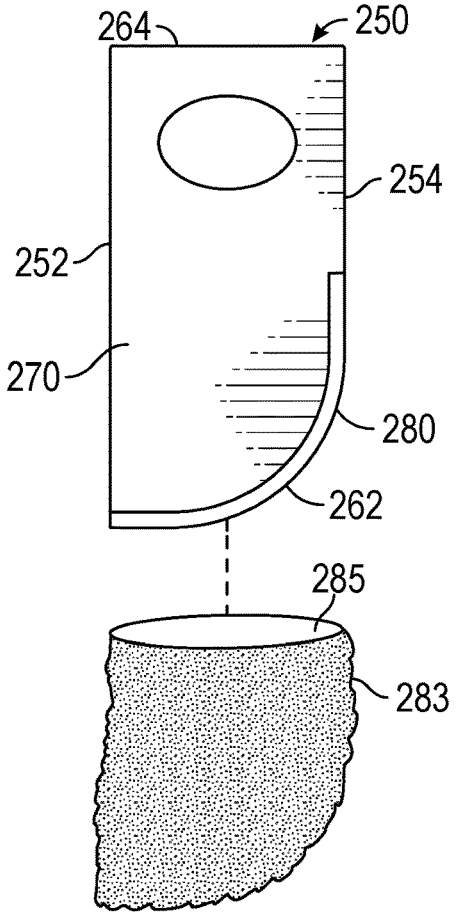
FIG. 2G is an exploded perspective view of a divider and auxiliary tool in accordance with a representative embodiment of the present invention.

Some embodiments of the present invention further comprise an auxiliary tool 283 configured to connect with or otherwise engage divider 250 to provide an additional benefit or function to tool 280, divider 250, and storage system 100. For example, in some embodiments storage system 100 further comprises an auxiliary tool 283 comprising a cover, sleeve, or cozy having an opening 285 configured to receive bottom edge 262, a portion of body 270, and one or more additional surfaces of divider 250, as shown in FIG. 2G. In some embodiments, auxiliary tool 283 comprises an abrasive scrubbing or scouring material. In some embodiments, auxiliary tool 283 comprises a squeegee surface. In some embodiments, auxiliary tool 283 comprises a sponge. In some embodiments, auxiliary tool 283 comprises a cleaning solution or material, such as soap, bleach, ammonia, or an antibacterial agent.

Figure 3:
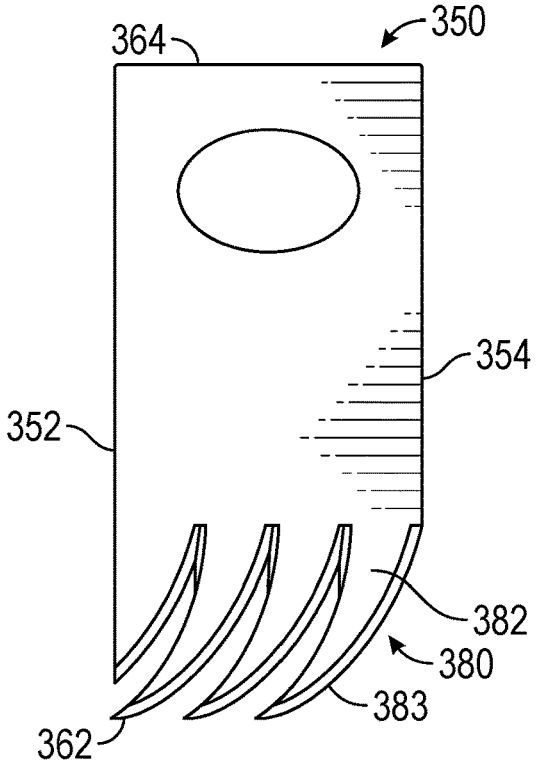
FIG. 3 is a front plan view of a divider having a tool in accordance with a representative embodiment of the present invention.

Referring now to FIG. 3, a divider 350 is shown having an integrated tool 380 comprising a plurality of tines 382 forming a comb. The plurality of tines 382 are formed from portions of first and second edges 352 and 354, and the entirety of bottom edge 362. In some embodiments, tool 380 comprises one or more features for use as a tool to remove hair, string, carpet fibers and other debris from the brushroll of a vacuum. For example, in some embodiments tines 382 are curved or arched to provide a hook-shape or contour to the comb. Tines 382 may further comprise beveled edges 383. In some instances, beveled edges 383 are sharpened. In some instances, tool 380 comprises a metal material, whereby beveled edges 383 are sharpened to a knife edge. Tines 382 may further comprise sharpened tips configured to assist a user in loosening tightly wound debris.

Figure 4A:
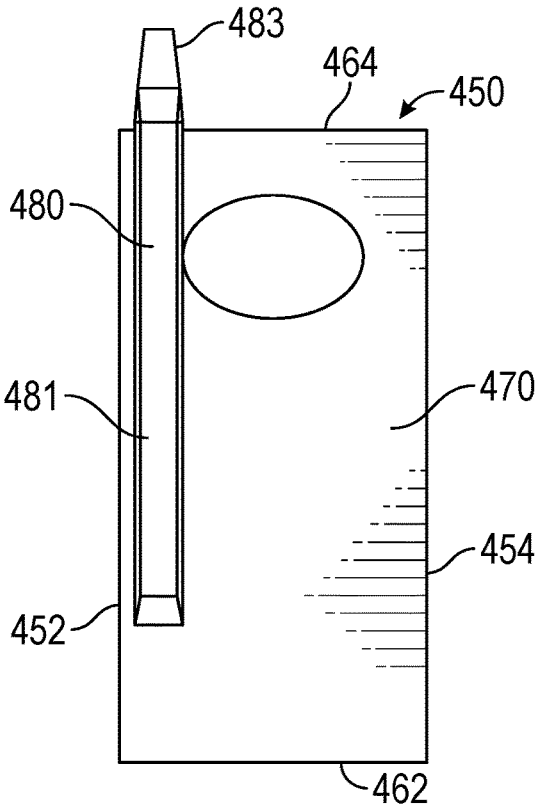
FIGS. 4A-5D provide front and side plan views of various dividers having tools in accordance with various representative embodiments of the present invention.
Figure 4B:
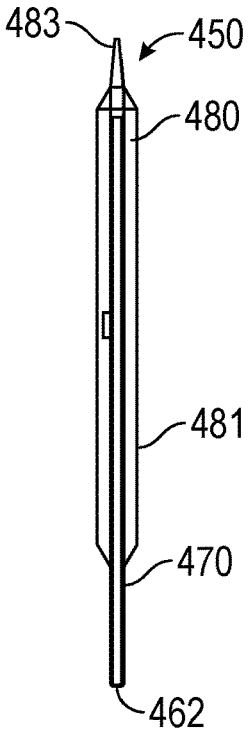
Figure 5A:
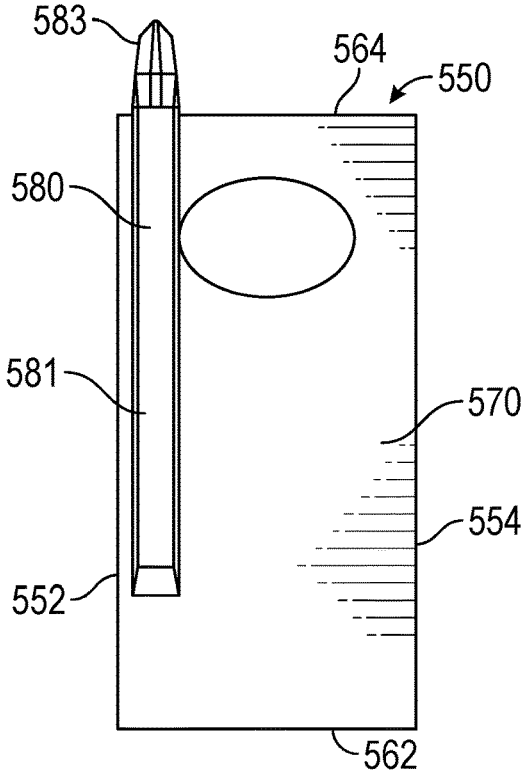
Figure 5B:
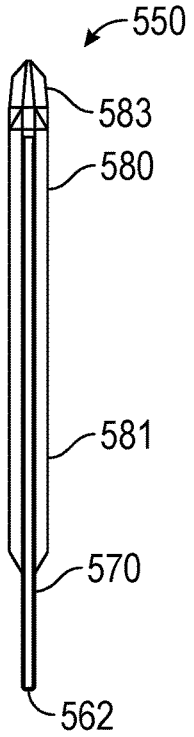

Referring now to FIGS. 4A and 4B, divider 450 is shown having an integrated tool 480 comprising a flathead screwdriver. In some embodiments, a portion of body 470 comprises a flathead screwdriver. In some embodiments, one or more edge surfaces comprises a flathead screwdriver. Flathead screwdriver 480 generally includes a handle or shaft portion 481 comprising a thickened portion of divider 450, such as a thickened portion of body 470. In some embodiments, flathead screwdriver 480 further comprises a flathead tip 483 that is connected to shaft 481 and extends outwardly from top edge 464, such that body 470 and the remaining surfaces of divider 450 do not obstruct use of tip 483. A similar divider 550 is provided having an integrated tool 580 comprising a phillips head screwdriver 580, as shown in FIGS. 5A and 5B.

Figure 5C:
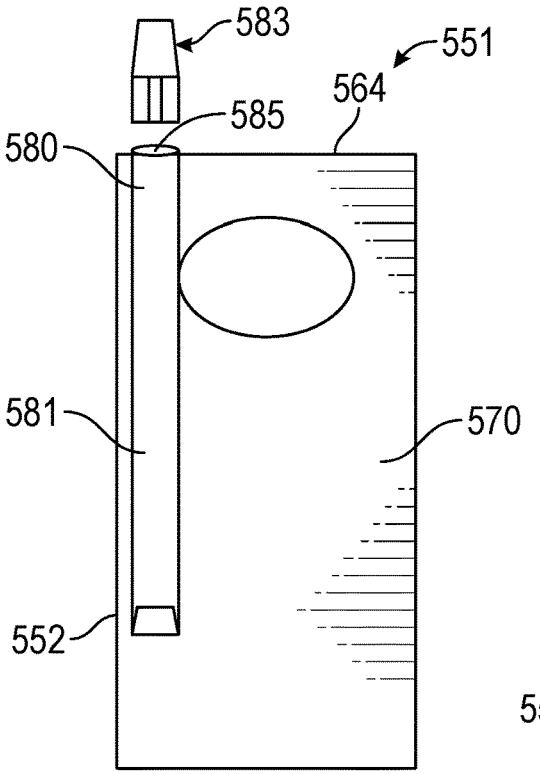
Figure 5D:
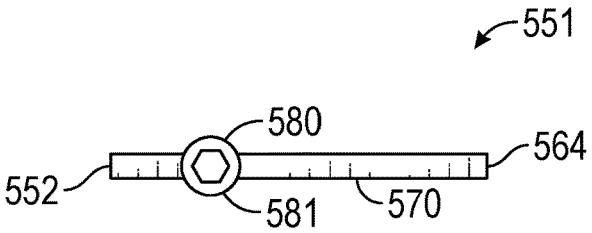
Figure 6A:
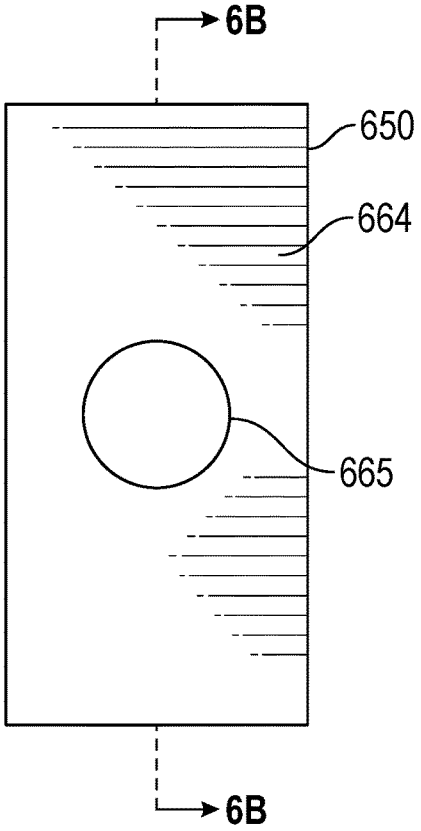
FIGS. 6A-6D provide a cross-section side view, and top, end, and bottom plan views of a divider comprising a top surface having a round opening in accordance with a representative embodiment of the present invention.
Figure 6B:
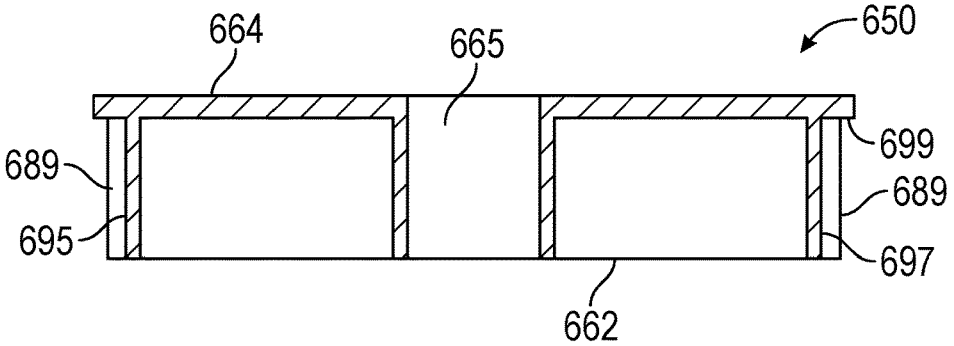
Figure 6C:
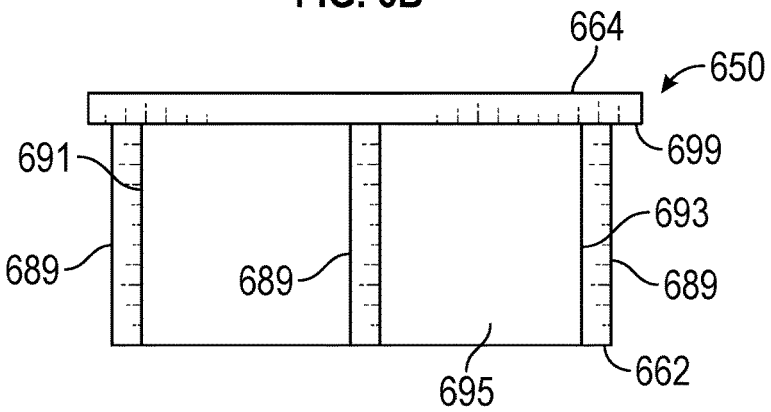
Figure 6D:
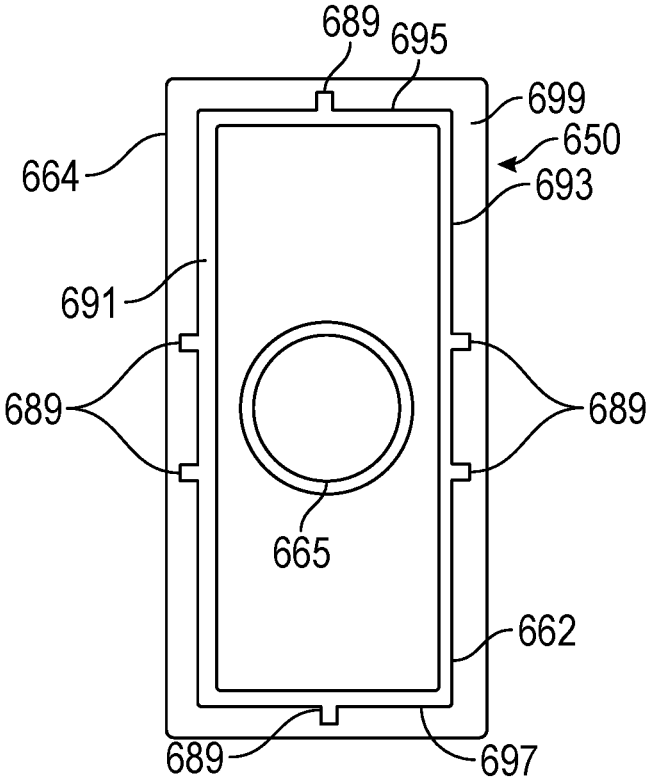
Figure 7A:
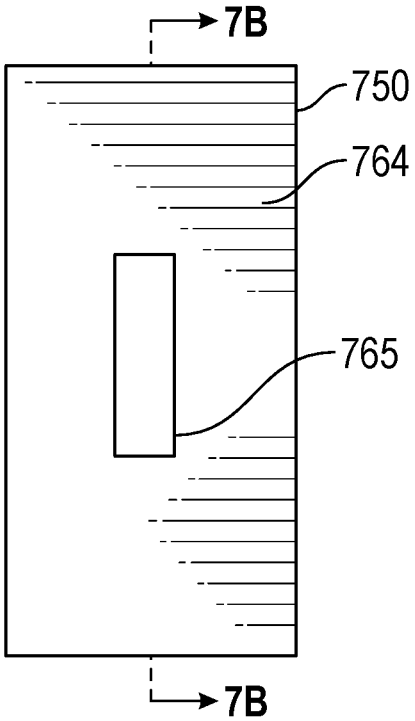
FIGS. 7A-7D provide a cross-section side view, and top, end, and bottom plan views of a divider comprising a top surface having a rectangular opening in accordance with a representative embodiment of the present invention.
Figure 7B:
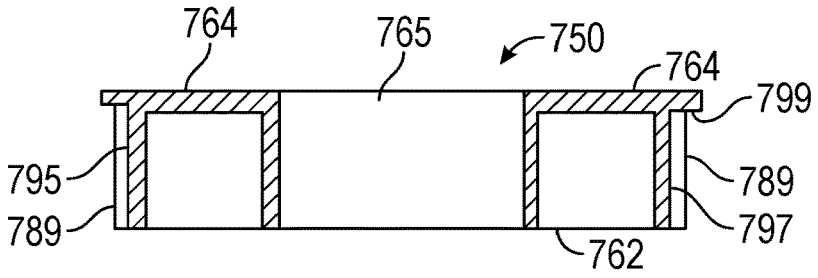
Figure 7C:
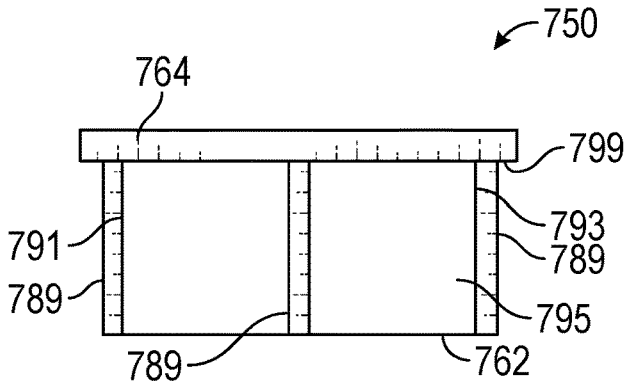
Figure 7D:
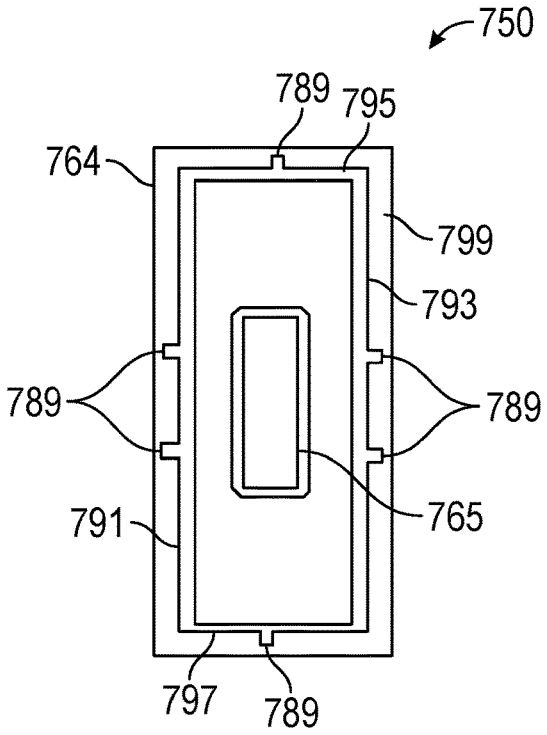

In some embodiments, a divider 551 is provided comprising an integrated handle or shaft 581 comprising a socket 585, such as a ¼-inch hex socket, as shown in FIGS. 5C and 5D. Socket 585 is configured to receive a plurality of bits 583, such as hex bits, comprising a variety of functional surfaces, such as screwdriver bits, torx bits, spanner bits, security bits, tamperproof bits, sockets, drill bits, and the like. In some embodiments, divider 551 (or another divider of the invention) is further modified to include a plurality of receptacles for storing a plurality of bits for use with socket 585. Thus, some embodiments of the present invention provide a divider having one or more features that may be used with one or more auxiliary tools.

Referring now generally to FIGS. 6A-11B, some embodiments of the present invention further comprise a divider having one or more storage compartments or surfaces configured to receive an auxiliary tool, material, part or object. With reference to FIGS. 6A-6D, a divider 650 is shown having first, second, third and fourth tool walls 691, 693, 695, 697 extending downwardly from a top surface 664. Top surface 664 further comprises an aperture or opening 665, such as a circular opening, forming a pathway through divider 650. In some embodiments, opening 665 comprises a shape, diameter, and height selected to accommodate storage of a desired auxiliary tool, such as a feather duster, a bottle brush, a handle portion of a tool, a bottle, or similarly shaped item. In some embodiments, opening 665 comprises a cylindrical shaft having top and bottom openings. In some embodiments, opening 665 comprises a cylindrical shaft having a closed or partially closed bottom surface (see, for example, FIGS. 8A, 8B, 11A and 11B). In some embodiments, opening comprises a cylindrical shaft having a tapered inner diameter.

Tool walls 691, 693, 695 and 697 further comprise one or more edges 689 configured to compatibly and selectively engage one or more receptacles 130 of a storage container. In some embodiments, edges 689 comprise a raised ridge or rail surface. In some embodiments, edges 689 comprise a channel or recessed groove or surface of one or more tool walls. In some embodiments, edges 689 comprise one or more surfaces that are keyed to selectively engage with a compatibly keyed surface or feature of a receptacle 130.

In some embodiments, divider 650 comprises a height that is less than a height of a sidewall 120 of a storage container into which divider 650 is inserted. In some instances, the lesser height of divider 650 results in the bottom-most surface of divider 650 resting directly on the inner surface of planar base 112, wherein the top surface 664 is position within interior volume 130 at a height that is lower than the upper perimeter edges of sidewalls 120 and/or rim 140. In some instances, top surface 664 overhangs at least one of tool walls 691, 693, 695, and 697 to provide a rim or lip 699. In some embodiments, top surface 664 overhangs all four tool walls to provide a lip that circumscribes the perimeter of top surface 664. In some embodiments, lip 699 is configured to contact and rest on the upper perimeter edges of sidewalls 120 and/or rim 140 when divider 650 is inserted therein, wherein the shortened height of divider 650 positions and/or suspends the bottom-most surface of divider 650 above the inner surface of planar base 112. In some instances, the suspended position of the bottom-most surface of divider 650 prevents an object stored within opening 665 from contacting the inner surface of planar base 112. In some embodiments, the shortened height of divider 650 permits two or more dividers to be stacked and occupy a same location or area within interior volume 130. In some embodiments, divider 750 comprises a square or rectangular opening, as shown in FIGS. 7A-7D, and further comprising various features and elements in common with one or more of the previously discussed dividers.

Figure 8A:
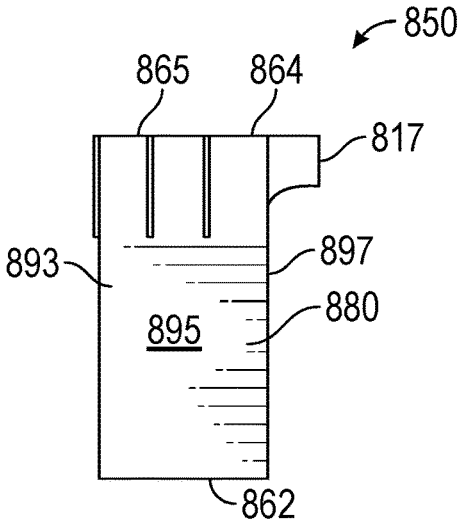
FIGS. 8A-8C provide side, front and top plan views of a divider comprising a container in accordance with a representative embodiment of the present invention.
Figure 8B:
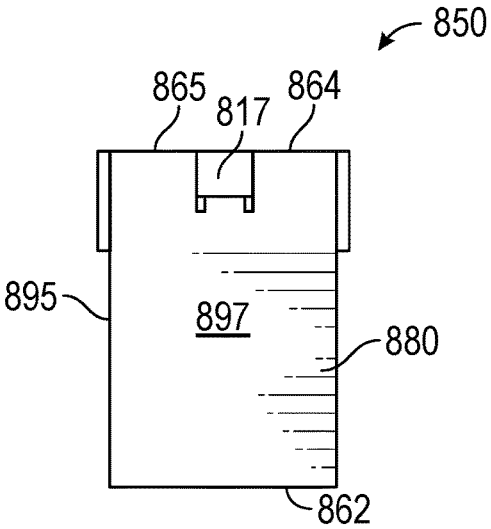
Figure 8C:
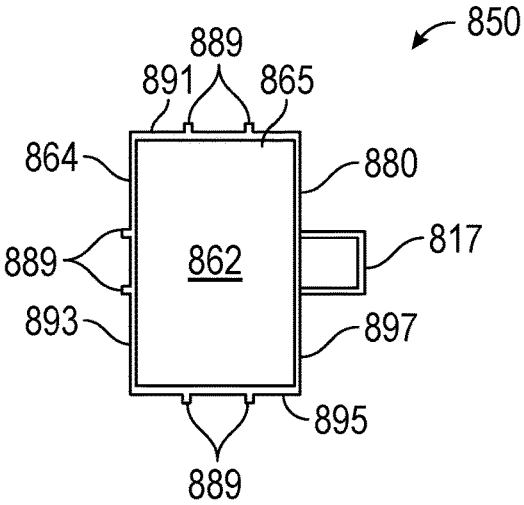

Referring now to FIGS. 8A and 8B, a divider 850 is shown having tool 880 comprising a storage compartment. In some embodiments, divider 850 comprises first, second, third, and fourth tool walls 891, 893, 895, and 897 which extend upwardly from a bottom surface 862. Divider 850 further comprises an opening 865 formed in the top surface 864 and defining a continuous perimeter of the tool walls, wherein divider 850 comprises a cup or similar type of container. In some embodiments, divider 850 further comprises a handle 817 coupled to an outer surface of a tool wall, for example fourth tool wall 897. In some instances, handle 817 is positioned near top surface 864 to provide easy user access when divider 850 is inserted within storage container 110. In some embodiments, divider 850 is configured to store a liquid, such as a cleaning solution or a rinsing solution. In some embodiments, opening 865 comprises a diameter sufficient to accommodate insertion of a user's hand. In some embodiments, opening 865 comprises a diameter sufficient to accommodate insertion of a mop head. In some embodiments, divider 850 further comprises a bucket handle coupled to two oppositely positioned tool walls, such as first and third tool walls 891 and 895.

Divider 850 further comprises a plurality of edges 889 configured to compatibly and selectively engage one or more receptacles 130 of storage container 110. In some embodiments, an outer surface of first, second, and third tool walls 891, 893, and 895 comprise edges 889 having a spacing configured to align with and compatibly engage respective receptacles 130 provided on the inner surfaces of sidewalls 120. In some embodiments, edges 889 are positioned near top surface 864 and extend along only a portion of the tool walls.

Figure 9:
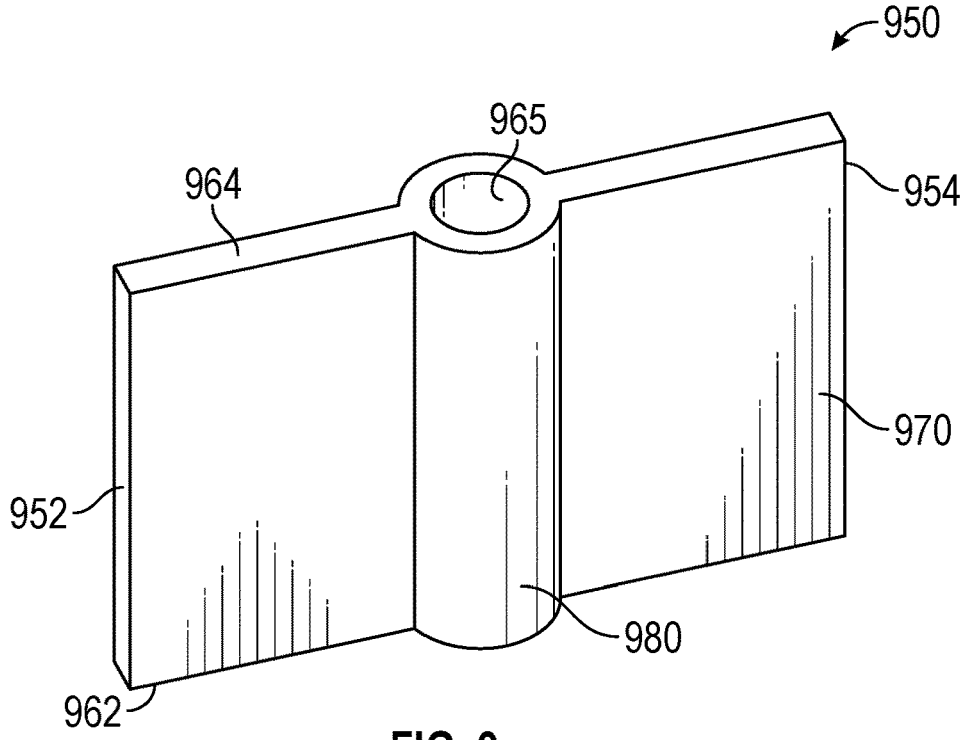
FIG. 9 provides a perspective top and front view of a divider comprising a single compartment in accordance with a representative embodiment of the present invention.
Figure 10:
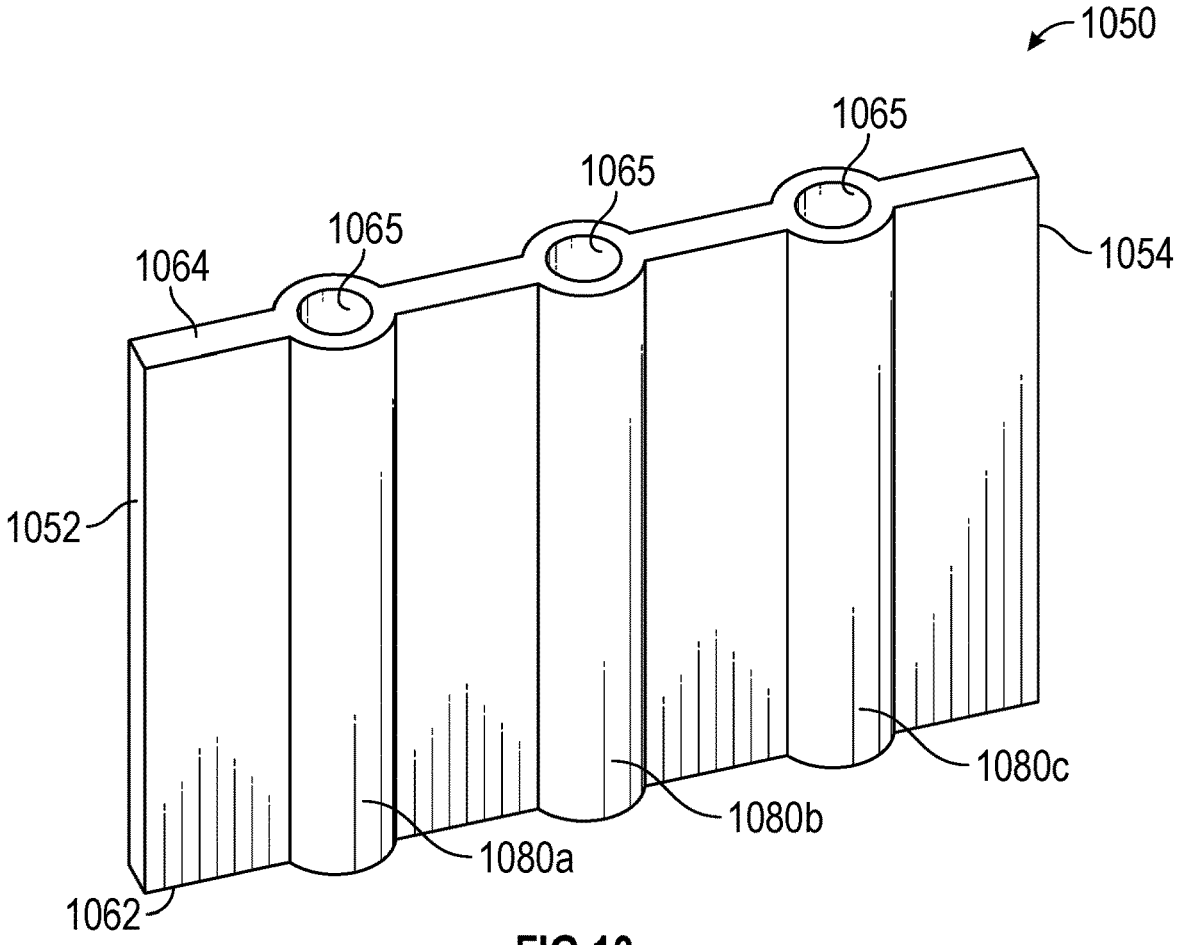
FIG. 10 provides a perspective top and front view of a divider comprising a plurality of compartments in accordance with a representative embodiment of the present invention.

Referring now to FIG. 9, a divider 950 is shown having a tool 980 comprising a storage compartment. Divider 950 comprises a first edge 952, a second edge 954, a bottom edge 962 and a top edge 964, wherein first, second, bottom, and top edges define a body portion 970 that is generally planar. Body portion 970 further comprises tool 980. In some embodiments, tool 980 comprises a hollow, cylindrical column having an upper opening 965. In some embodiments, tool 980 further comprises a solid or closed bottom end opposite upper opening 965. In some embodiments, tool 980 further comprises a lower opening opposite upper opening 965, such that tool 980 forms a vertical pathway through body 970. Tool 980 may comprise any diameter in accordance with the teaching of the present invention. Tool 980 may further comprise any geometric shape in accordance with the present invention. In some embodiments, a divider 1050 is provided comprising a plurality of tools 1080*a*, 1080*b*, and 1080*c*, each tool comprising a storage compartment, as shown in FIG. 10. In some embodiments, tools 980, 1080*a*, 1080*b*, and 1080*c* are configured to store a shaft structure of an object, such as a pencil, a pen, a handle, a screwdriver, a ruler, a scalpel or knife, a wrench handle, scissors, paint brush, cleaning brush, toothbrush, and the like. In some embodiments, divider 950 or 1050 further comprises additional storage compartments coupled to or extending outwardly from tools 980, 1080*a*, 1080*b* and/or 1080*c*, such that the additional storage compartments extend in a perpendicular orientation to body 970 and/or 1070.

Figure 11A:
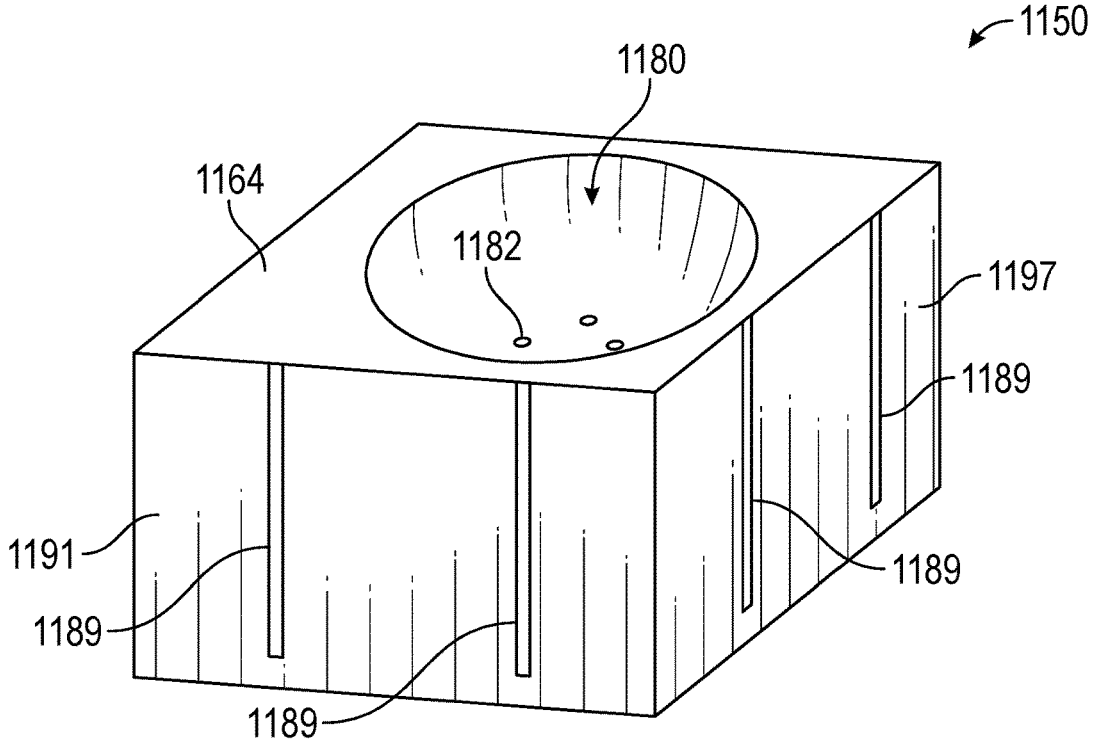
FIGS. 11A and 11B provide perspective and cross-section views of a divider comprising a top surface having a hemispherical concave compartment in accordance with a representative embodiment of the present invention.
Figure 11B:
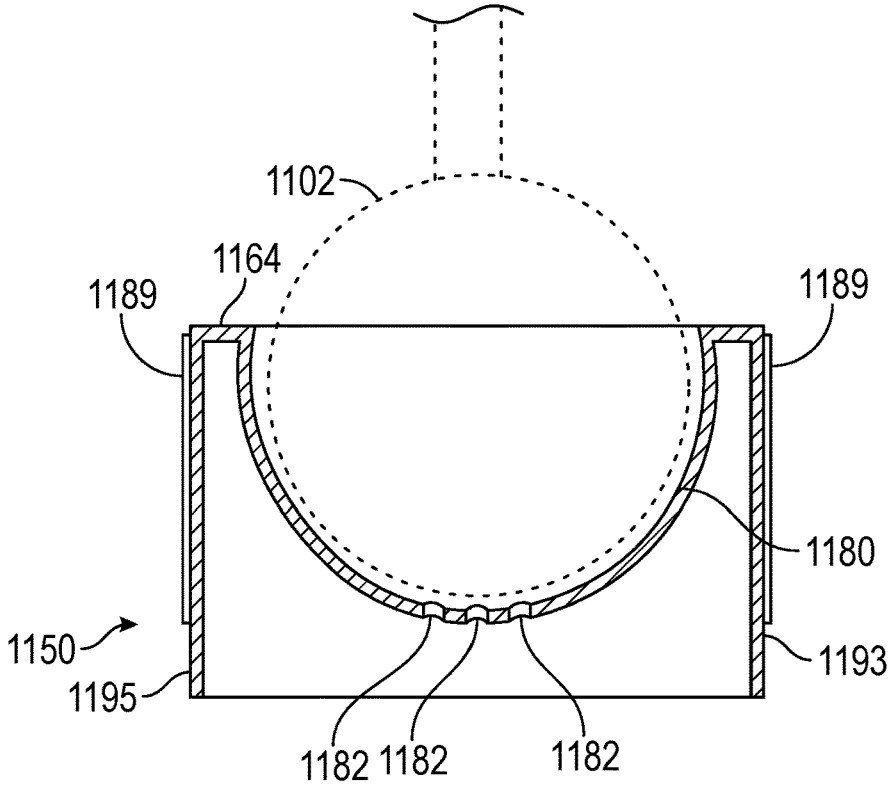

Referring now to FIGS. 11A and 11B, divider 1150 is shown having a tool 1180 comprising a storage compartment formed in a top surface 1164 and having a geometric shape configured to receive and store an auxiliary tool, material, part or object 1102. Divider 1150 comprises first, second, third, and fourth tool walls 1191, 1193, 1195 and 1197 extending downwardly from top surface 1164. An outer surface of one or more of the tool walls further comprises one or more edges 1189 configured to compatibly and selectively engage one or more receptacles 130, in accordance with previous embodiments. Top surface 1164 further comprises an opening 1165 providing access to an interior volume of tool 1180. Opening 1165 may comprise any shape, diameter, or other geometries as may be desired and in accordance with the teachings of the present invention. In some embodiments, opening 1165 comprises a circle. In some embodiments, the storage compartment of tool 1180 comprises a hemispherical concave recess configured to compatibly receive and store an object 1102 having a spherical or hemispherical shape, such as a toilet brush, a ball, a bowl, a cup, or similarly shaped object. In some embodiments, the concave recessed surface of tool 1180 provides a bowl or dish surface in which may be stored a plurality of small parts or objects. In some embodiments, a bottom-most portion of the concave recessed surface may comprise one or more drainage holes 1182 configured to prevent a liquid from gathering within tool 1180. In some embodiments, the dimensions of tool 1180 are selected to provide an interference or friction fit between the recessed concave surface an object 1102 stored therein.

Figure 12A:
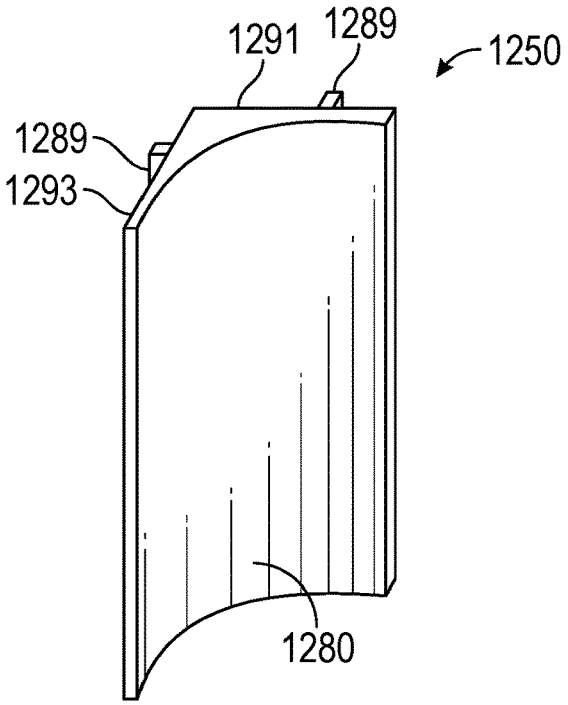
FIGS. 12A and 12B provide perspective and top plan views of a divider having tool walls for engaging receptacles of the storage container, and further comprising a tool or body surface comprising a concave geometry or shape in accordance with a representative embodiment of the present invention.
Figure 12B:
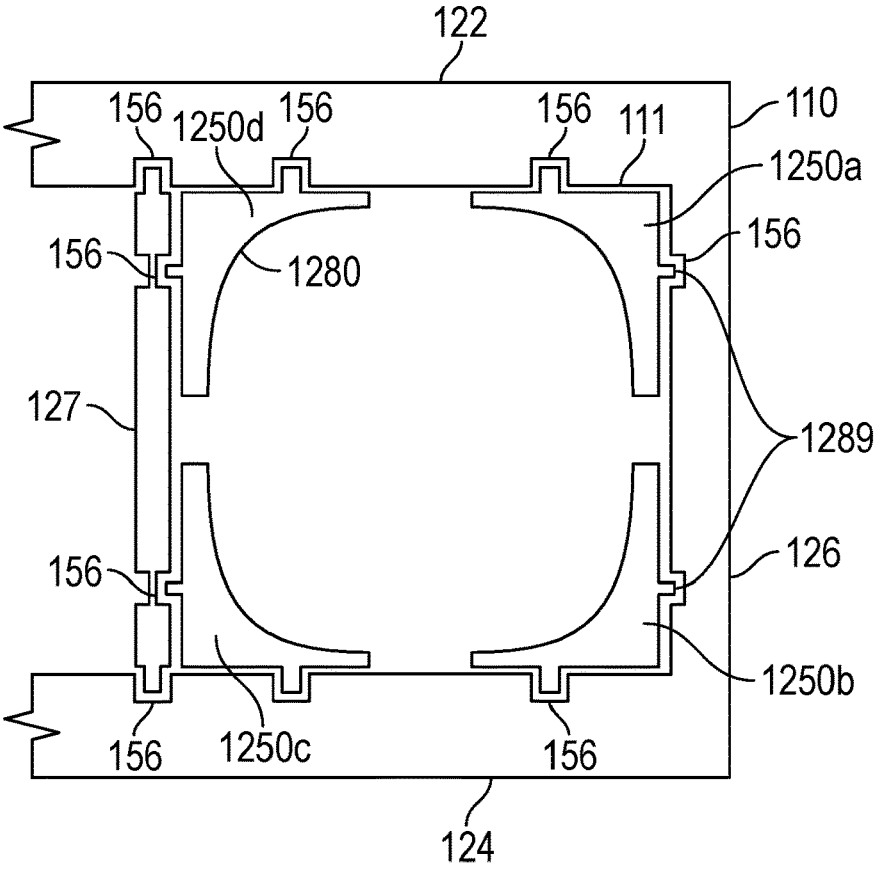

Referring now to FIGS. 12A and 12B, a divider 1250 is shown comprising a first tool wall 1291 positioned at 90 degrees from a second tool wall 1293, wherein first and second tool walls further comprise one or more edges 1289 configured to compatibly engage one or more receptacles 156 of storage container 110. Divider 1250 further comprises a tool 1280 comprising a geometric shape or surface, such as a concave surface, a convex surface, a chamfered surface, a tapered surface, a keyed surface, a textured surface, a gripping surface, and the like.

When selectively engaged with and inserted within storage container 110, the tool or tool surface 1280 of divider 1250 modifies an existing geometric shape or structure of storage container 110. For example, a squared corner 111 of storage container 110 comprises a right angle or square configuration where sidewalls 122 and 126 meet. When divider 1250*a* is inserted into storage container 110, corner 111 is modified by tool 1280 to be a concave radius. The further addition of dividers 1250*b*, 1250*c*, and 1250*d* modify the square corners of the square sub-compartment (defined by sidewalls 122, 124, 126, and divider 127) are rounded to provide a round sub-compartment. In some embodiments, dividers 1250*a*, 1250*b*, 1250*c*, and 1250*d* include a tool comprising a flat surface at approximately 45 degrees to first and second tool walls 1291 and 1293, wherein when the dividers are inserted into a square sub-compartment of storage container 110, the square sub-compartment is modified to provide an octagonal sub-compartment.

Figure 13A:
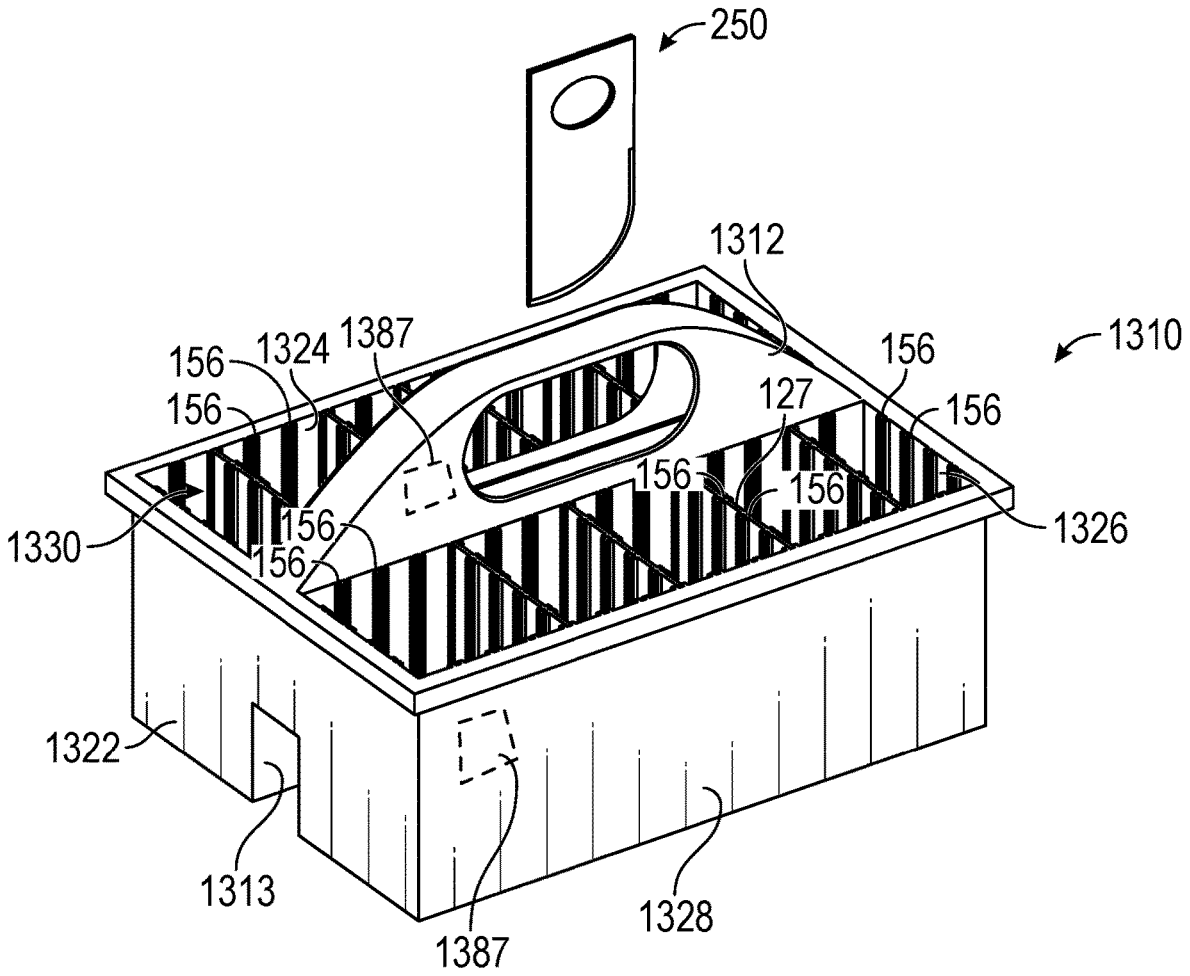
FIG. 13A provides an exploded perspective top and front view of a divider and a storage container having a plurality of sub-compartments in accordance with a representative embodiment of the present invention.
Figure 13B:
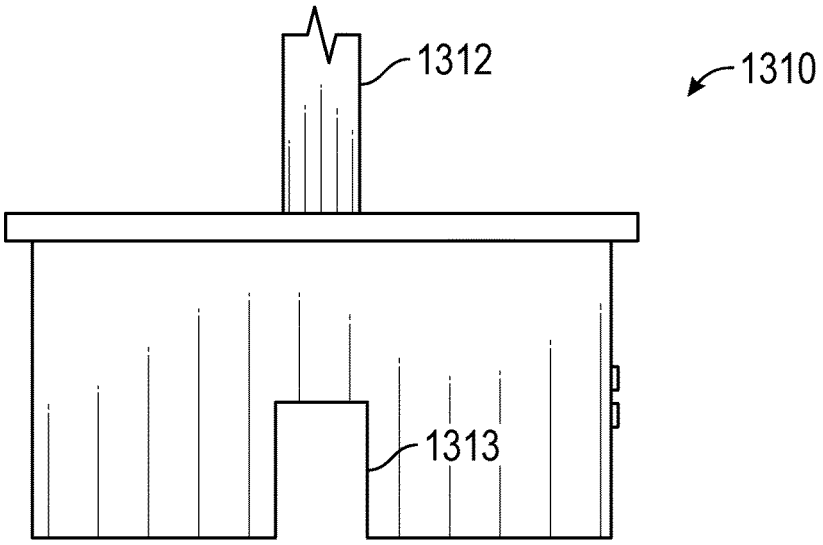
FIGS. 13B and 13C provide side and top plan views of the storage container of FIG. 13A.
Figure 13C:
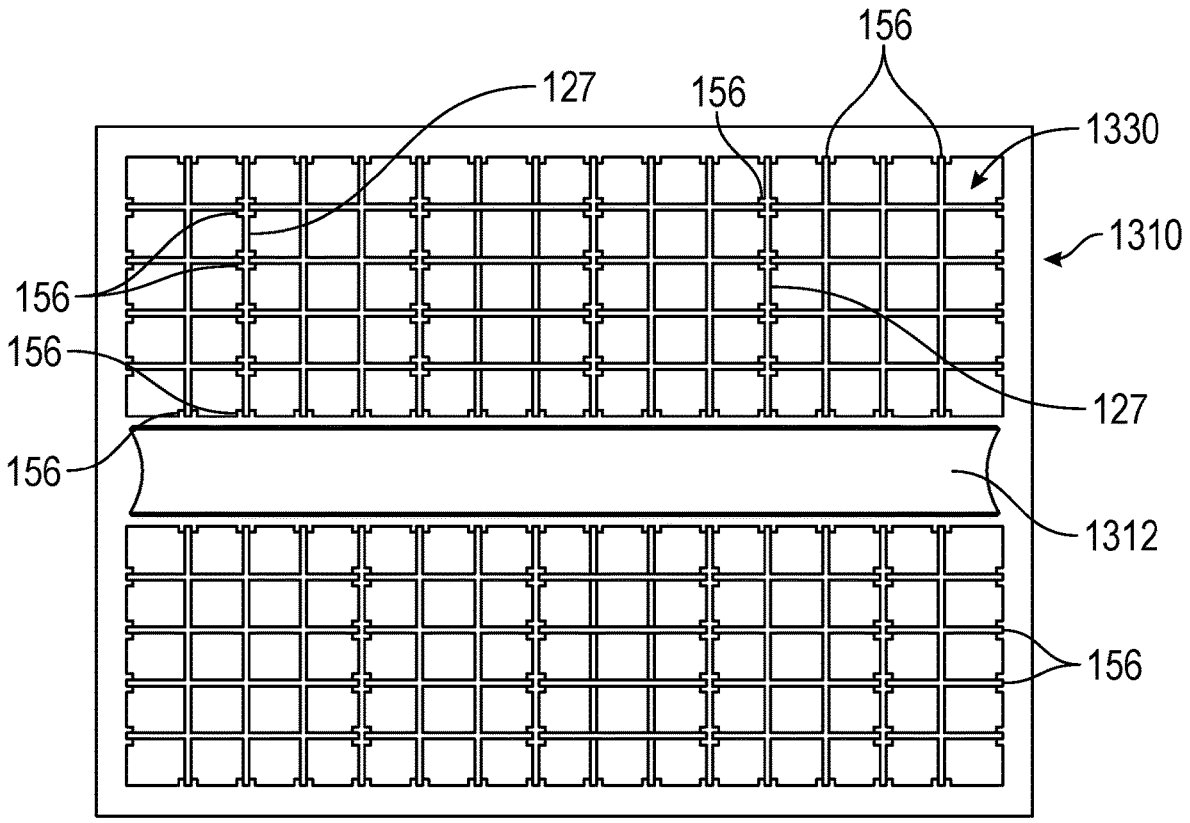

Referring now to FIGS. 13A-13C, a storage container 1310 of the present invention comprises a plurality of receptacles 156 having a desired spacing and placement for accommodating a variety of dividers 250. Receptacles 156 may further accommodate one or more standard partitions 127, which only provide a single function of dividing the interior volume 1330 into two or more sub-compartments. In some embodiments, partitions 127 further include one or more receptacles 156. In some embodiments, partitions 127 comprise receptacles 156 on both front and back surfaces of partition 127.

In some embodiments, storage container 1310 comprises a handle 1312. Handle 1312 may comprise any structure, shape, size, dimensions and other features compatible with the teachings of the present invention. In some embodiments, handle 1312 comprises a lower portion coupled to the inner sidewall and planar base surfaces and extending upwardly therefrom to provide an interior wall surface that divides the interior volume 1330 into two or more sub-compartments. In some embodiments, the lower portion of handle 1312 further comprises a plurality of receptacles 156. In some embodiments, handle 1312 is selectively coupled to storage container 1310.

In some embodiments, storage container 1310 further comprise a tool 1387 that is embedded within, or applied to, one or more surfaces of storage container 1310. For example, in some embodiments tool 1387 is integrated into or associated with handle 1312. In some embodiments, tool 1387 is integrated into or applied onto an interior or exterior sidewall, such as sidewall 1328. In some embodiments, tool 1387 comprises a magnet. In some embodiments, tool 1387 comprises an RFID chip, such as part of a security access card or identification badge. In some embodiments, tool 1387 comprises a mirror. In some embodiments, tool 1387 comprises an adhesive memo pad. In some embodiments, tool 1387 comprises a power source, such as a portable charger. In some embodiments, tool 1387 comprises a thumb drive. In some embodiments, tool 1387 comprises a hook and/or loop fastener material. In some embodiments, tool 1387 comprises one or more tools disclosed herein.

In some embodiments, storage container 1310 further comprises a recess or channel 1313 formed in the bottom surface and corresponding to a position of handle 1312. In some embodiments, channel 1313 is a hollow interior of handle 1312. In some embodiments, channel 1313 is configured to compatibly receive a handle of a second storage container when stacked atop storage container 1310, wherein the bottom surface of storage container 1310 rests on a rim of the second storage container. In some embodiments, handle 1312 is tapered to permit insertion within a channel 1313 of a storage container stacked on top of storage container 1310.

Figure 14:
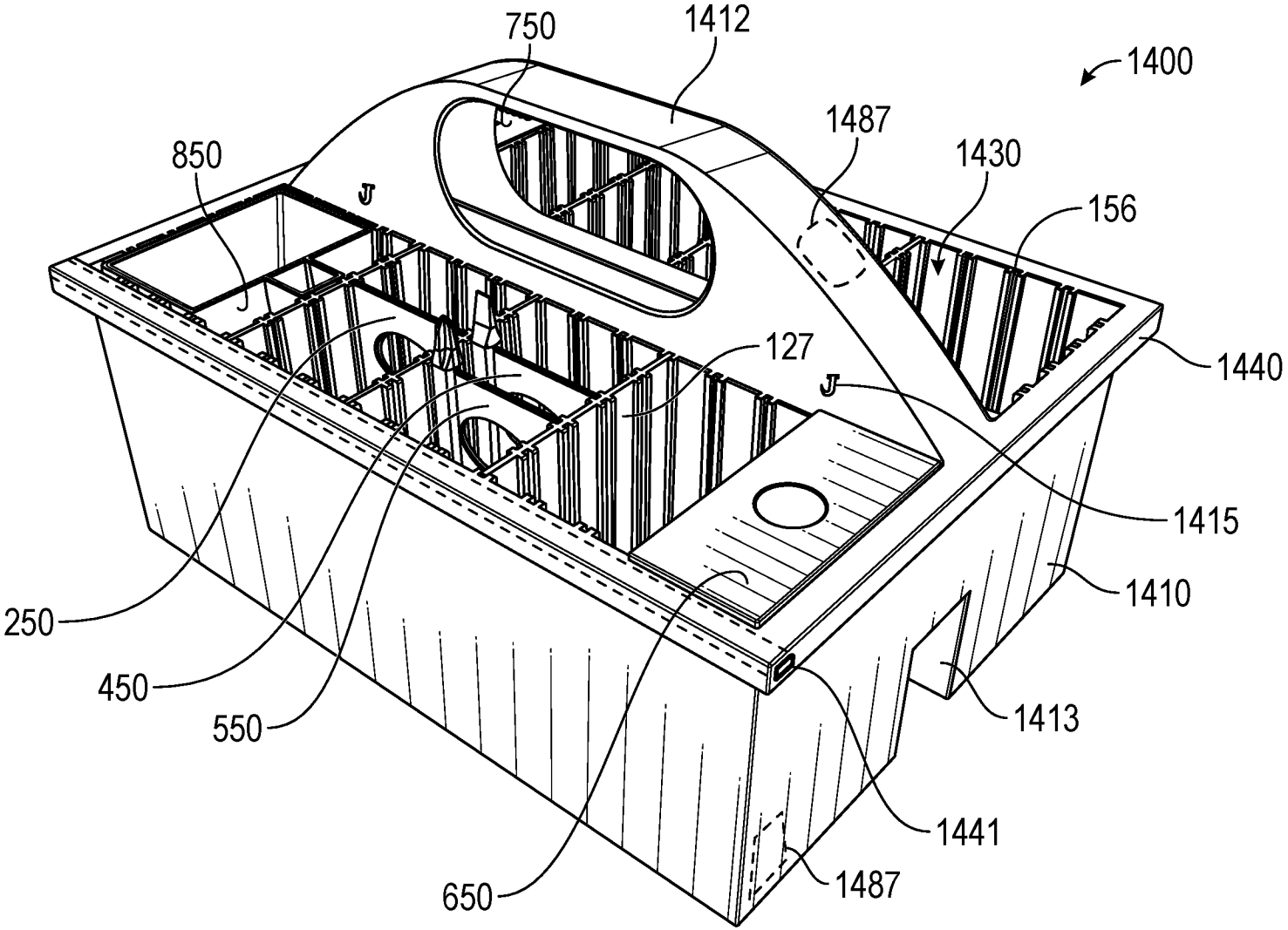
FIG. 14 provides a perspective top and front view of an assembled storage container system having a plurality of dividers comprising a variety of tools in accordance with a representative embodiment of the present invention.

Referring now to FIG. 14, a representative embodiment of an assembled storage system 1400 is shown. In some embodiments, a variety of sub-compartments is provided via a combined use of standard partitions 127 and one or more dividers having a first function for dividing a compartment into two or more sub-compartments, and having a second function unrelated to the first function (250, 450, 550, 650, 750 and 850). In some embodiments, a divider of the present invention further comprises one or more receptacles 156 by which a partition 127 or an additional divider may be inserted and retained within interior volume 1430.

In some embodiments, storage container 1410 further comprises a storage compartment 1441 located within a portion of rim 1440. In some embodiments, storage compartment 1441 comprises an elongated opening forming a pathway through a length or a portion of a length of rim 1440. Accordingly, in some embodiments storage compartment 1441 comprises a single opening and a closed end opposite the single opening. In some embodiments, storage compartment 1441 comprises first and second openings positioned on opposite ends or sides of storage container 1410. In some embodiments, storage compartment 1441 is configured to store an elongated item or object, such as a drain cleaning tool, welding rods, knitting needles, a writing utensil, a knife, or a similarly shaped object.

In some embodiments, a surface of storage container 1410 comprises one or more hooks 1415 or similarly shaped or functional elements to facilitate storage of a desired item. For example, in some embodiments handle 1412 comprises hooks 1415 that may be used individually or in concert to store an elongated item or object.

In some embodiments, a surface of storage container 1410 further comprises or more tools 1487 embedded therein or applied thereon. For example, in some embodiments storage container 1410 comprises a tool 1487 embedded within or applied onto a sidewall, a rim, or a handle 1412 portion of the container. In some embodiments, tool 1487 comprises one or more tools disclosed herein.

Figure 15:
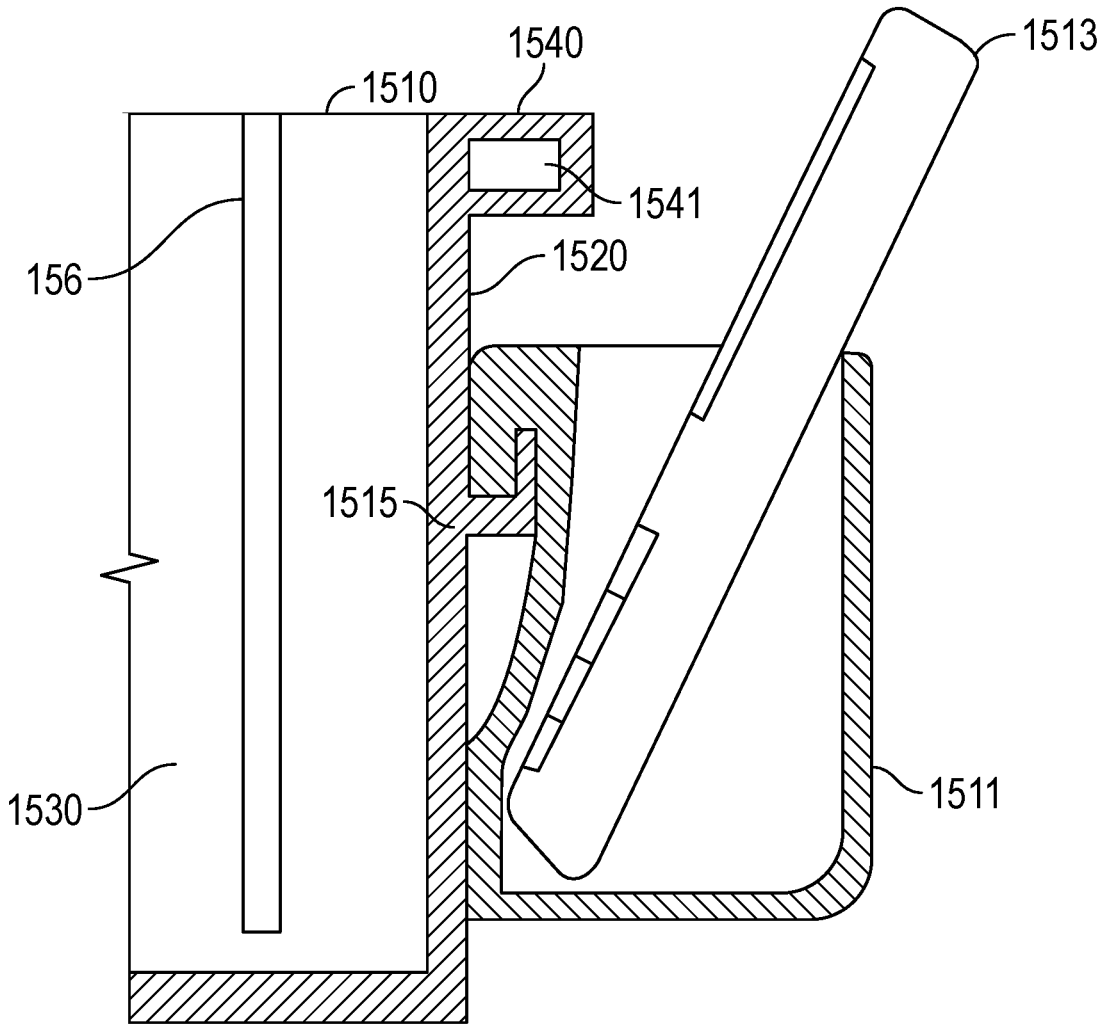
FIG. 15 provides a detailed cross-section side view of a storage container and external storage container in accordance with a representative embodiment of the present invention.

In some embodiments, an exterior or outer surface of a sidewall 1520 comprises an adapter 1515 configured to selectively receive a storage container 1511, as shown in FIG. 15. Adapter 1515 may comprise any surface, structure, configuration, size, shape or other feature as may be desired to selectively receive storage container 1511. Storage container 1511 further comprises a surface, structure, or other feature that is compatible for securement to adapter 1515.

In some embodiments, storage container 1511 comprises one or more compartments for storing an object outside of interior volume 1530. In some embodiments, storage container 1511 comprises a compartment for storing a cellular phone 1513. In some embodiments, storage container 1511 comprises an identification or badge holder. In some embodiments, storage container 1511 comprises a beverage holder. In some embodiments, storage container 1511 comprises a pouch, a hook or other structure for holding keys.

In some embodiments, adapter 1515 is suited for selectively receiving a variety of additional components or tools. For example, in some embodiments adapter 1515 is configured to compatibly receive a portable speaker. In some embodiments, adapter 1515 is configured to compatible receive a second storage container of the present invention. In some embodiments, adapter 1515 is configured to compatibly receive a handle. In some embodiments, adapter 1515 is configured to compatibly receive a cover for storage container 1510. In some embodiments, adapter 1515 is configured to compatibly receive a tool selected from the group consisting of a magnet, an RFID chip, an access or identification card, a mirror, an adhesive memo pad, a power source, such as a battery and/or a portable charger, a thumb drive, and a hook and/or loop fastener material.

The present invention further comprises one or more methods of manufacturing a storage system and/or the various components of a storage system disclosed herein, including one or more dividers and tools of the present invention. In some embodiments, a method for manufacturing a storage system includes steps for providing a storage container having a plurality of receptacles; and providing a divider having a first edge configured to selectively engage a first receptacle of the storage container, a second edge configured to selectively engage a second receptacle of the storage container, a bottom edge, a top edge positioned opposite the bottom edge, a body defining a surface between the first, second, bottom and top edges, and a tool comprising at least one of the top edge, the bottom edge, the first edge, the second edge, and the body, wherein the divider comprises a first function of dividing a compartment of the storage container into two or more sub-compartments, and further comprises a second function that is unrelated to the first function.

Some embodiments of the present invention further include a storage system comprising a kit, wherein the kit includes a storage container, and one or more dividers having a tool disclosed herein.

Referring now to FIGS. 16A-16I, a storage container 1600 is shown. Storage container 1600 comprises a base 1610 and, in some embodiments, a lid 1690 selectively coupled to an opening of the base defined by a raised perimeter edge 1618 of base 1610. In some embodiments, lid 1690 comprises an opening 1692 through which a handle 1620 may extend when lid 1690 is secured to base 1610. In some embodiments, storage container 1600 further comprises a water- and/or air-tight seal between base 1610 and lid 1690. In some embodiments, container 1600 further comprises a perimeter stop 1682 for engaging lid 1690 and/or one or more elements of the present invention. In some embodiments, perimeter stop 1682 further provides an edge whereby a user may grasp and lift container 1600 by the outer surfaces of the side walls.

In some embodiments, base 1610 further comprises a channel 1612 which divides base 1610 into left and right halves 1614 and 1616, wherein channel 1612 provides a space for receiving a handle of a second storage container when storage container 1600 is stacked on top of a lid of a second storage container. In some embodiments, a base portion of handle 1620 comprises an opening 1622 to accommodate insertion or passage of a handle of second storage container when the bases of two or more storage containers are stacked together without anything being stored inside of the storage containers, such as during initial shipment of the product, during display of the product on a store shelf, or while being stored away by a user prior to or following use of the container for storage. The sidewalls of base 1610 are further angled or tapered outwardly from the bottom 1624 to the base of the raised perimeter edge 1618 such that the overall length of width of the base 1610 at the bottom 1624 is less than the overall length and width of the opening of the base (as defined by the raised perimeter edge 1618). The angled configuration of the sidewalls further permits efficient stacking of multiple bases 1610 within one another.

Figure 16A:
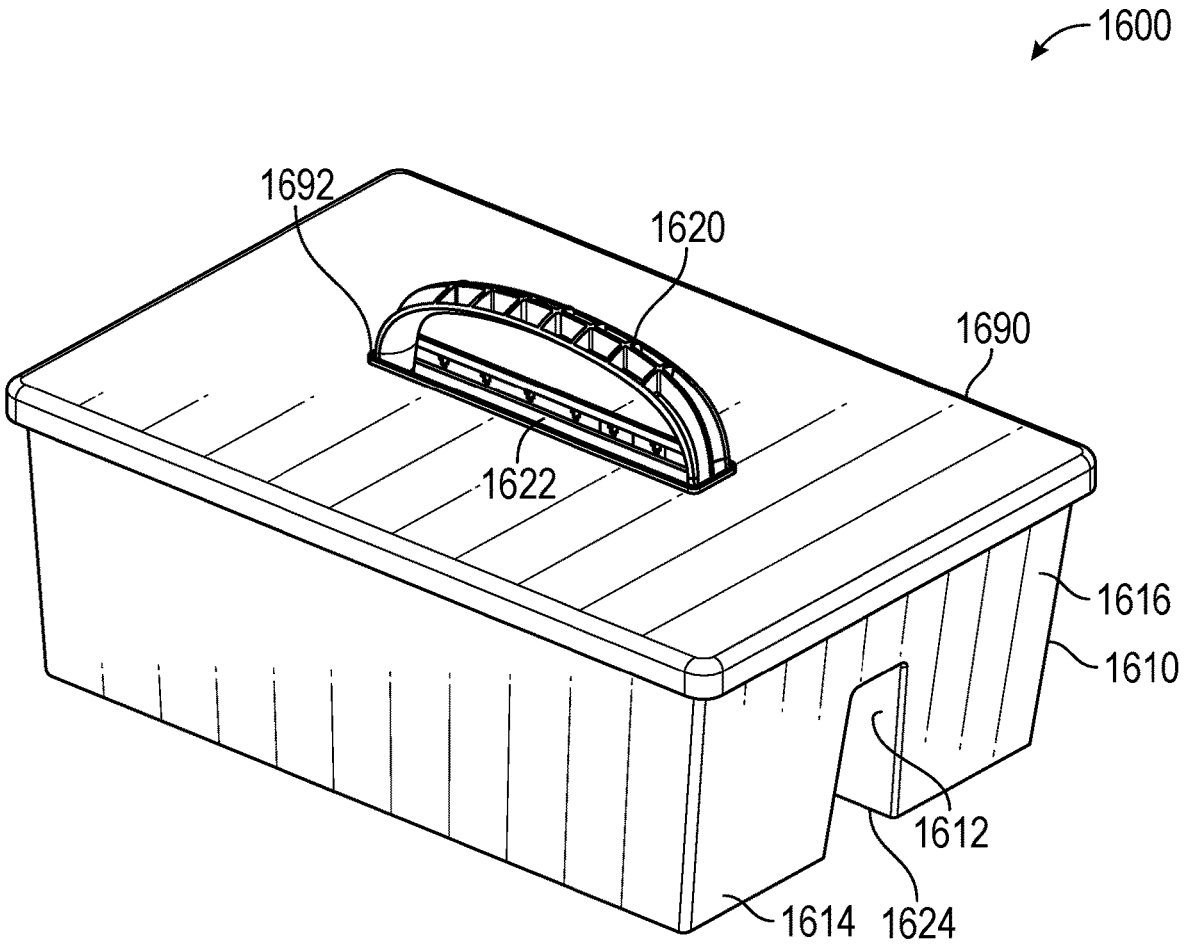
FIG. 16A provides a perspective view of an assembled storage container and lid in accordance with a representative embodiment of the present invention.
Figure 16B:
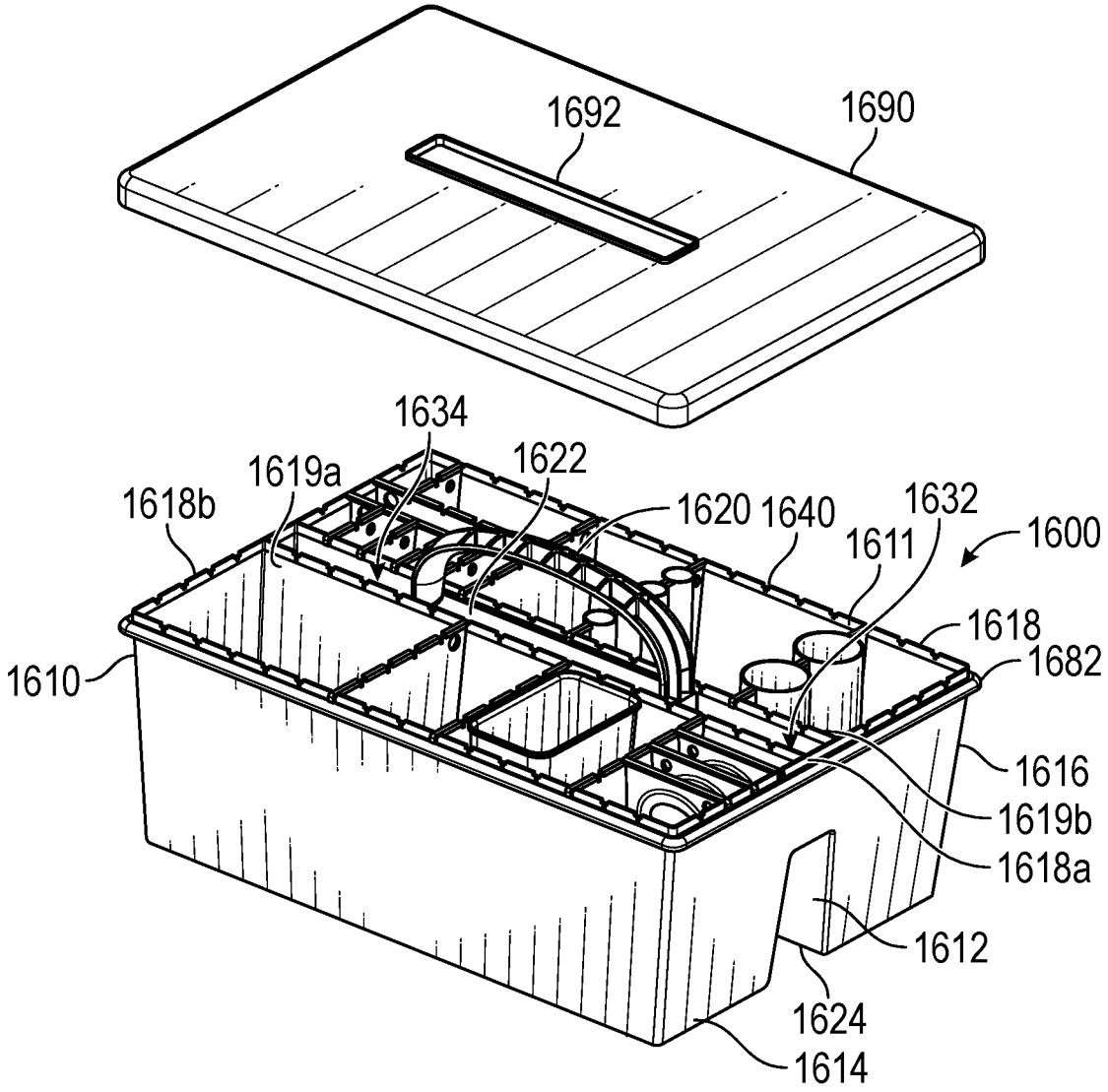
FIG. 16B provides an exploded view of the assembled storage container of FIG. 16A.
Figure 16C:
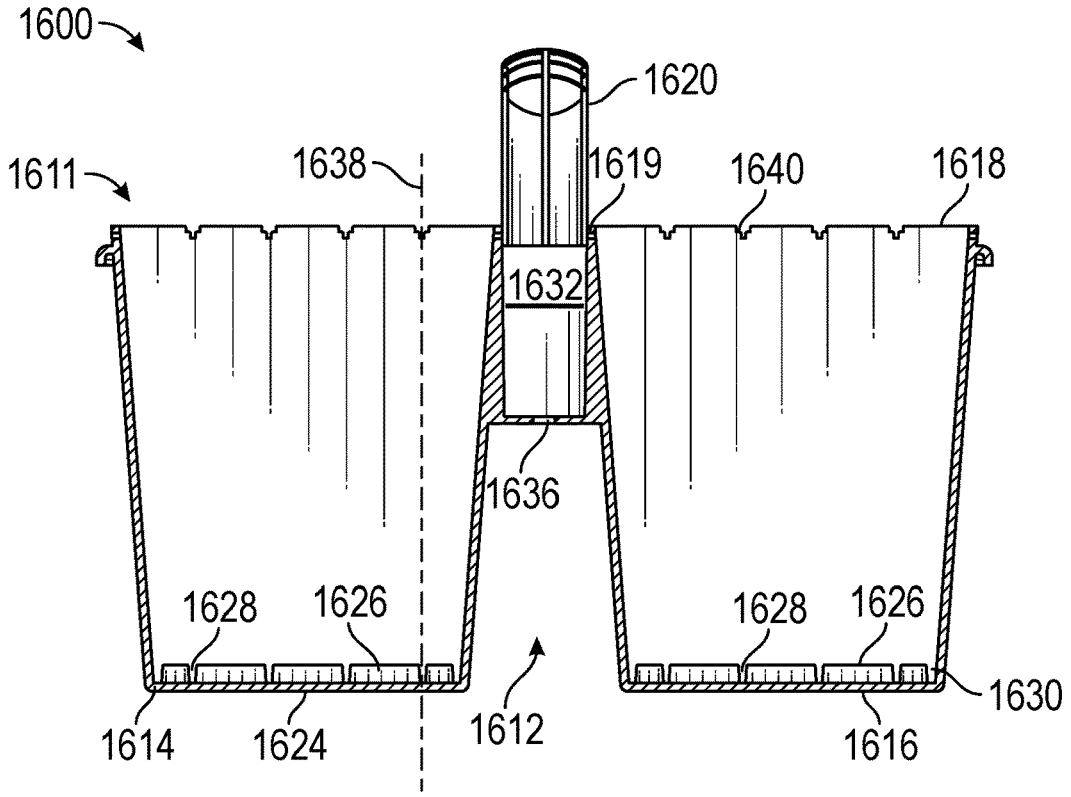
FIG. 16C provides a cross-section end view of the storage container of FIG. 16A.
Figure 16D:
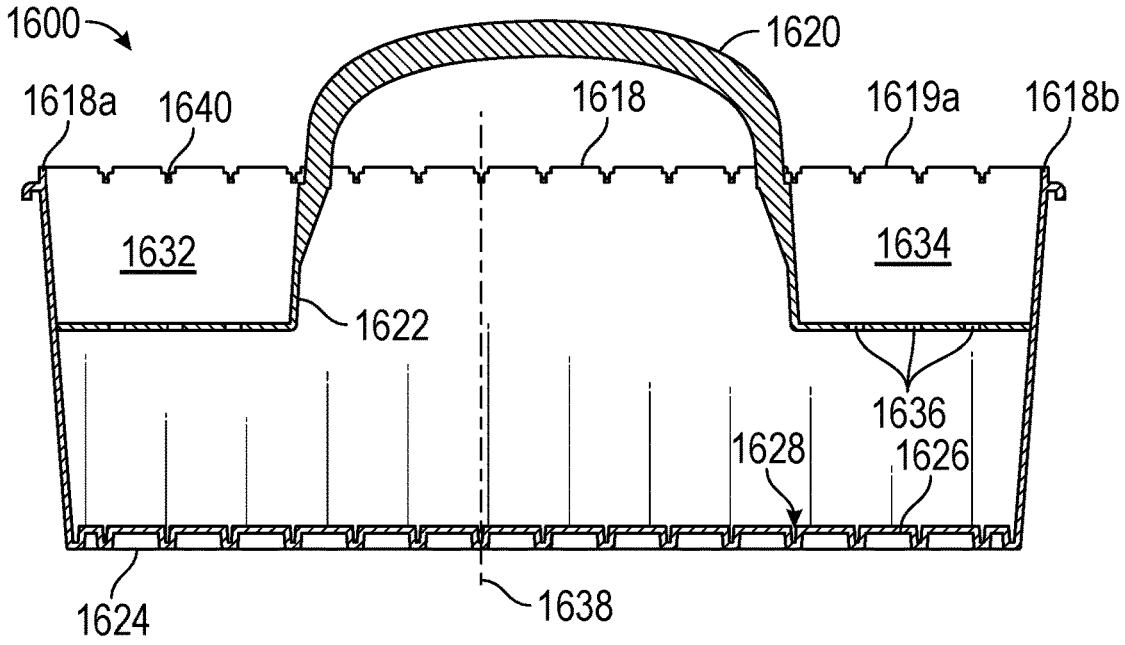
FIG. 16D provides a modified cross-section side view of the storage container of FIG. 16A, wherein the sidewall of the container is removed, and the handle and center cups are cross-sectioned.
Figure 16E:
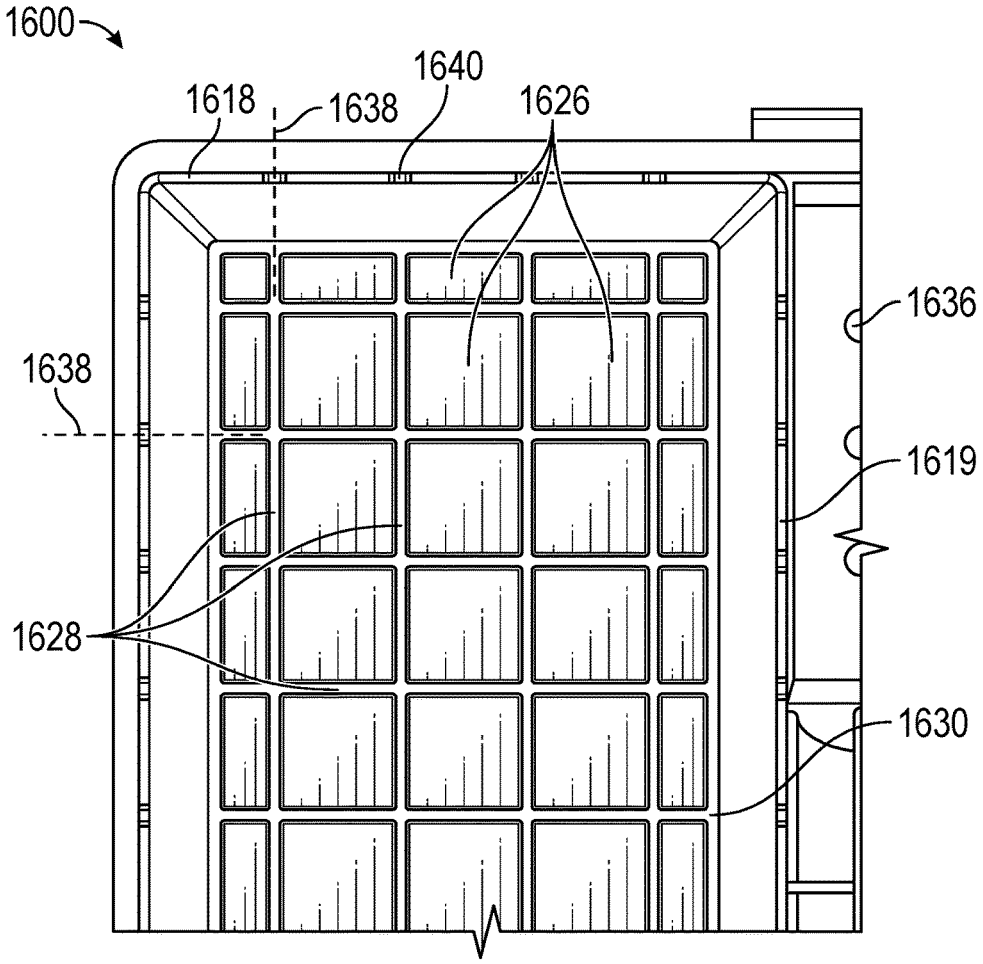
FIG. 16E is a detailed top view of the interior floor surface of the storage container of FIG. 16.
Figure 16F:
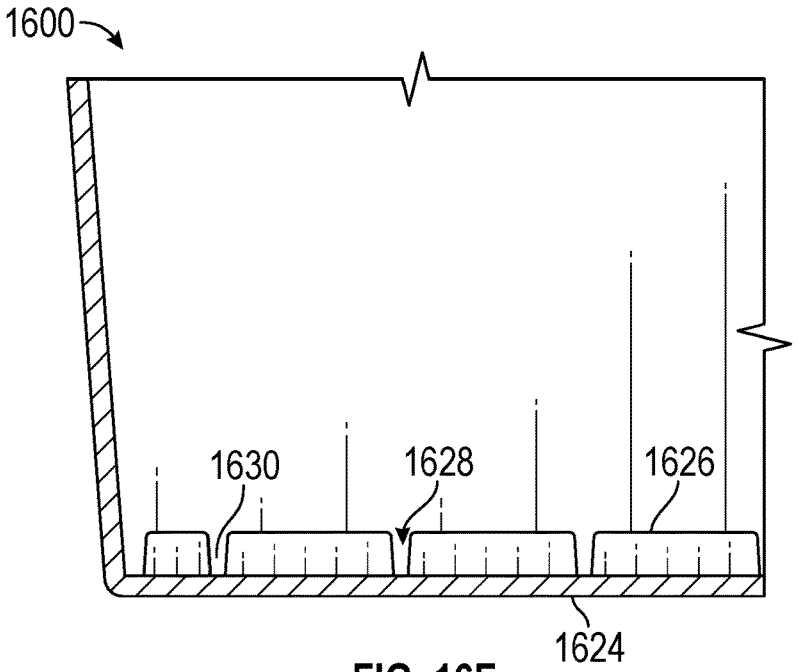
FIG. 16F is a detailed cross-section end view of the interior floor surface of the storage container of FIG. 16A.
Figure 16G:
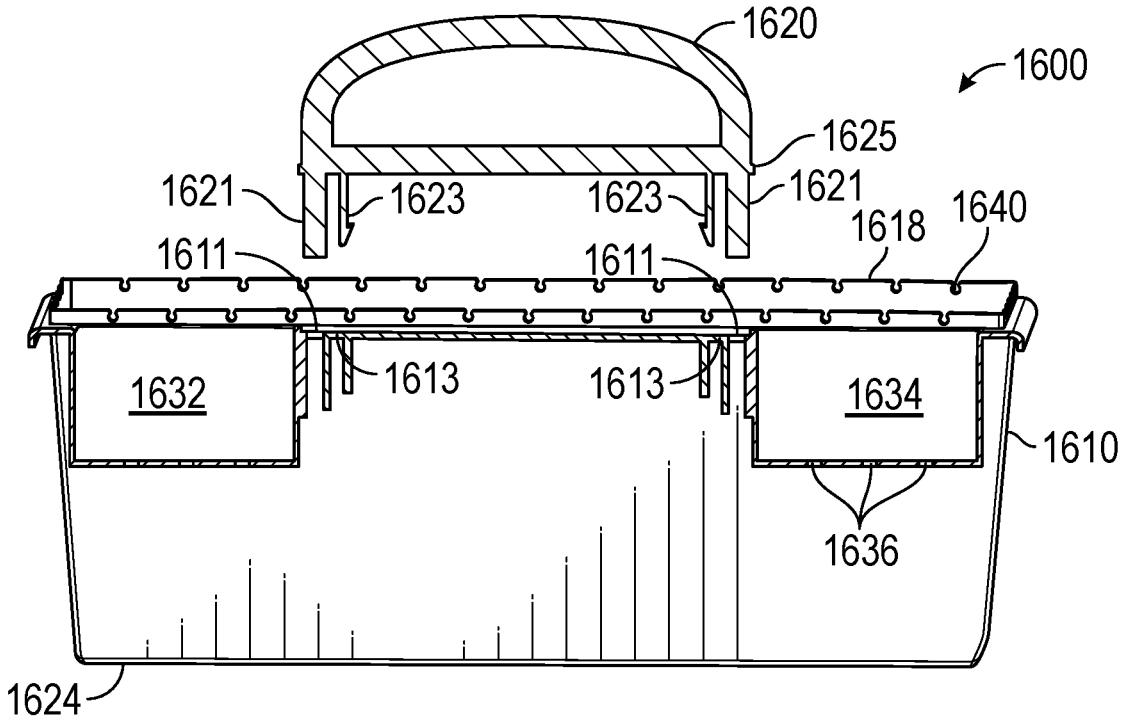
FIG. 16G is an exploded cross-section side view of a storage container having a removable handle in accordance with a representative embodiment of the present invention.
Figure 16H:
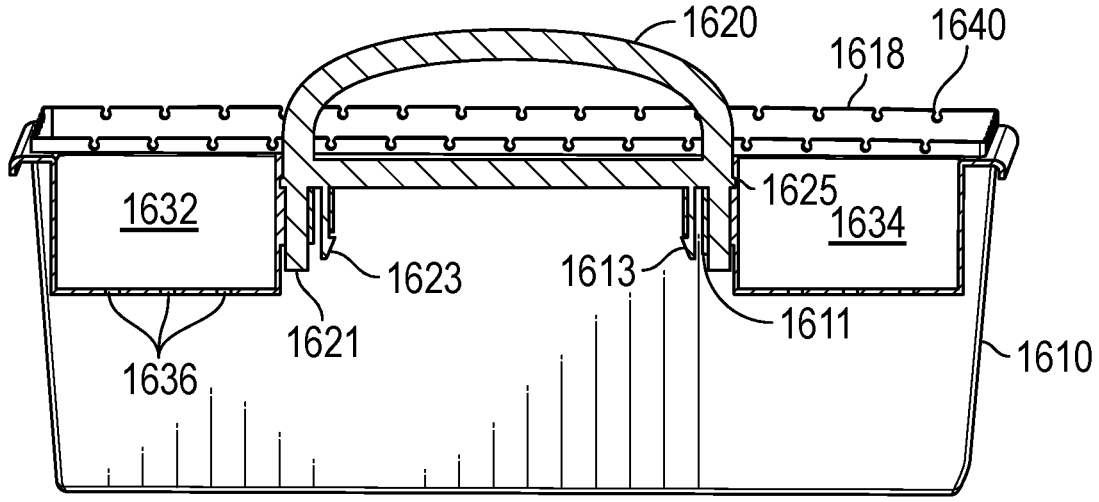
FIG. 16H is a cross-section side view of the storage container of FIG. 16G with the removable handle installed therein in accordance with a representative embodiment of the present invention.
Figure 16I:
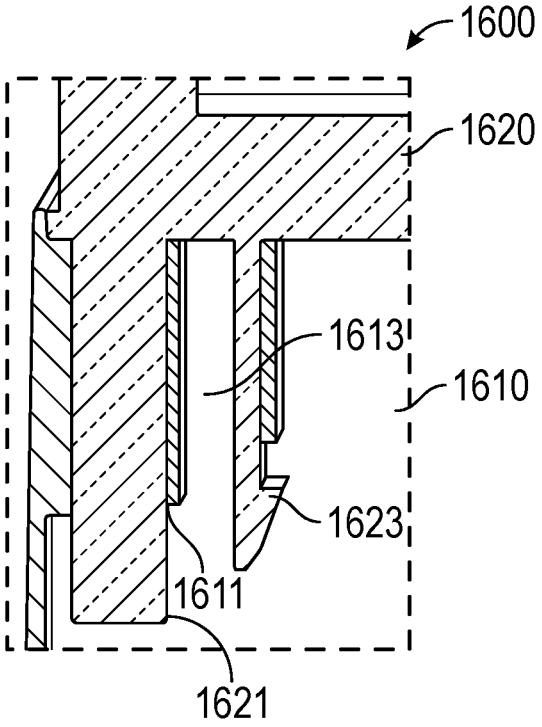
FIG. 16I is a detailed cross-section side view of a removable handle selectively engaged with a storage container in accordance with a representative embodiment of the present invention.

In some embodiments, handle 1620 is removably coupled to base, as shown in FIGS. 16G-16I. Handle 1620 may comprise legs 1621 configured to insert within leg receptacles 1611 of base 1610. In some embodiments, handle 1620 further comprises retaining clips 1623 configured to insert within and engage with clip receptacles 1613 of base 1610. In some embodiments, retaining clips 1623 may be reversibly coupled to clip receptacles 1613. In some embodiments, handle 1620 may further include one or more detents 1625 configured to insert within a catch or notch provided in leg receptacle 1611, wherein the mechanical interface between detent 1625 and leg receptacle 1611 is irreversible. In some embodiments, handle 1620 is coupled to container 1600 as part of an assembly process by a consumer or retailer.

The interior walls of base 1610 are generally smooth and featureless, unlike some of the previous embodiments of this invention. Base 1610 further comprises an interior floor surface 1626 comprising a plurality of grooves 1628 forming a grid pattern of intersecting horizontal and vertical grooves at approximately right angles to one another, wherein the at least some of the horizontal and vertical grooves are interconnected. In some embodiments, the grid pattern of grooves forms a network of interconnected grooves, wherein the network of interconnected grooves forms a reservoir 1630 below the interior floor surface 1626 for collecting and isolating liquid and other materials from the interior floor surface, such that items in contact with the interior floor surface are prevented from contacting the liquid or other contents of the reservoir. In some embodiments, at least one of the grooves 1628 is aligned with an engagement surface 1640 of base 1610, as described below. In some embodiments, the interconnected grooves of the grid pattern comprise rounded walls and/or edges, as shown in FIGS. 20C and 22G, below.

Raised perimeter edge 1618 defines an upper opening 1611 of storage container 1600. In some instances, raised perimeter edge 1618 is the upper or top edge of each side wall of container 1600. In some embodiments, container 1600 further comprises raised internal edges 1619 which are located within the interior of container 1600 and interconnect oppositely positioned sides of raised perimeter edge 1618. For example, in some embodiments container 1600 comprises raised internal edges 1619*a* and 1619*b* which extend between forward raised perimeter edge 1618*a* and rearward raised perimeter edge 1618*b*, wherein raised internal edge 1619*a* is the top edge of an interior wall of the left half 1614 compartment of container 1600, and raised internal edge 1619*b* is the top edge of an interior wall of the right half 1616 compartment of container 1600. In some embodiments, handle 1620 is positioned between the interior walls and raised internal edges 1619*a* and 1619*b*, wherein said opening 1622 is defined by an open space between the interior walls and raised internal edges and beneath a middle portion of the handle 1620, and wherein spaces forward and rearward of opening 1622 provides forward and rearward compartments 1632 and 1634, respectively. In some embodiments, at least one of forward and rearward compartments 1632 and 1634 comprise at least one drain hole 1636, whereby a liquid or other undesirable material within the compartment may exit the compartment via drain hole 1636. In some embodiments, forward and/or rearward compartments 1632 have a depth that is approximately equal to a distance between the raised perimeter edge 1618 and channel 1612, wherein a bottom surface of the compartment 1632 is the upper or top surface of the channel 1612.

Storage container 1600 further comprises at least one engagement surface 1640 for compatibly receiving and retaining at least one surface of a divider configured for use with container 1600. In some embodiments, at least one raised perimeter edge 1618 and/or raised internal edge 1619 comprises an engagement surface 1640. In some embodiments, storage container 1600 comprises a plurality of engagement surfaces. In some embodiments, storage container 1600 comprises at least one engagement surface 1640 for each groove 1628, wherein the at least one engagement surface 1640 is aligned with and corresponds with the groove 1628 (see alignment plane 1638). In some embodiments, the at least one engagement surface 1640 is adapted to receive a first part of a divider for use with the storage container 1600, and the groove 1628 is adapter to receive a second part of the divider, wherein the engagement surface 1640 and the groove 1628 maintain a desired location of the divider within the storage container.

In some embodiments, engagement surface 1640 comprises a stepped or notched surface having a first or upper width that is greater than a second or lower width. Accordingly, engagement surface 1640 may have a plurality of horizontal and vertical surfaces. In some embodiments, engagement surface 1640 is formed by removing a portion of raised perimeter and/or raised internal edges 1618, 1619. In some embodiments, a divider adapted for use with storage container 1600 comprises one or more engagement surfaces, as described below.

In some embodiments, engagement surface 1640 comprises a plurality of rounded receptacles configured to receive a peg extension of a divider, as described below. In some embodiments, a rounded receptacle further comprises a chamfered or beveled opening having an upper or outer width that is greater than a lower or inner width, such that the opening tapers inwardly from the top edge of raised perimeter edge 1618 to the rounded receptacle. In some embodiments, the upper or outer width is approximately equal to or larger than a diameter of the rounded receptacle, and the lower or inner width is less than the diameter of the rounded receptacle, such that the lower or inner width provides a constriction point for engagement surface 1640. In some embodiments, a peg extension of a divider comprises a width that is approximately equal to the diameter of the rounded receptacle, such that a mechanical interference is experienced between the peg extension and the constriction point of the lower or inner width when the peg extension is inserted into the rounded receptacle. Once inserted within the rounded receptacle, the constriction point of the lower or inner width maintains the inserted position of the peg extension within the rounded receptacle.

Figure 17A:
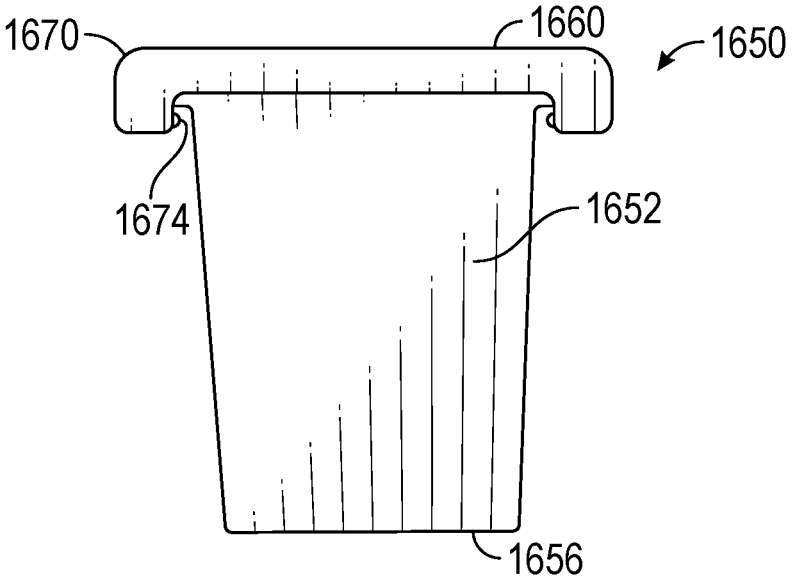
FIG. 17A is a front plan view of a divider having engagement arms in accordance with a representative embodiment of the present invention.
Figure 17B:
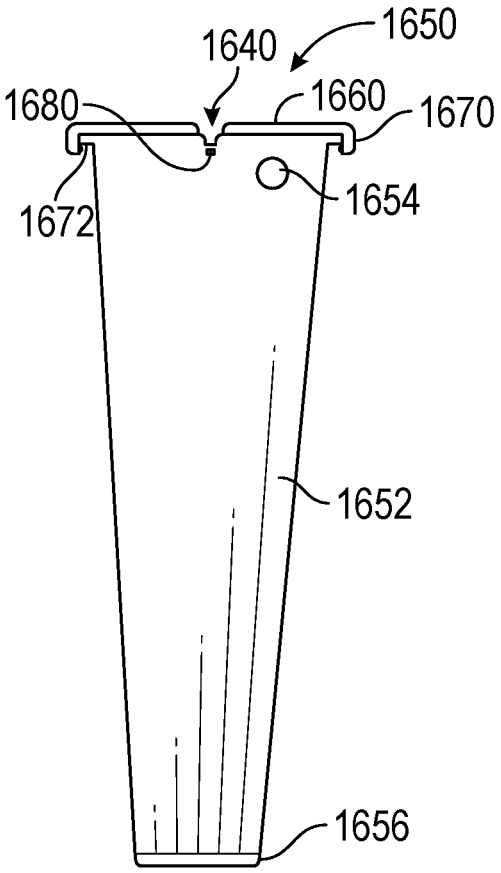
FIG. 17B is a front plan view of a divider having engagement arms in accordance with a representative embodiment of the present invention.
Figure 17C:
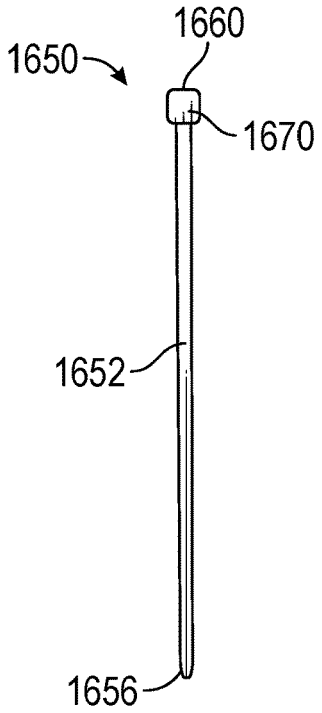
FIG. 17C is a plan side view of the divider shown in either of FIGS. 17A and 17B.
Figure 18A:
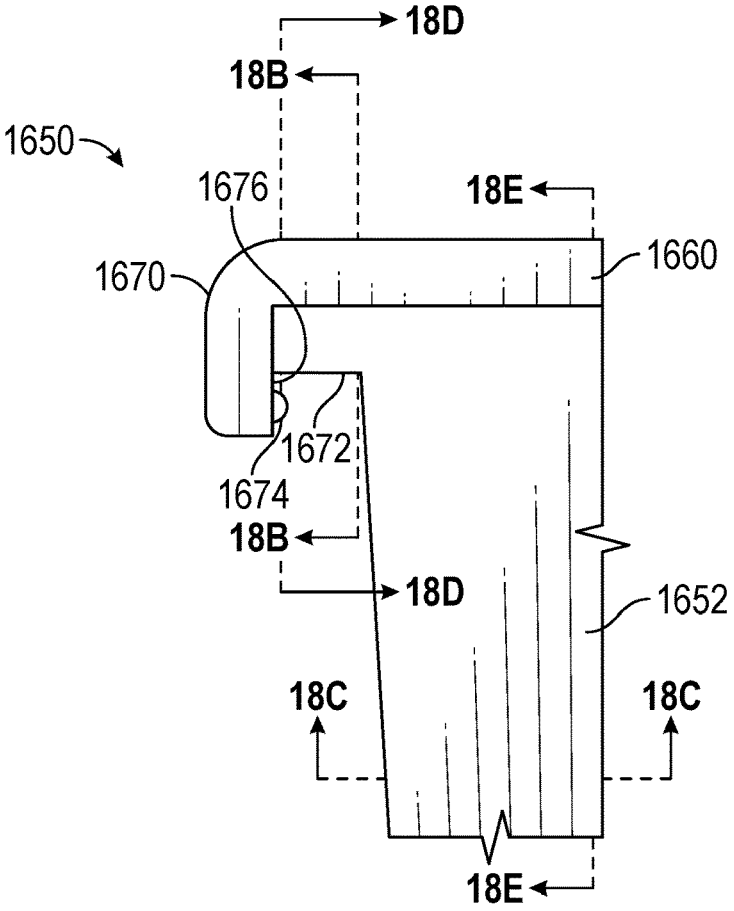
FIG. 18A is a detailed front plan view of an engagement arm of the divider in any of FIGS. 17A-17C.
Figure 18B:
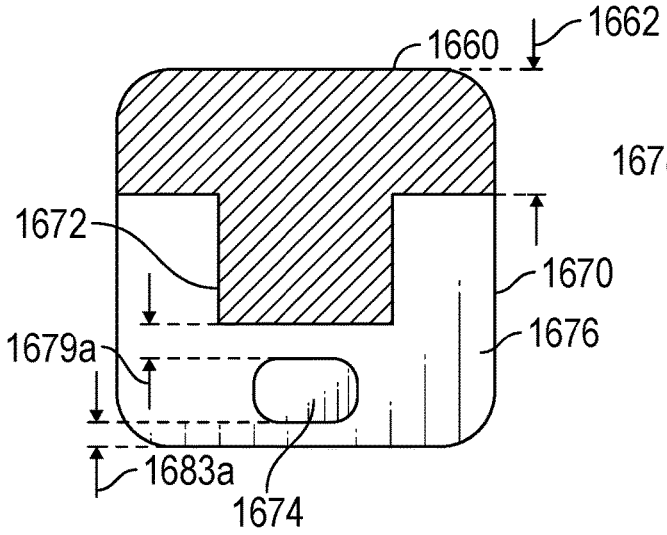
FIG. 18B is a detailed cross-section side view of the head of the engagement arm of the divider shown in FIG. 18A.
Figure 18C:
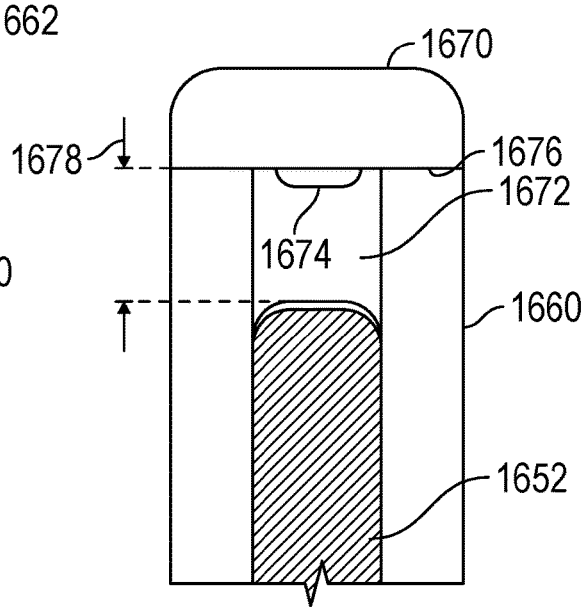
FIG. 18C is a detailed cross-section bottom view of the divider shown in FIG. 18A.
Figure 18D:
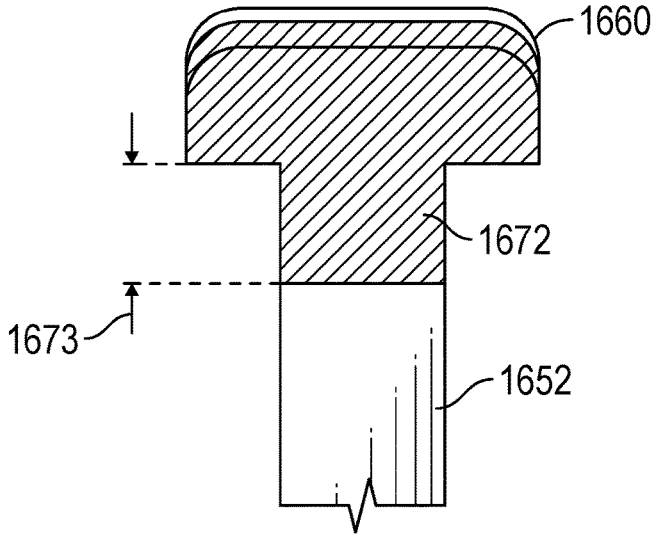
FIG. 18D is a detailed cross-section side view of the base of the engagement arm of the divider shown in FIG. 18A.
Figure 18E:
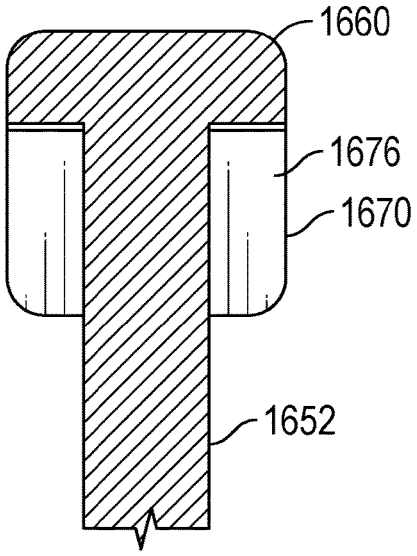
FIG. 18E is a detailed cross-section side view of the divider shown in FIG. 18A.

Referring now to FIGS. 17A-17C, a divider 1650 adapted for use with storage container 1600 is shown. In some embodiments, divider 1650 comprises a body 1652 having a height that is approximately equal to a depth of container 1600. In some embodiments, the depth of container 1600 is defined by a distance between raised perimeter edge 1618 and bottommost interior surface of the container, for example, the lowest surface of grooves 1628 (i.e., the bottom of reservoir 1630). Body 1652 may comprise any shape or configuration compatible for use with the present invention. In some embodiments, body 1652 is solid, as shown in FIG. 17A. In some embodiments, body 1652 may comprise one or more openings or apertures 1654, as shown in FIG. 17B. In some embodiments, the outer edges of body 1652 are tapered inwardly from the top to the bottom edge 1656, such that the degree of the taper is the same as a degree of the taper or outward angle of the walls of storage container 1600. As such, one or both of the outer edges of body 1652 may tightly align with one or more walls of the storage container 1600 when secured therein. In some embodiments, bottom edge 1656 is further tapered to match a taper or other profile shape of grooves 1628.

Divider 1650 further comprises a top edge 1660 having one or more features to accommodate attachment of divider 1650 within storage container 1600. In some embodiments, top edge 1660 comprises a thickness that is greater than a thickness of body 1652, as shown in FIG. 17C. In some embodiments, top edge 1660 further comprises a width that is greater than a width of body 1652, as clearly shown in FIGS. 17A and 17B. In some instances, top edge comprises one or more engagement arms 1670 which extend outwardly beyond the outer edges of body 1652, wherein engagement arms 1670 are adapted to engage one or more engagement surfaces 1640 of container 1600 or another divider of the system. In some instances, a divider is provided comprising an engagement surface 1640, wherein the engagement surface 1640 is formed in the body 1652 and through the top edge 1660, such that the engagement surface 1640 replaces a portion of the top edge 1660, such as is shown in the divider of FIG. 17B. Thus, in some embodiments a divider may include a divider comprises two or more sections divided by an engagement surface.

Referring now to FIGS. 18A-18E, various detailed and cross-section views of engagement arms 1670 are shown. In some embodiments, engagement arm comprises an interface surface 1676 that is positioned opposite the outer edges of body 1652 and space apart from the outer edges via an extension 1672. Interface surface 1676 is generally planar, however it is understood that interface surface 1676 may have one or more non-planar surfaces for engaging a surface or feature of storage container 1600. For example, in some embodiments interior surface 1676 comprises a bump 1674 configured to compatibly engage a catch 1680 provided on storage container 1600 or another divider (such as is as shown in FIG. 17B). In some embodiments, interior surface 1676 may comprise a recess, a texture, or some other non-planar feature.

In some embodiments, extension 1672 comprises a thickness that is equal to, or approximately equal to the thickness of body 1652. In some instances, a thickness of extension 1672 is slightly less than width 1644 of a lower notch 1648 of engagement surface 1640, and a thickness of top edge 1660 is slightly less than a width of an upper notch 1646 of engagement surface 1640, as described below. In some embodiments, a distance 1678 between interface surface 1676 and the outer edges of body 1652 is slightly greater than a thickness of raised perimeter and internal edges 1618, 1619, as well as a thickness of body 1652. In some embodiments, a distance 1679*a* between a bottom or lower surface of extension 1672 and bump 1674 is approximately equal to a distance between engagement surface 1640 and catch 1680. In some embodiments, a height 1662 of top edge 1660 is approximately equal to a depth of an upper notch 1646 of an engagement surface 1640, and a height 1673 of extension 1672 is approximately equal to a depth of a lower notch 1648 of an engagement surface 1640. Thus, the position of bump 1674, the thickness of extension 1672, the length of extension 1672, and the thickness of top edge 1660 are selected to permit concomitant engagement of each of these features with compatible surfaces and/or features of engagement surfaces 1640 and catches 1680 of the present invention, as shown below.

Figure 19A:
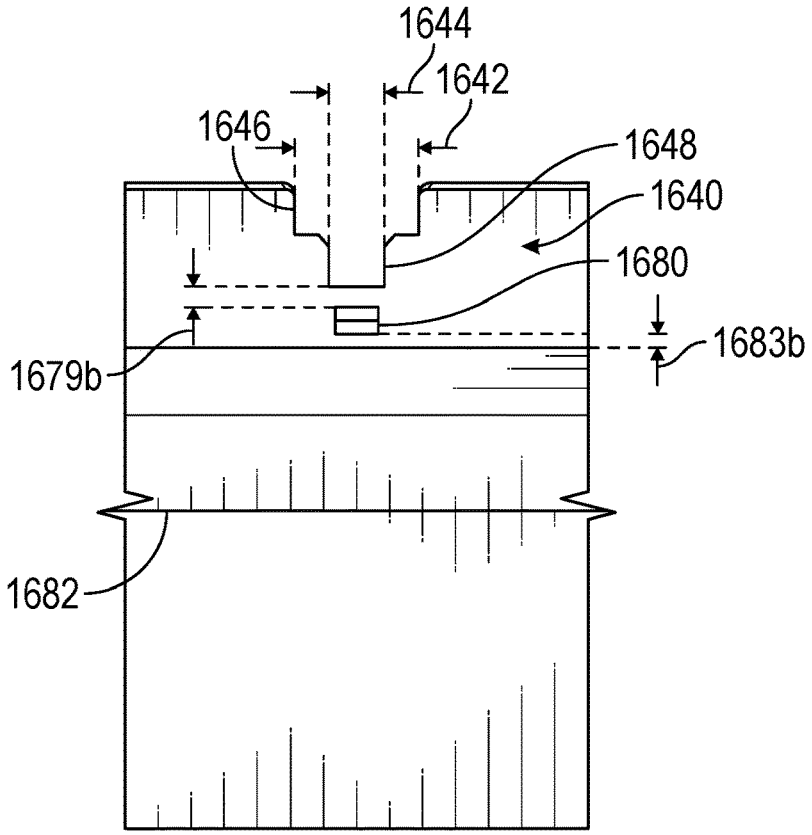
FIG. 19A is a detailed plan view of the raised perimeter edge, the engagement surface, and the catch of the storage container shown in FIG. 16A.
Figure 19B:
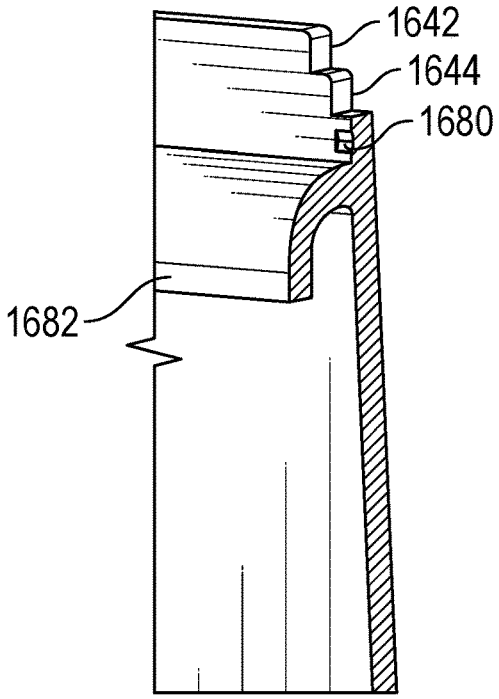
FIG. 19B is a detailed cross-section perspective view of the raised perimeter edge, the engagement surface, and the catch of the storage container shown in FIG. 16A.
Figure 19C:
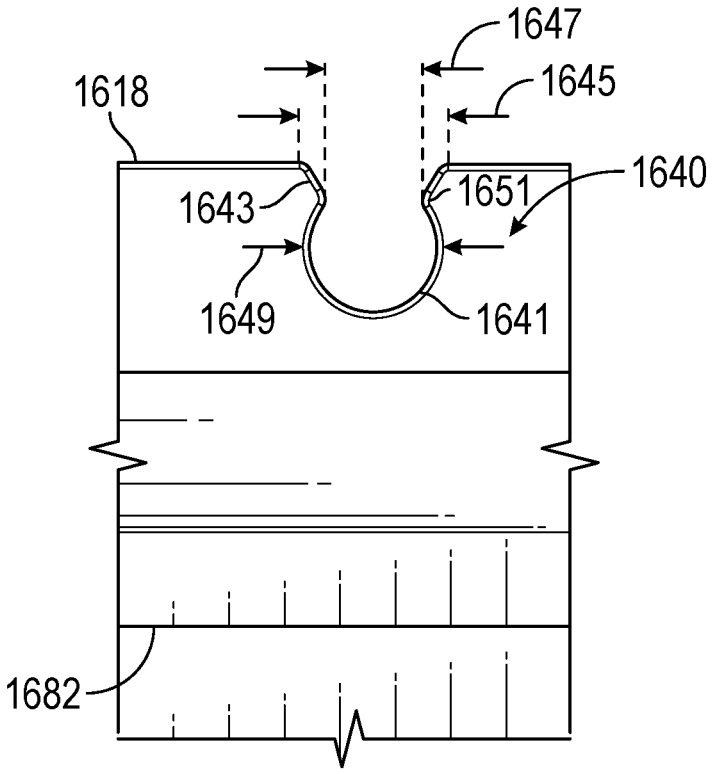
FIG. 19C is a detailed view of a raised perimeter edge comprising a plurality of receptacles for receiving a peg extension of a divider in accordance with a representative embodiment of the present invention.

Referring now to FIGS. 19A-19C, engagement surfaces 1640 comprise structural surfaces and configurations adapted to compatibly receive an extension 1672 of divider 1650. In some embodiments, engagement surfaces 1640 of the present invention may include stepped or notched surfaces comprising an upper notch surface 1646 and a lower notch surface 1648, as shown in FIGS. 19A and 19B. In some instances, the upper notch 1646 of engagement surface 1640 comprises an upper width 1642 that is greater than width 1644 of the lower notch 1648, wherein the lower width is approximately centered within the upper width 1642. In some instances, upper width 1642 is slightly greater than a thickness of top edge 1660 of divider 1650. In some embodiments, lower width 1644 is slightly greater than a thickness of extension 1672 of divider 1650. In some instances, a distance 1679*b* between the bottom of lower notch 1648 and catch 1680 is approximately equal to the distance 1679*a* between the lower surface of extension 1672 and bump 1674 of divider 1650. In some embodiments, a distance 1683*a* between the bottom of bump 1674 and the bottom edge of interface surface 1676 of divider 1650 is approximately equal to a distance 1683*b* between the bottom edge of catch 1680 and a top surface of perimeter stop 1682, such that a portion of engagement arm 1670 rests or contacts perimeter stop 1682 when bump 1674 is engaged with catch 1680. Thus, perimeter stop 1682 further supports an engaged position of divider 1650 with storage container 1600.

In some embodiments, engagement surfaces 1640 of the present invention may include a rounded receptacle 1641 comprising a chamfered or beveled opening 1643 having an upper or outer width 1645 that is greater than a lower or inner width 1647, such that the opening 1643 tapers inwardly from the top edge of raised perimeter edge 1618 to the rounded receptacle 1641, as shown in FIG. 19C. In some embodiments, the upper or outer width 1645 is approximately equal to or larger than a diameter 1649 of rounded receptacle 1641, and the lower or inner width 1647 is less than diameter 1649, such that width 1647 provides a constriction point 1651 for engagement surface 1640. In some embodiments, a peg extension of a divider comprises a width that is approximately equal to diameter 1649 such that a mechanical interference is experienced between the peg extension and the constriction point 1651 when the peg extension is inserted into the rounded receptacle 1641. Once inserted within the rounded receptacle 1641, the constriction point 1651 maintains the inserted position of the peg extension within the rounded receptacle 1641. In some embodiments, wherein the diameter of the peg extension is greater than the width of constriction point 1651, at least one of the peg extension and the constriction point 1651 comprises a compliant material configured to permit the peg extension to bypass the constriction point 1651 by applying a desired amount of downward force on the peg extension. Conversely, for these embodiments, the compliant material is further configured to permit the peg extension to be removed from the rounded receptacle 1641 by applying a desired amount of upward force on the peg extension.

Figure 20A:
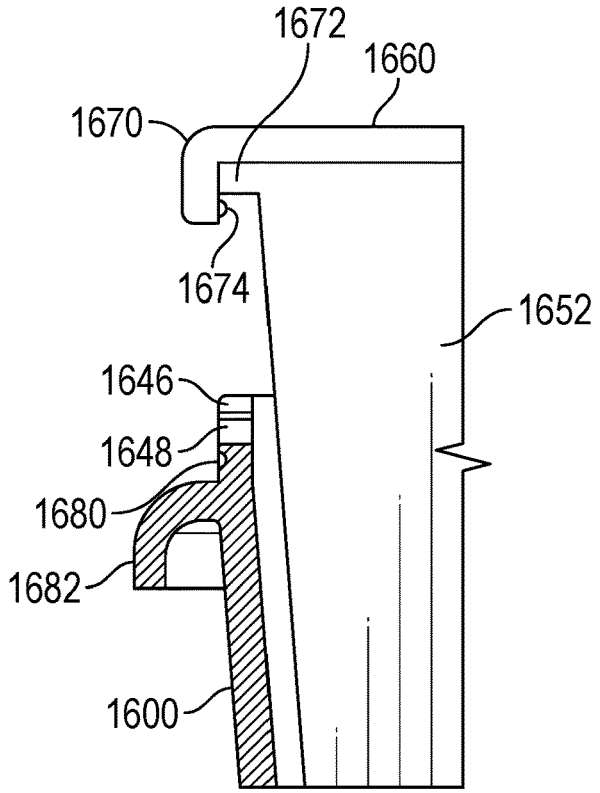
FIG. 20A is a detailed cross-section perspective view of a divider and storage container prior to engagement in accordance with a representative embodiment of the present invention.
Figure 20B:
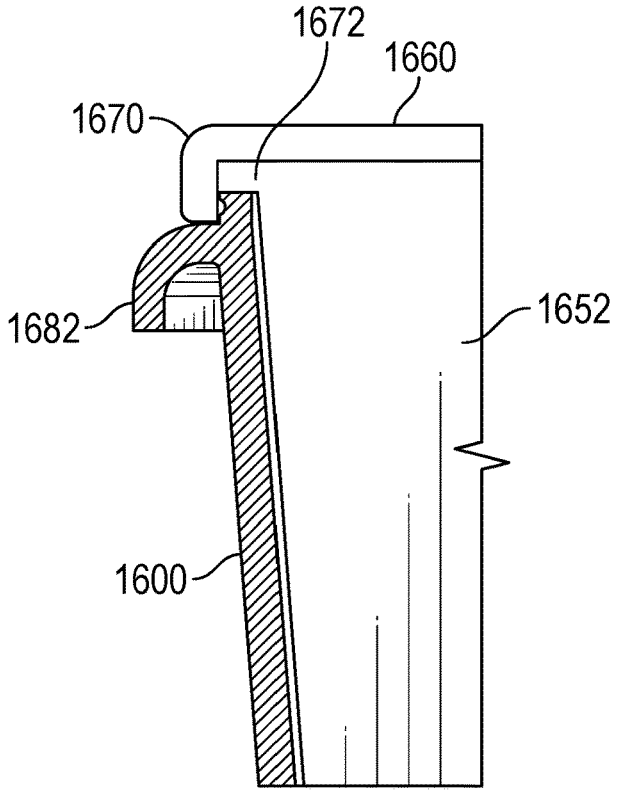
FIG. 20B is a detailed cross-section perspective view of a divider selectively engaged with a storage container in accordance with a representative embodiment of the present invention.
Figure 20C:
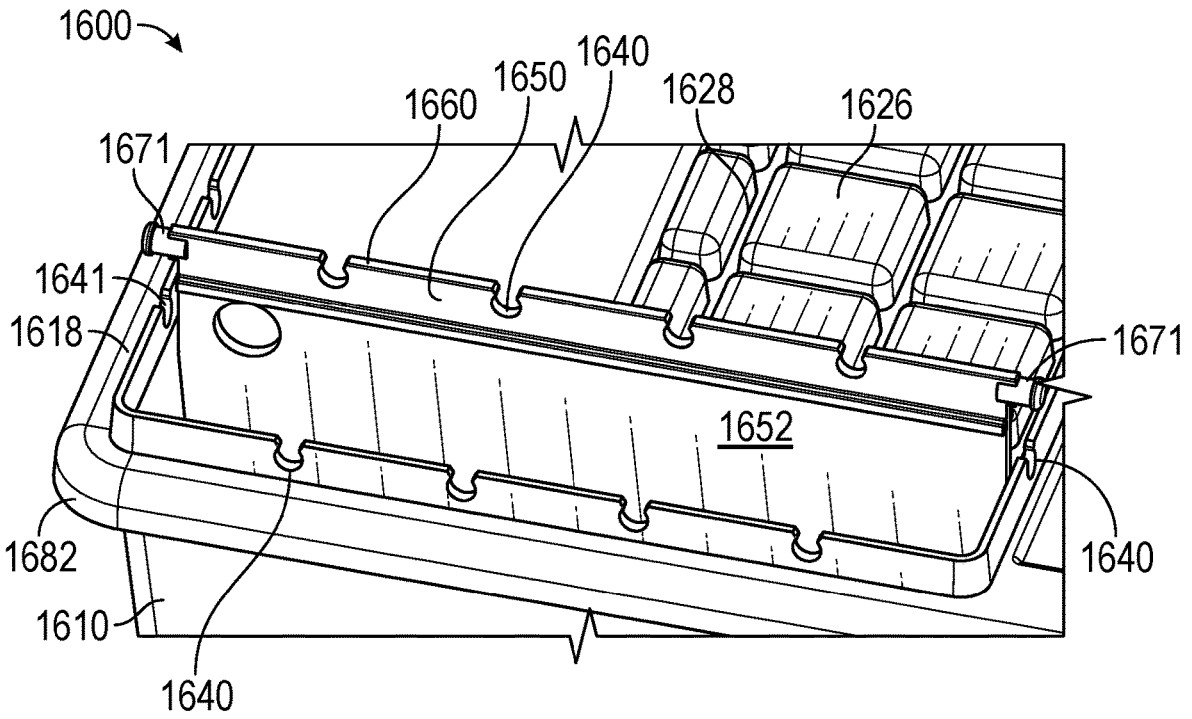
FIG. 20C is an exploded perspective view of a divider and a storage container in accordance with a representative embodiment of the present invention.

Referring now to FIGS. 20A-20G, various view are shown demonstrating engagement of divider 1650 and storage container 1600, in accordance with various representative embodiments of the present invention. FIG. 20A shows a detailed view of engagement arm 1670 and engagement surface 1640 prior to engagement of divider 1650 and container 1600, and FIG. 20B shows a detailed view of divider 1650 fully engaged with container 1600, wherein top edge 1660 is engaged with upper notch 1646, extension 1672 is engaged with lower notch 1648, and bump 1674 is engaged with catch 1680.

Figure 20D:
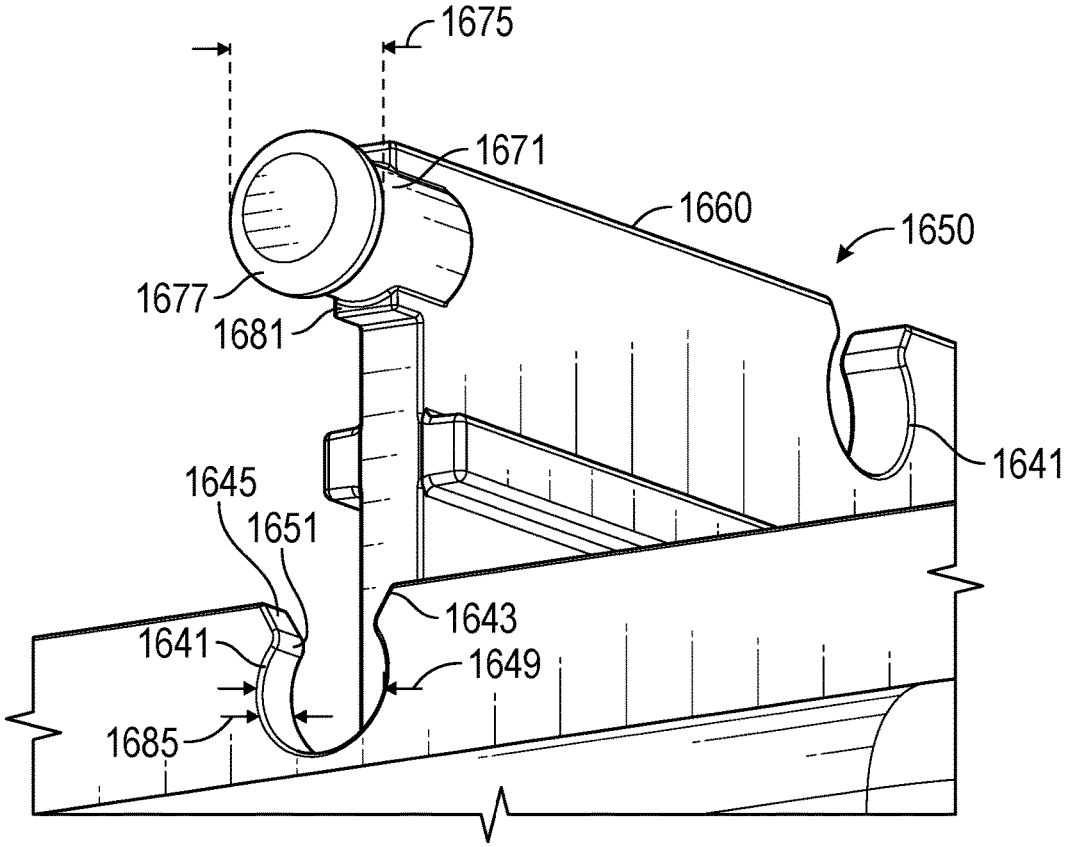
FIG. 20D is a detailed, exploded perspective view a peg extension and a receptacle of a storage container in accordance with a representative embodiment of the present invention.
Figure 20E:
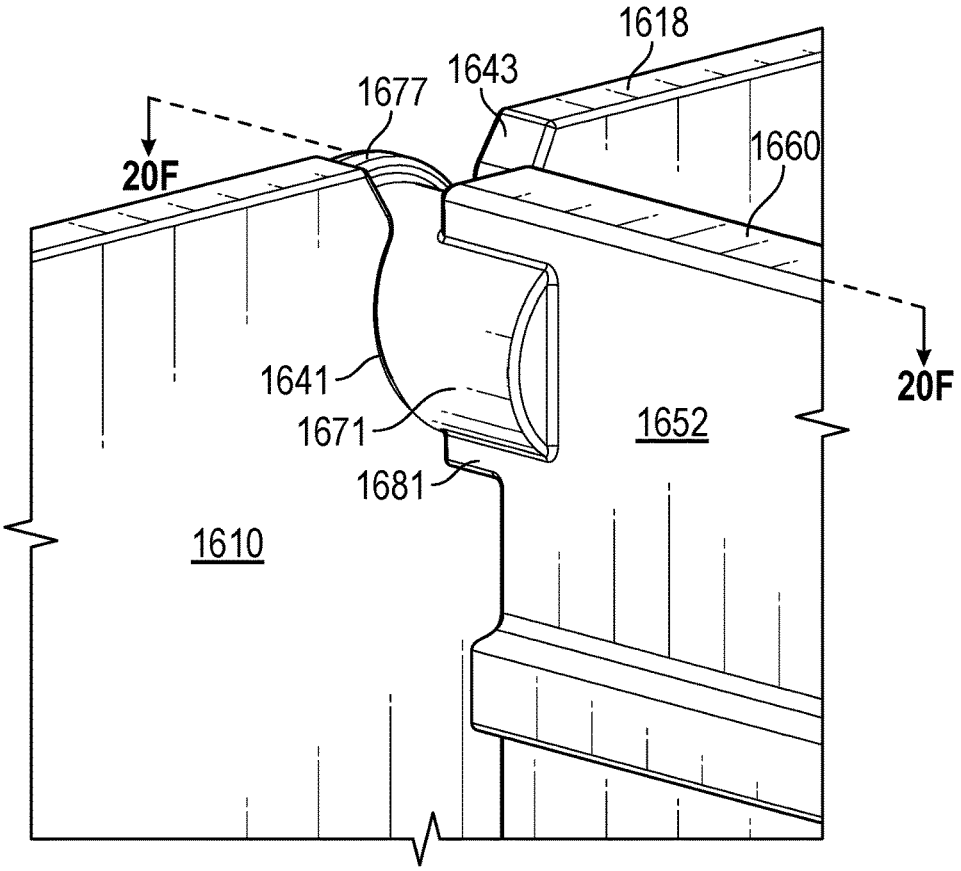
FIG. 20E is a detailed perspective view of a peg extension engaged with a receptacle of a storage container in accordance with a representative embodiment of the present invention.
Figure 20F:
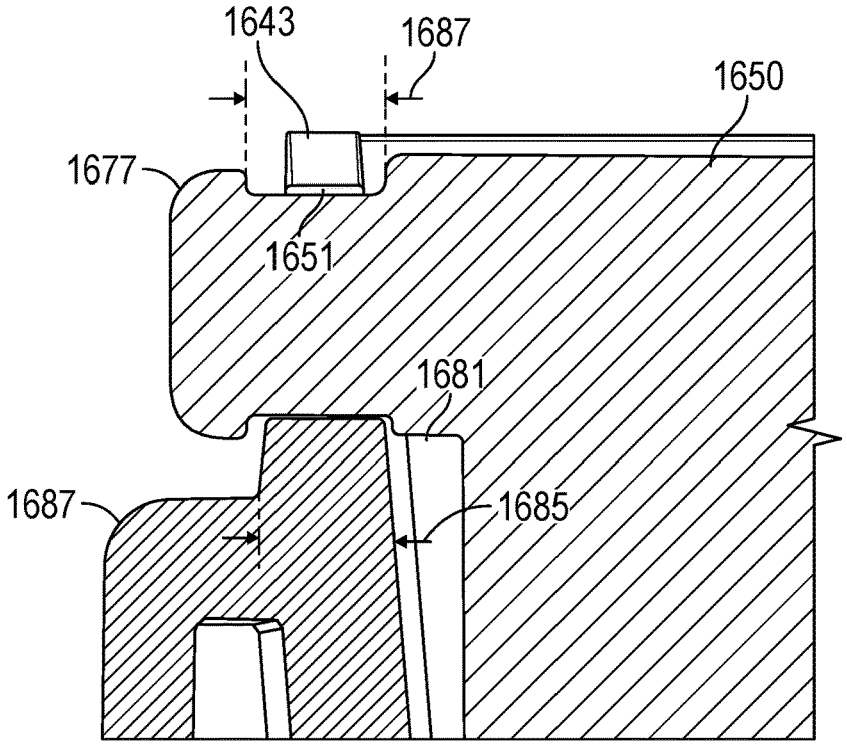
FIG. 20F is a cross-section view of a peg extension engaged with a receptacle of a storage container in accordance with a representative embodiment of the present invention.
Figure 20G:
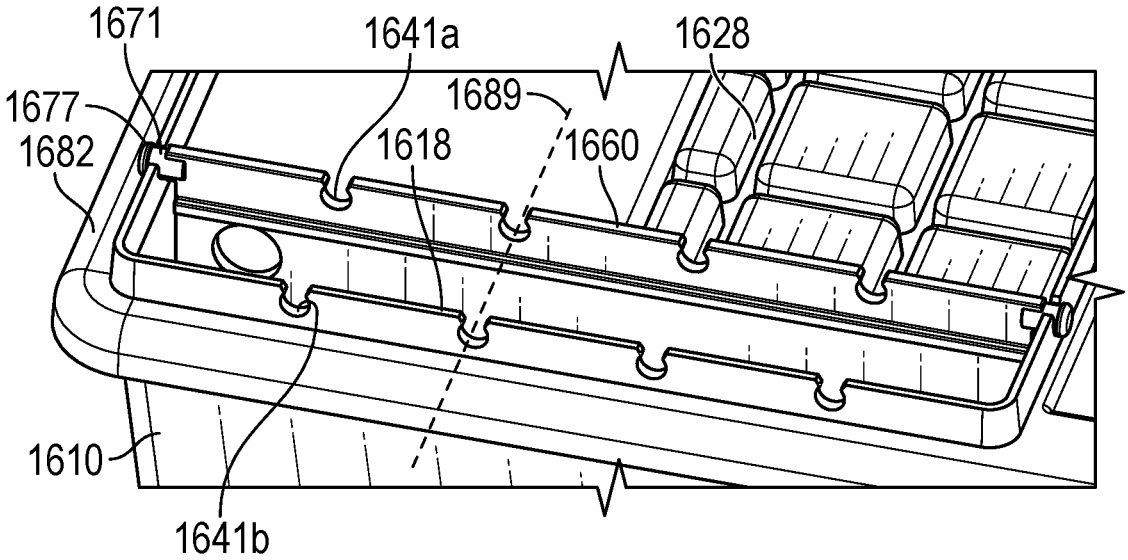
FIG. 20G is a perspective view of a divider comprising peg extensions, wherein the peg extensions are engaged with opposing receptacles of a storage container in accordance with a representative embodiment of the present invention.

FIGS. 20C and 20D show a detailed views of divider 1650 prior to engagement with container 1600. In some embodiments, divider 1650 comprises peg extensions 1671 which are coupled to or form part of top edge 1660 and extend outwardly therefrom, such that peg extensions 1671 are located outside the body 1652 of divider 1650. Peg extension 1671 generally comprises a cylindrical extension having a width 1675 that is approximately equal to diameter 1649 of rounded receptacle 1641. In some embodiments, peg extension 1671 comprises an end or tip 1677 having a diameter that is greater than width 1675 and diameter 1649. Body 1652 further comprises a stop 1681, wherein a length 1687 of the portion of peg extension 1671 located between tip 1677 and stop 1681 is approximately equal to, or slightly less than a thickness 1685 of rounded receptacle 1641, such that this portion of peg extension 1671 is configured to seat within rounded receptacle 1641 with minimal lateral tolerance, as shown in FIGS. 20E-20G. When divider 1650 is engaged with container 1600, rounded receptacles 1641*a* of divider 1650 are laterally aligned 1689 with adjacent rounded receptacles 1641*b* on raised perimeter edge 1618, as well as laterally aligned with a groove 1628, as shown in FIG. 20G. As such, an additional divider (not shown) may be coupled to divider 1650 and container 1600 via rounded receptacles 1641*a* and 1641*b*, wherein a bottom end of said additional divider would be inserted within groove 1628.

Figure 21A:
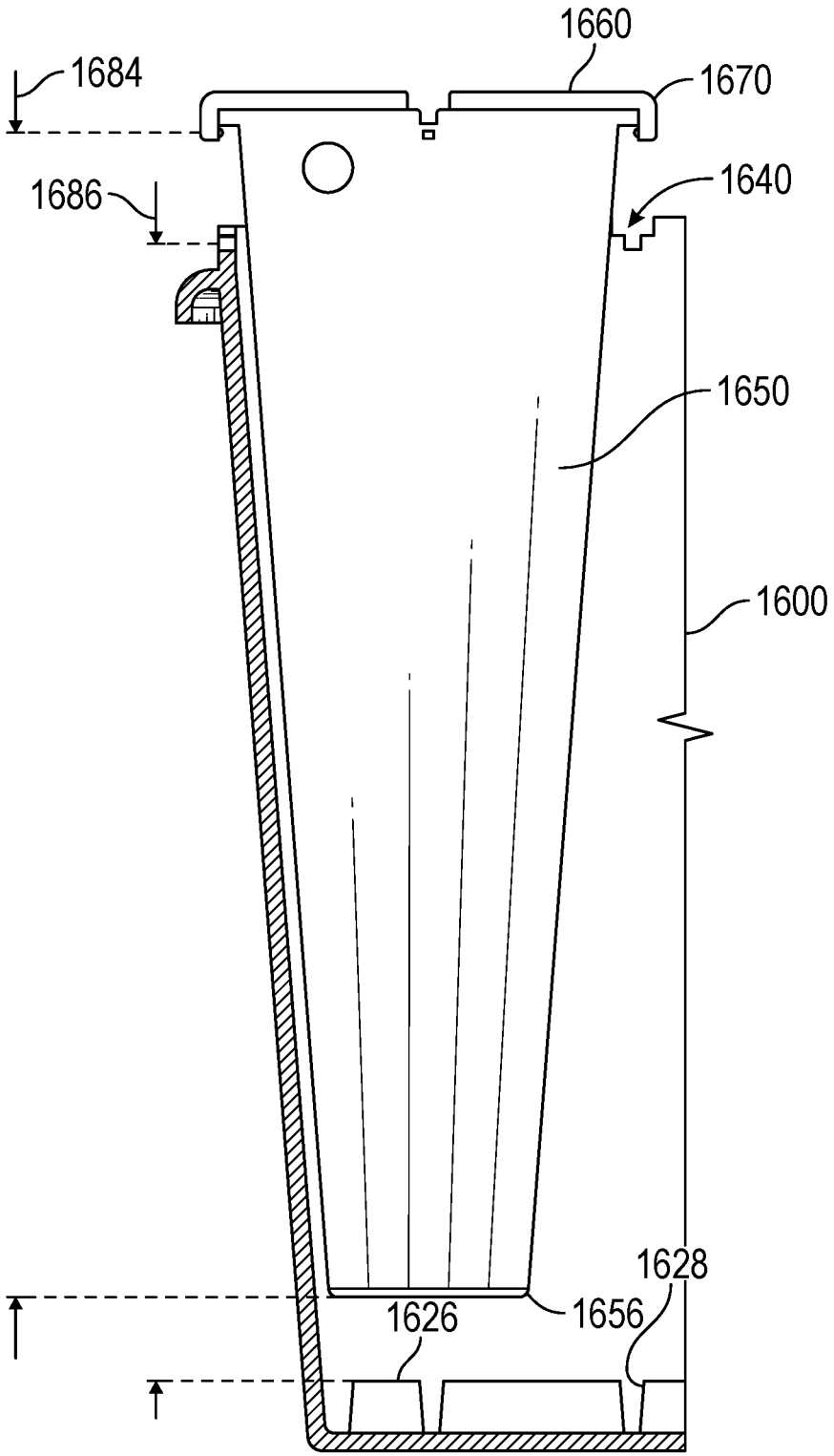
FIG. 21A is a detailed cross-section end view of a divider and storage container prior to engagement and illustrating relative heights between various surfaces in accordance with a representative embodiment of the present invention.
Figure 21B:
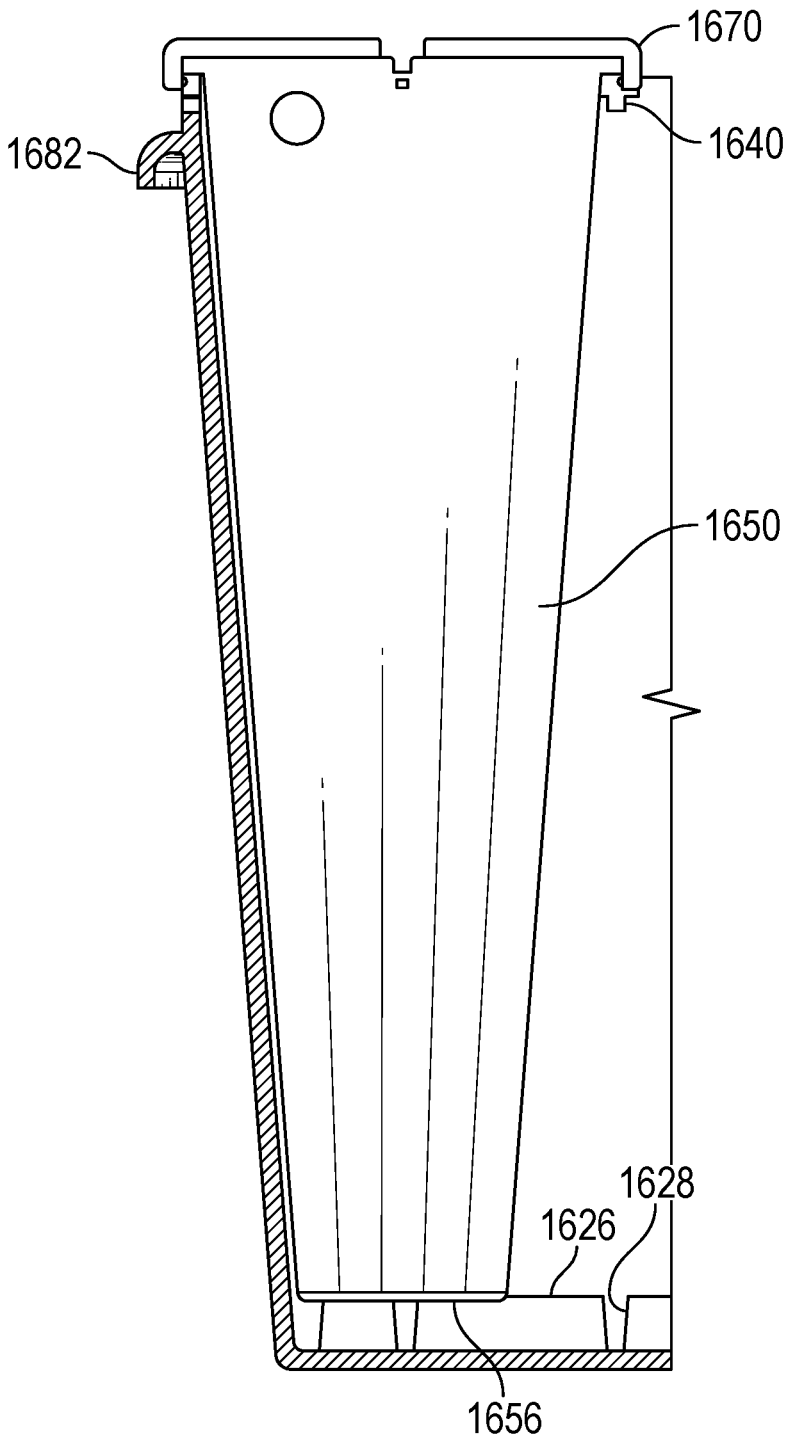
FIG. 21B is a detailed cross-section end view of a divider and storage container demonstrating a first step of engagement, wherein the bottom edge is engaged with a groove in the floor surface of the storage container, but the engagement arm of the divider is not engaged with the engagement surface of the raised perimeter edge, in accordance with a representative embodiment of the present invention.
Figure 21C:
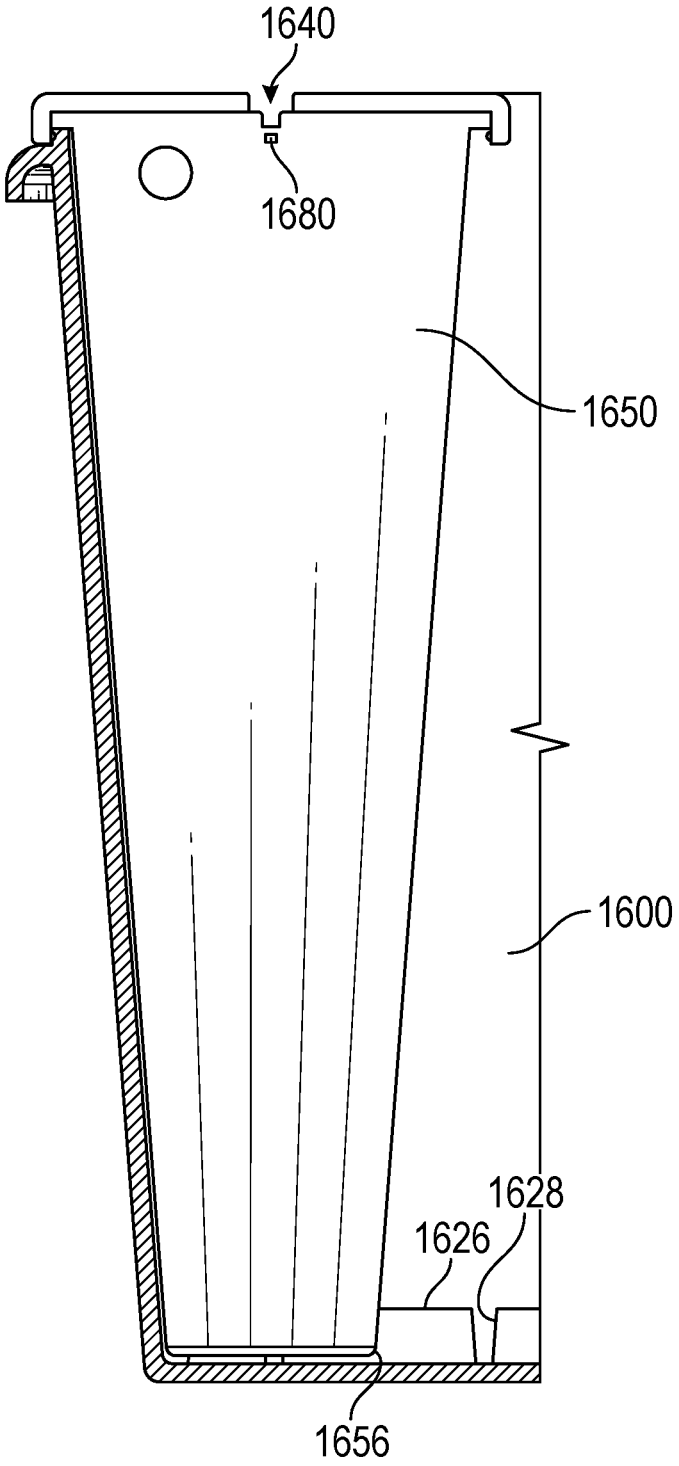
FIG. 21C is a detailed cross-section end view of a divider and storage container demonstrating a second step of engagement, wherein the bottom edge is fully engaged with the groove in the floor surface of the storage container, and the engagement arm of the divider is fully engaged with the engagement surface of the raised perimeter edge, in accordance with a representative embodiment of the present invention.
Figure 21D:
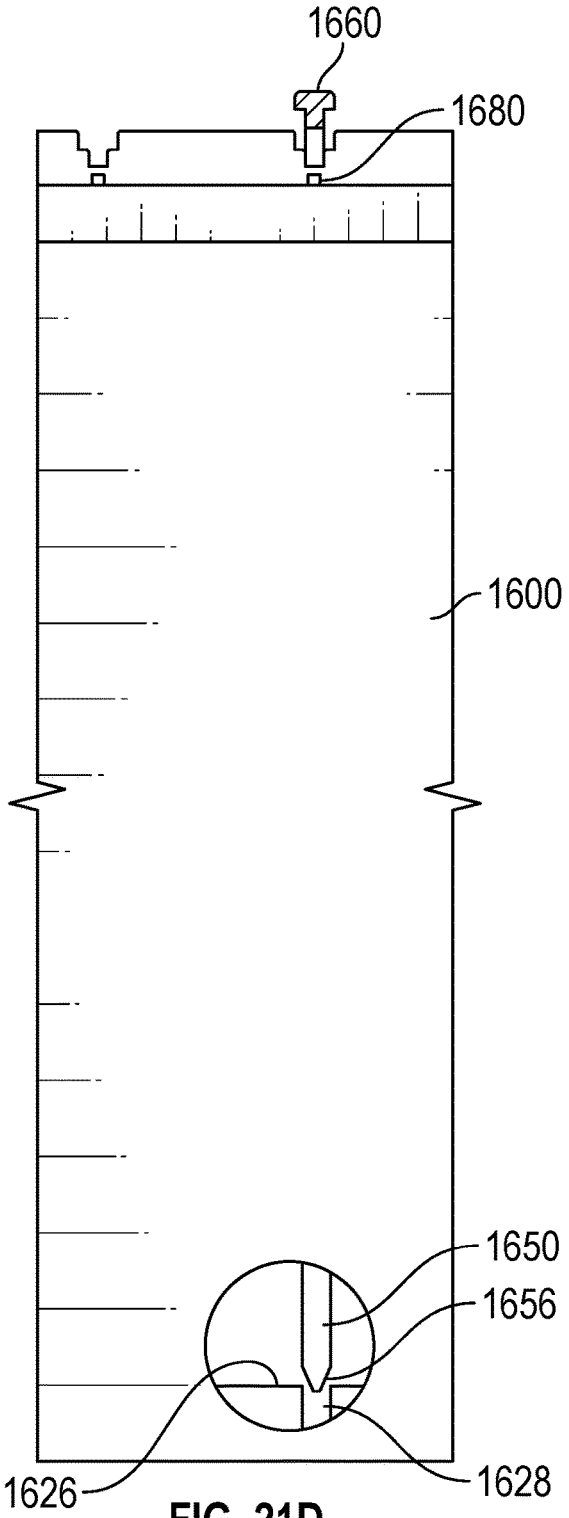
FIG. 21D is a partially cross-section side view of the storage container and divider demonstrating the first step of engagement shown in FIG. 21B, and further illustrating a vertical alignment of the groove in the floor surface of the storage container with the engagement surface of the raised perimeter edge in accordance to a representative embodiment of the present invention.

Referring now to FIGS. 21A-E, various detailed partially cross-sectioned views are shown demonstrating various important features and methods for engaging a divider 1650 with a storage container 1600 in accordance with various representative embodiments of the present invention. In some embodiments, a first distance 1684 between the underside of the extension 1672 and bottom edge 1656 of divider 1650 is greater than a second distance 1686 between the lower notch 1648 and interior floor surface 1626 of container 1600. As such, bottom edge 1656 may engage with grooves 1628 prior to engagement of engagement arms 1670 with engagement surface 1640, as shown in FIGS. 21B and 21D.

Figure 21E:
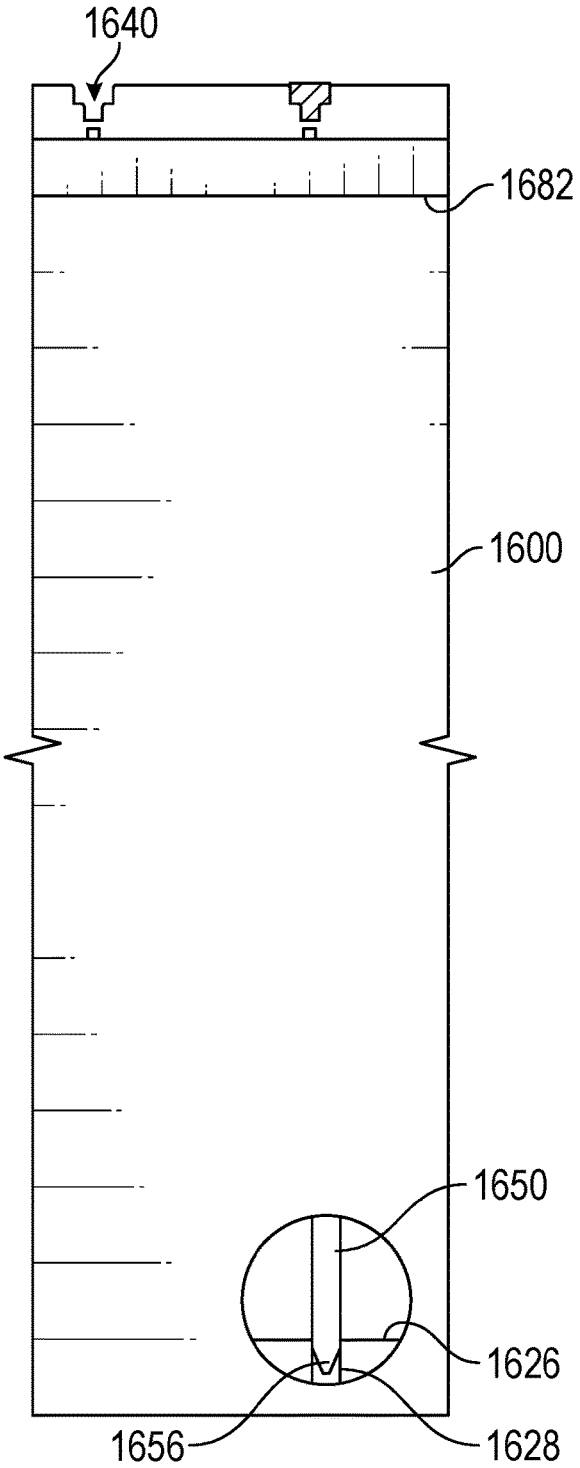
FIG. 21E is a partially cross-section side view of the storage container and divider demonstrating the second step of engagement shown in FIG. 21C.

As thus configured, insertion and engagement of divider 1650 with container 1600 is a three-step process, wherein a first step is achieved by selectively engaging the bottom edge 1656 with a groove 1628 of container 1600, as shown in FIGS. 21B and 21D. In some embodiments, this first step is assisted by providing rounded edges and/or walls for groove 1628. Once engaged, the second step is to align the engagement arms 1670 with an engagement surface 1640 corresponding to the groove 1628 in which the bottom edge 1656 is inserted. This may be accomplished by pivoting the divider forward and backwards (or side to side) on an axis provided by an interaction between the bottom edge 1656 and groove 1628. The engagement of bottom edge 1656 and groove 1628 enables the user to align the engagement arms 1670 and engagement surfaces 1640 without needing to also align the bottom edge with a corresponding groove. Thus, the interaction between bottom edge 1656 and groove 1628 provides stability and accuracy during the engagement process. Once aligned, the third step is to fully engage the engagement arms 1670 with the engagement surface 1640, whereby the bottom edge 1656 is more fully inserted within groove 1628, as shown in FIGS. 21C and 21E.

Figure 22A:
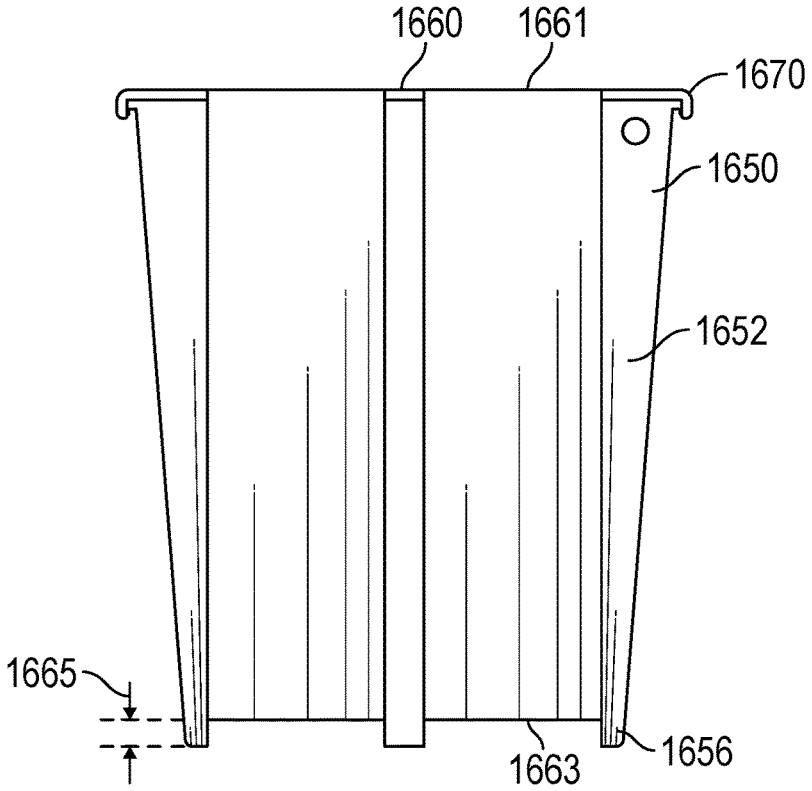
FIG. 22A is a side plan view of a divider having a plurality of receptacles and bottom edge extensions for engaging a groove in the floor surface of a storage container in accordance with a representative embodiment of the present invention.
Figure 22B:
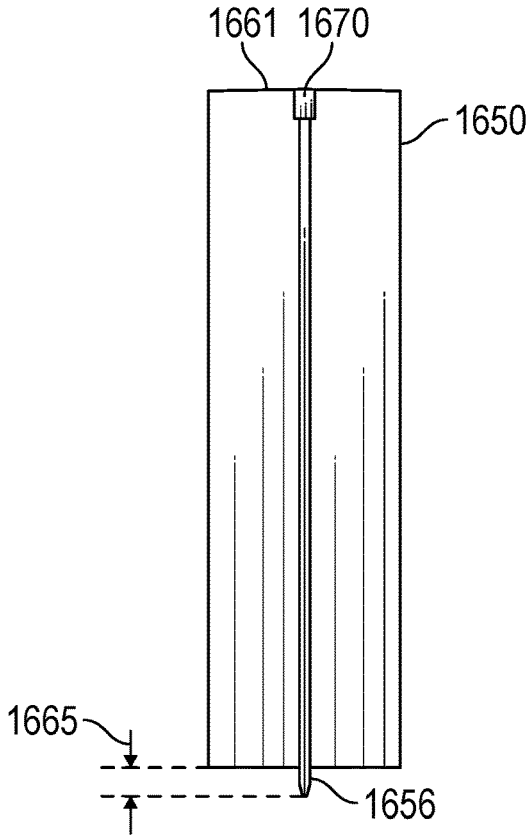
FIG. 22B is an end plan view of the divider shown in FIG. 22A.

Referring now to FIGS. 22A and 22B, in some embodiments divider 1650 comprises one or more receptacles 1688 forming a top opening 1661 in top edge 1660 and providing a pathway through a portion of body 1652. In some embodiments, receptacle 1688 further comprises a bottom opening 1663 that is adjacent bottom edge 1656 but is not formed in or through bottom edge 1656. As such, there is a space 1665 between to bottom opening 1663 of receptacle 1688 and bottom edge 1656. Further, bottom edge 1656 is divided into multiple sections by receptacle 1688. In some embodiments, space 1665 is less than a depth of grooves 1628, such that when bottom edge 1656 is maximally inserted within grooves 1628 bottom opening 1663 rests on interior floor surface 1626. Although the bottom opening 1663 rests on interior floor surface 1626, the grid pattern of grooves 1628 permits fluid communication between the interior volume of receptacle 1688 and reservoir 1630 via grooves 1628 and bottom opening 1663. In some embodiments, space 1665 is greater than a depth of grooves 1628, such that when bottom edge 1656 is maximally inserted within grooves 1628, a gap is provided between bottom opening 1663 and interior floor surface 1626, as shown in FIGS. 23A and 23B.

Figure 23A:
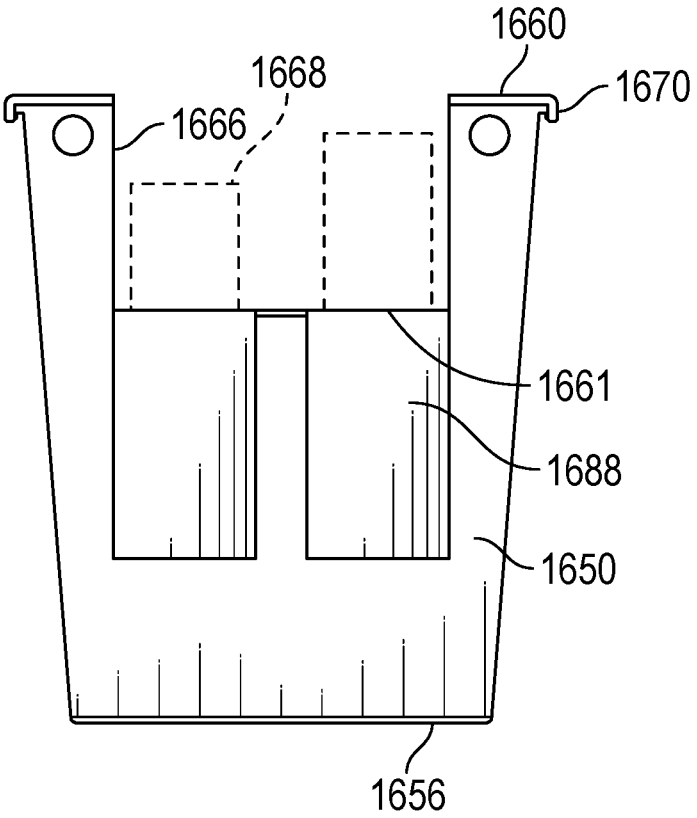
FIG. 23A a side plan view of a divider having a plurality of truncated receptacles in accordance with a representative embodiment of the present invention.
Figure 23B:
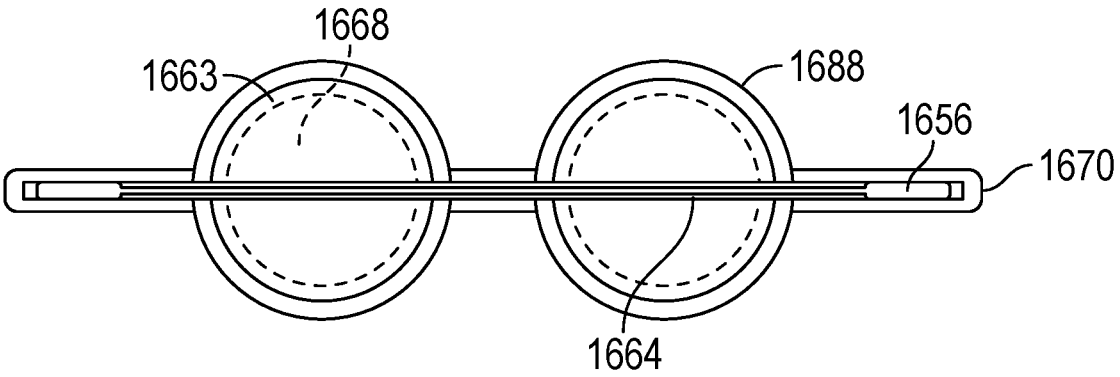
FIG. 23B is a bottom plan view of the divider shown in FIG. 23A.

Referring now to FIGS. 23A and 23B, a divider 1650 comprising truncated receptacles is shown. In some embodiments, a divider 1650 is provided comprising one or more receptacles 1688 having a top opening 1661 formed in the body of the divider, but not in the top edge 1660, and further comprising a bottom opening 1663 that is formed in the body of the divider, but not in the bottom edge 1656. Receptacles 1688 provide a pathway through the body of divider 1650 such that the bottom opening 1663 is in fluid communication with the top opening 1661 via the pathway of the receptacle 1688. Divider 1650 of the present embodiment further comprises an access window or cutout 1666 that provides access to store and recover items 1668 stored within receptacles 1688. As such, items 1668 having a height that is less than a distance between the bottom opening 1663 and top edge 1660 may be easily recovered from receptacles 1688 by accessing the items 1668 via the cutout 1666. In some embodiments, a portion 1664 of the divider body intersects the bottom opening 1663 to provide a barrier for items 1668, such that portion 1664 prevents items 1668 from exiting receptacle 1688 via bottom opening 1663. In some embodiments, portion 1664 comprises a plurality of surfaces and/or features that intersect bottom opening 1663 to prevent passage of items 1668 stored within receptacle 1688.

Figure 24:
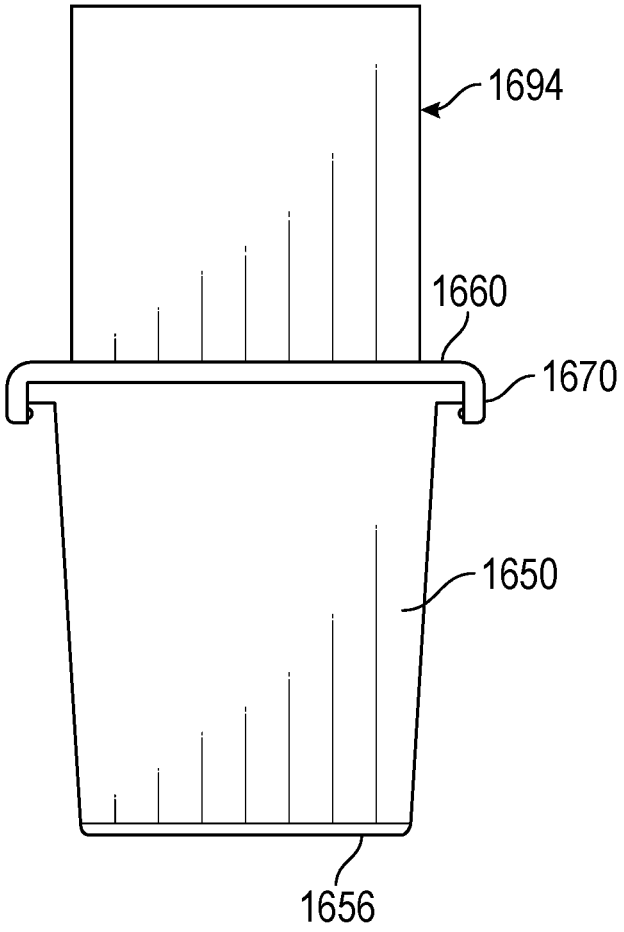
FIG. 24 is a front plan view of a divider comprising an extension in accordance with a representative embodiment of the present invention.
Figure 25:
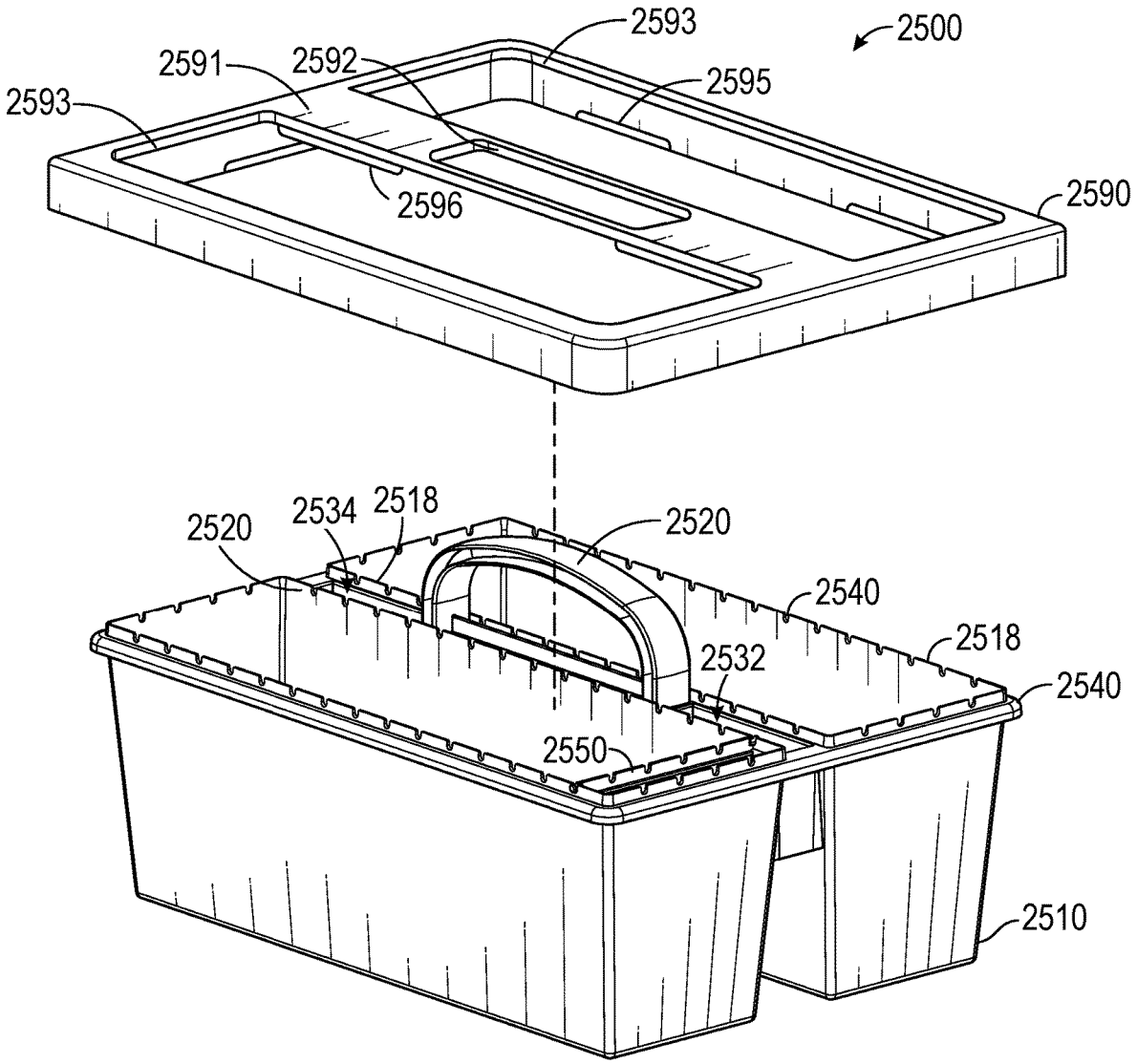
FIG. 25 is an exploded top perspective view of a retainer lid and storage container in accordance with a representative embodiment of the present invention.
Figure 26:
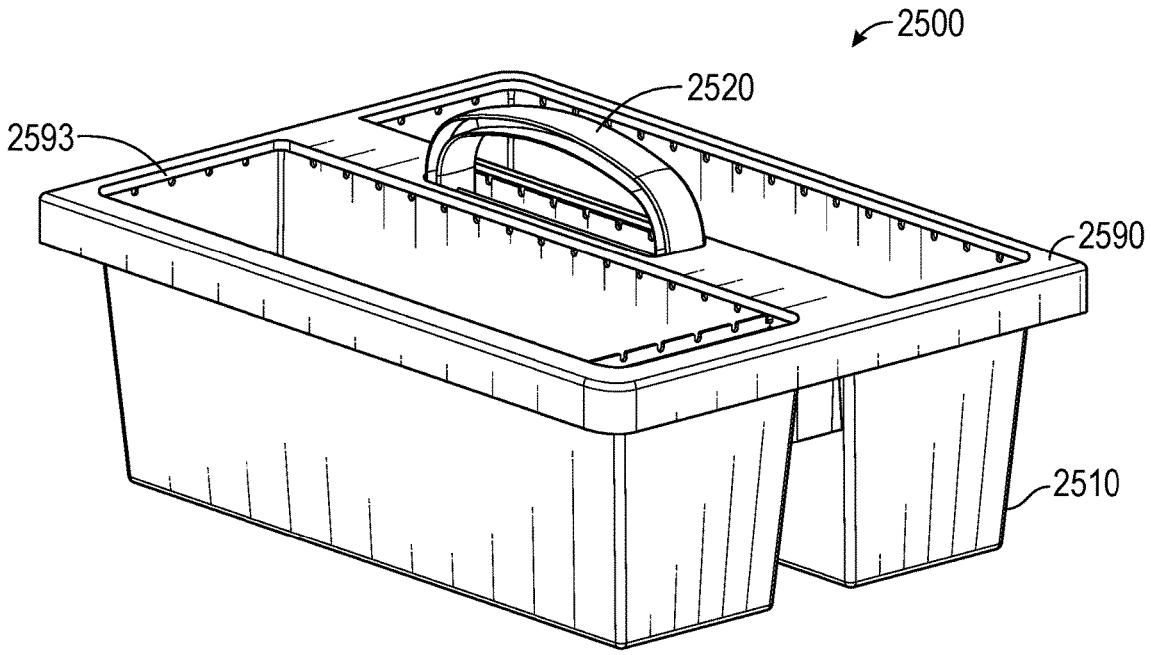
FIG. 26 is a perspective top view of a retainer lid secured to a storage container in accordance with a representative embodiment of the present invention.

Referring now to FIG. 24, in some embodiments top edge 1660 of divider 1650 comprise an extension 1694 that extends upwardly from top edge 1660. In some embodiments, extension 1694 is a planar extension having a width and thickness approximately equal to the body of the divider. In some embodiments, extension 1694 comprises at least one non-planar feature. In some embodiments, extension 1694 comprises a width that is approximately equal to the width of a standard sheet of paper, wherein extension 1694 provides a function of organizing paper goods or other sheet-like materials in an upright position. In some embodiments, extension 1694 comprises a height that extends above the raised perimeter edge 1618 of container 1600 when inserted therein. In some instances, two or more dividers comprising extensions 1694 are used together to provide a vertical channel having a width equal to a width of the dividers, a depth equal to a distance between the respective grooves and engagement surfaces to which the dividers are coupled, and a height equal to a distance between the top of the extensions 1694 and the interior floor surface 1626. In some embodiments, four dividers 1650 having extensions 1694 are used together to provide a square compartment within container 1600, wherein the square compartment has a width, depth and height defined by the relative dimensions and positions of the dividers 1650 within storage container 1600.

Referring now to FIGS. 27-30, in some embodiments a storage container 2500 further comprises a retainer lid 2590 having a perimeter sized to compatibly and selectively couple to the rim 2540 of the base 2510 of the storage container. In some instances, retainer lid 2590 comprises a central opening 2592 configured to permit passage of handle 2520 when retainer lid 2590 is secured to base 2510 (i.e., a rim portion of the exterior sidewall). Retainer lid 2590 further comprises a center support 2591 defining two openings 2593 corresponding to left and right sub-compartments or halves of base 2510, wherein openings 2593 overlap the exterior and interior raised perimeter edges 2518 when retainer lid 2590 is secured to base 2510, and openings 2593 permit access to the sub-compartments of base 2510. In some instances, center support 2591 is configured to cover forward and rearward compartments 2532, 2534 of base 2510 when secured to base 2510.

Figure 27:
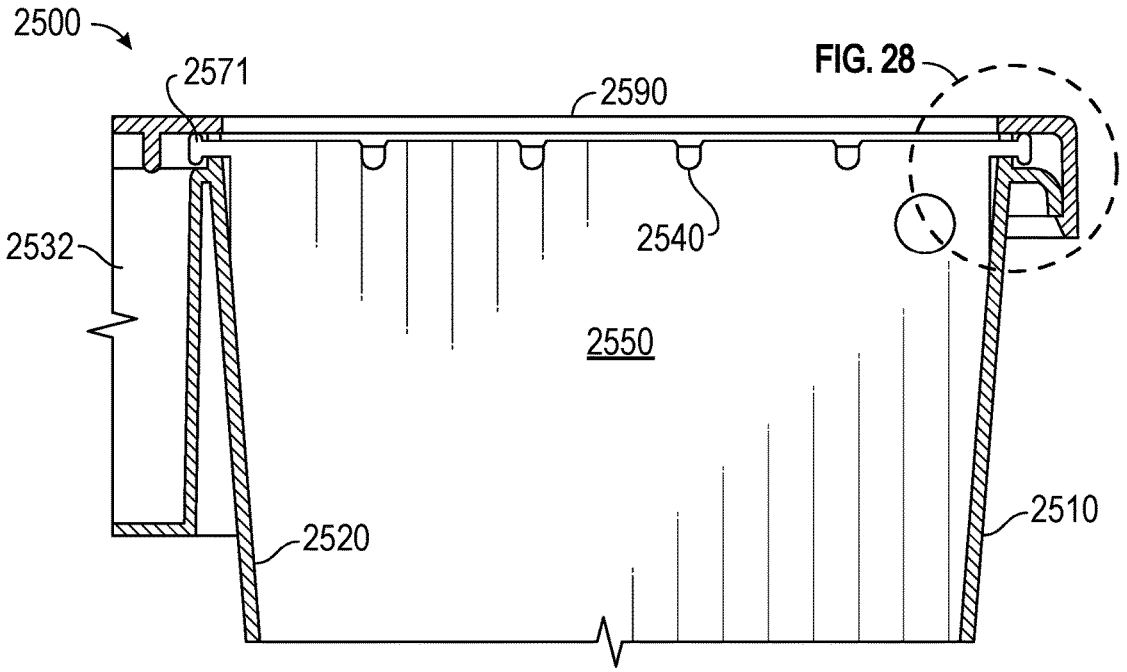
FIG. 27 is a partial cross-section view of a retainer lid and storage container, further comprising a front view of a divider secured within the storage container in accordance with a representative embodiment of the present invention.
Figure 28:
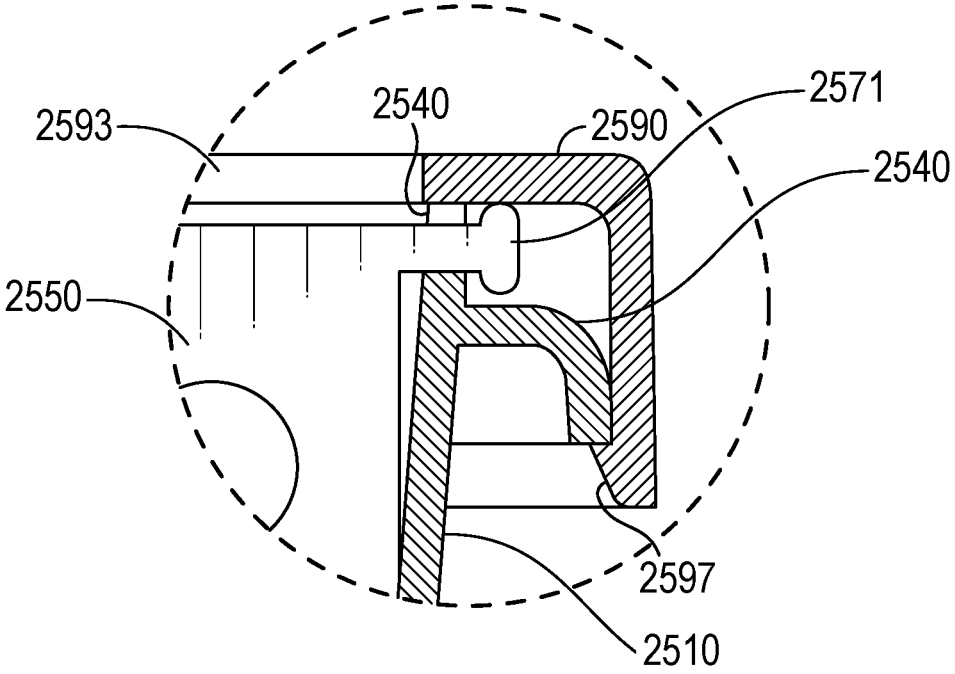
FIG. 28 is a detailed view of FIG. 27 showing the interface of the retainer lid, the raised perimeter edge of the storage container, and the divider in accordance with a representative embodiment of the present invention.

Retainer lid 2590 further comprises one or more catch features 2593 positioned on the inner surface and near the bottom edge of retainer lid 2590, wherein catch feature 2593 are configured to provide a mechanical connection between retainer lid 2590 and rim 2540, as most clearly shown in FIGS. 27 and 28. In some instances, retainer lid 2590 is secured to base 2510 by pushing retainer lid 2590 downwardly onto rim 2540 such that the catch features 2593 temporarily bias outwardly and slide down along the outer surface of rim 2540 until the point at which the catch features 2593 bypass the bottommost edge of rim 2590, at which point the elastic properties of retainer lid 2590 permit the catch features 2593 to return to the original configuration whereby the catch features 2593 are engaged with the bottommost edge or underside surface of rim 2590. Retainer lid 2590 is removed by manually biasing the catch features 2593 outwardly from rim 2590 until a point at which the catch features 2593 are no longer engaged with the underside surface of rim 2590, at which point the retainer lid 2590 is removed from base 2510.

In some instances, retainer lid 2590 further comprises one or more alignment tabs 2596 configured to contact one or more surfaces of base 2510. For example, in some embodiments one or more alignment tabs 2596 are configured to contact an interior sidewall 2520 of base 2510. In some embodiments, one or more alignment tabs 2596 are configured to seat within forward and rearward compartments 2532, 2534. Alignment tabs 2596 may be configured to assist in proper placement of retainer lid 2590 on base 2510. In some instances, alignment tabs 2596 may provide structural reinforcement or rigidity to various portion of retainer lid 2590, such as center support 2591.

In some instances, storage container 2500 comprises a raised perimeter edge 2518 having a plurality of u-shaped receptacles 2540 having vertical sidewalls and a rounded bottom configured to receive a peg extension 2571 of a divider 2550. Divider 2550 may also comprise a plurality of u-shaped receptacles 2540. To retain the peg extension 2571 within the u-shaped receptacles 2540, portions of retainer lid 2590 are configured to overlap the raised perimeter edge 2518 of the storage container such that the peg extension 2571 is prevented from being removed from the u-shaped receptacle 2540 when the retainer lid 2590 is secured to the base 2510. In some instances, retainer lid 2590 contacts peg extension 2571 when retainer lid 2590 is secured to base 2510. In some instances, retainer lid 2590 contacts and pushes peg extension 2571 fully into the u-shaped receptacle 2540 when the retainer lid 2590 is secured to the base 2510.

In some embodiments, the present invention provides a method for assembling a storage container, said method comprising steps for: i) providing a storage container comprising a plurality of receptacles, ii) inserting a divider or equivalent part into the storage container by seating a peg extension of the divider into the plurality of receptacles, and iii) retaining the seated position of the peg extension in the plurality of receptacles by securing a retainer lid to the storage container. In some embodiments, the present invention provides a method for retaining a divider or equivalent part in a storage container, said method comprising steps for: i) providing a storage container comprising a plurality of receptacles, ii) inserting a divider or equivalent part into the base portion of the storage container by seating a portion of the divider into one or more of the plurality of receptacles, and iii) securing a retainer lid to the base portion of the storage container, wherein the retainer lid prevents the divider from being displaced or removed from the plurality of receptacles.

Some embodiments of the present invention further include a kit comprising a container and at least one divider. In some instances, a kit of the present invention comprises a container and at least one divider comprising a tool and/or tool surface. In some embodiments, a kit of the present invention comprises a container and a selection of dividers. In some instances, the individual dividers in a selection of dividers are selected based upon a desired discipline or intended application of use. In some embodiments, the components of a kit are preselected based upon a desired discipline or intended application of use. In some embodiments, the components of a kit are selected by a user based upon a desired discipline or intended application of use for the user. In some embodiments, a kit further comprises a retainer lid.

For example, in some embodiments the present invention comprises a craft kit, wherein the craft kit comprises a container and at least one divider having a characteristic and/or use in the craft discipline. In some embodiments the present invention comprises a cleaning kit, wherein the cleaning kit comprises a container and at least one divider having a characteristic and/or use in the cleaning discipline. Additional and/or alternative non-limiting examples of desired disciplines and/or intended applications of use include: automotive mechanic, medical professional, first aid, auto detailing, sewing, art, administrative assistance, clerical, nursing, painting, drawing, embroidery, crocheting, knitting, notions, scrapbooking, tool storage, filing, cleaning, kitchen spices, kitchen utensils, and the like.

In some embodiments, the present invention comprises a method for providing a kit of the present invention. As an initial step of the method, a user identifies a desired discipline or intended application of use. The user then selects one or more dividers of the kit, wherein the one or more dividers includes a characteristic and/or use of the identified discipline or intended application of use. The user then combines the one or more dividers with a container of the invention to provide a kit. In some embodiments, the user of a method of the present invention is a consumer. In some embodiments, the user of a method of the present invention is a manufacturer. In some embodiments, the user of a method of the present invention is a distributor.

The present invention may be embodied in other specific forms without departing from its structures, methods, or other essential characteristics as broadly described herein and claimed hereinafter. The described embodiments and examples are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

All examples and conditional language recited herein are intended for pedagogical objects to aid the reader in understanding the invention and the concepts contributed by the inventor to furthering the art, and are to be construed as being without limitation to such specifically recited examples and conditions. Although implementations of the present inventions have been described in detail, it should be understood that the various changes, substitutions, and alterations could be made hereto without departing from the spirit and scope of the invention.

What is claim is:

1. A storage container, comprising:

a base having an interior floor surface comprising a plurality of grooves having a depth that extends below a plane of the interior floor surface;

an exterior sidewall coupled to the base and enclosing the base, the exterior sidewall having an inner surface, an outer surface and a raised perimeter edge interposed therebetween and defining an opening of the container;

a u-shaped engagement surface formed in the raised perimeter edge and having an opening formed in an upper edge of the raised perimeter edge and opening out through the upper edge, the u-shaped engagement surface and the opening providing a pathway through the raised perimeter edge such that the inner and outer surfaces of the exterior sidewall are in communication via the pathway and the opening, the u-shaped engagement surface in alignment with at least one of the plurality of grooves; and a divider having a bottom edge configured to engage one of the plurality of grooves, a top edge opposite the bottom edge, and a side edge extending therebetween, wherein a height of the side edge is greater than a distance between the interior floor surface and the upper edge of the raised perimeter edge, wherein the height of the side edge is less than a distance between a bottom surface of the u-shaped engagement surface and a lowest portion of the depth of the plurality of grooves.

2. The storage container of claim 1, wherein the plurality of grooves are interconnected to form a reservoir located below the plane of the interior floor surface.

3. The storage container of claim 1, further comprising a channel dividing the base into a right half and a left half, a right side and a left side of the channel being defined by interior sidewalls coupled to the exterior sidewall and enclosing the right and left halves of the base.

4. The storage container of claim 3, wherein the channel further comprises a handle interposed between the right and left halves.

5. The storage container of claim 4, further comprising an opening formed in the channel and extending between a first base and a second base of the handle.

6. The storage container of claim 3, wherein the channel further comprises forward and rearward compartments each having a height that is less than a height of the exterior sidewall.

7. The storage container of claim 6, wherein at least one of the forward and rearward compartments further comprises a drain hole.

8. The storage container of claim 1, wherein the u-shaped engagement surface is configured to selectively receive a peg extension of a divider such that when the peg extension is engaged with the u-shaped engagement surface, a proximal portion of the peg extension is positioned in proximity to the inner surface of the exterior sidewall, a distal portion of the peg extension is positioned in proximity to the outer surface of the exterior sidewall, and a middle portion of the peg extension extends through the pathway, such that the proximal and distal portions of the peg extension are positioned external to the pathway.

9. The storage container of claim 1, wherein the exterior sidewall tapers outwardly from the interior floor surface to the raised perimeter edge.

10. The storage container of claim 1, further comprising a retainer lid configured to couple to the raised perimeter edge and having an opening through which an interior volume of the base may be accessed, a portion of the retainer lid configured to cover the raised perimeter edge and entirely overlap the opening and pathway of the u-shaped engagement surface.

11. The storage container of claim 10, wherein the retainer lid further comprises a catch feature configured to selectively retain a rim portion of the exterior sidewall.

12. The storage container of claim 10, wherein the retainer lid further comprises a center support having an opening configured to receive a handle of the base.

13. A storage system, comprising:

a storage container, comprising:

a base having an interior floor surface comprising a plurality of grooves having a depth that extends below a plane of the interior floor surface;

an exterior sidewall coupled to the base and enclosing the base, the exterior sidewall having an inner surface, an outer surface and a raised perimeter edge interposed therebetween and defining an opening of the container; and a receptacle formed in the raised perimeter edge, the receptacle having an opening formed in an upper edge of the raised perimeter edge and opening out through the upper edge, the receptacle providing a pathway through the raised perimeter edge such that the inner and outer surfaces of the exterior sidewall are in communication via the opening and the pathway, an engagement surface of the receptacle in alignment with at least one of the plurality of grooves; and a divider having a bottom edge configured to engage one of the plurality of grooves, a top edge opposite the bottom edge, and a side edge extending therebetween, wherein a height of the side edge is greater than a distance between the interior floor surface and the upper edge of the raised perimeter edge, wherein the height of the side edge is less than a distance between a bottom surface of the receptacle and a lowest portion of the depth of the plurality of grooves.

14. The storage system of claim 13, further comprising:

a retainer lid configured to couple to the raised perimeter edge and having an opening through which an interior volume of the base may be accessed, a portion of the retainer lid configured to cover the raised perimeter edge.

15. The storage system of claim 14, wherein the divider further comprises a peg extension extending outwardly from the side edge and having a proximal portion in proximity to the side edge, a distal portion opposite proximal portion and spaced from the side edge, and a middle portion interposed between the proximal and distal portion, wherein when the peg extension is engaged with the receptacle, the proximal portion of the peg extension is positioned in proximity to the inner surface of the exterior sidewall, the distal portion of the peg extension is positioned in proximity to the outer surface of the sidewall, and the middle portion of the peg extension extends through the pathway, such that the proximal and distal portions of the peg extension are positioned external to the pathway.

16. The storage system of claim 15, wherein the portion of the retainer lid overlaps the distal portion of the peg extension when the peg extension is engaged with the receptacle.

17. The storage system of claim 16, wherein the retainer lid maintains an engaged relationship between the peg extension and the receptacle when the retainer lid is coupled to the raised perimeter edge.

* * * * *